US008421717B2

(12) United States Patent
Ono

(10) Patent No.: US 8,421,717 B2
(45) Date of Patent: Apr. 16, 2013

(54) ACTIVE MATRIX TYPE DISPLAY APPARATUS

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 756 days.

(21) Appl. No.: 12/525,633

(22) PCT Filed: Dec. 16, 2008

(86) PCT No.: PCT/JP2008/003776

§ 371 (c)(1),
(2), (4) Date: Aug. 3, 2009

(87) PCT Pub. No.: WO2009/078166

PCT Pub. Date: Jun. 25, 2009

(65) Prior Publication Data

US 2010/0110055 A1 May 6, 2010

(30) Foreign Application Priority Data

Dec. 19, 2007 (JP) ..... 2007-327432

(51) Int. Cl.
*G09G 3/30* (2006.01)

(52) U.S. Cl.
USPC ..... 345/76; 345/87

(58) Field of Classification Search ..... 345/76–83, 345/87–104
See application file for complete search history.

(56) References Cited

U.S. PATENT DOCUMENTS

| | | | | |
|---|---|---|---|---|
| 2004/0196239 | A1* | 10/2004 | Kwon | 345/92 |
| 2006/0114200 | A1 | 6/2006 | Yamashita et al. | |
| 2006/0221005 | A1 | 10/2006 | Omata et al. | |
| 2006/0232678 | A1 | 10/2006 | Choi et al. | |
| 2007/0063993 | A1 | 3/2007 | Shishido | |
| 2007/0268217 | A1 | 11/2007 | Ahn et al. | |

FOREIGN PATENT DOCUMENTS

| | | |
|---|---|---|
| JP | 2003-066908 | 3/2003 |
| JP | 2003-195810 | 7/2003 |
| JP | 2004-310006 | 11/2004 |
| JP | 2004-310014 | 11/2004 |
| JP | 2006-154521 | 6/2006 |
| JP | 2006-268000 | 10/2006 |
| JP | 2006-309179 | 11/2006 |
| JP | 2007-108733 | 4/2007 |
| JP | 2007-310346 | 11/2007 |

* cited by examiner

*Primary Examiner* — Kevin M Nguyen
*Assistant Examiner* — Cory Almeida
(74) *Attorney, Agent, or Firm* — McDermott Will & Emery LLP

(57) ABSTRACT

An active matrix type display apparatus of the present invention includes a plurality of pixels (50) disposed in a matrix arrangement. Each of the pixels (50) includes a light-emitting element (9) which emits light in response to a supplied current, a signal line (13) connected to a signal line drive circuit (23) which supplies a luminance signal corresponding to a luminance of light emission of the light-emitting element (9), the luminance signal being a current signal, a driver element (6) which controls a current value of the luminance signal supplied to the light-emitting element (9), a luminance signal retention capacitor (8) which retains, as a luminance signal voltage, a potential difference generated between a drain electrode and a source electrode of the driver element (6) when the luminance signal is supplied to the driver element (6) via the signal line (13), and a threshold voltage detection and addition unit (20) which detects a threshold voltage of the driver element (6) and causes a voltage obtained by adding the luminance signal voltage being retained in the luminance signal retention capacitor (8) to the detected threshold voltage to be applied at a gate electrode of the driver element (6).

10 Claims, 55 Drawing Sheets

ACTIVE MATRIX TYPE DISPLAY APPARATUS

RELATED APPLICATIONS

This application is the U.S. National Phase under 35 U.S.C. §371 of International Application No. PCT/JP2008/003776, filed on Dec. 16, 2008, which in turn claims the benefit of Japanese Application No. 2007-327432, filed on Dec. 19, 2007, the disclosures of which Applications are incorporated by reference herein.

TECHNICAL FIELD

The present invention relates to a display apparatus of an active matrix type having a pixel circuit on a pixel-by-pixel basis, and more particularly, to one which causes luminance changes by controlling the light emission strength of a pixel with a pixel signal current.

BACKGROUND ART

Practical use of an organic EL display apparatus employing a spontaneously light-emitting organic electroluminescent (EL) element is expected as a next-generation display apparatus, as it requires no backlight which is needed in a liquid crystal display apparatus, so as to be most suited for a reduction in apparatus thickness, and has an unlimited viewing angle. In the organic EL element employed in an organic EL display apparatus, the luminance of each light-emitting element is controlled by the current value that flows therein, and the organic EL element differs in this respect from the crystal liquid cell in which control is made by the voltage applied.

The active matrix method in a display apparatus with an organic EL element is an effective method over a passive matrix method in lengthening the life of an organic EL element and making a large-sized screen, and is being the subject of active research and development activities. Active matrix methods are grouped into a voltage writing method and a current writing method, depending on the type of a signal written into each pixel.

In an organic EL display apparatus according to the active matrix method, the brightness of each pixel is determined by the current value that flows to the organic EL element implemented in each pixel, and a control for the current value is performed by the voltage applied between the gate and the source electrodes of a drive transistor connected in series to the organic EL element. Generally, in many cases, the threshold voltage and mobility, the electric and physical characteristics of a drive transistor, vary in stability and uniformity among pixels, depending on the production process, material composition, and structure of the transistor. Therefore, reports are actively being made on the research to introduce a pixel compensation circuit and enhance the uniformity among the pixels.

With the above voltage writing method, compensation may be made only for the threshold voltage of the drive transistor, while with the above current writing method both the threshold voltage and the mobility may be compensated. In principle, the current writing method, capable of compensation for both the threshold voltage and the mobility, can easily realize display characteristics of high uniformity as compared with the voltage writing method.

A conventional pixel compensation circuit according to the current writing method is disclosed in patent document 1. FIGS. 50 and 51 show the conventional pixel compensation circuit according to the current writing method and the timing chart that represents the operation of the pixel compensation circuit, respectively. In this conventional technique, a second power line 109 is controlled as a scan line, and the diode characteristics of a light-emitting element 105 is utilized to provide on-off controls of the current flowing to the light-emitting element 105. The operation of this pixel compensation circuit will be described.

Immediately before the time period A shown in FIG. 51, the potential of the second power line 109 is made at least equal to or lower than the value of the potential of the first power line 108 plus the threshold voltage of the light-emitting element 105, so as to prevent current flow to and light emission by the light-emitting element 105. It is assumed here for the sake of simplicity that the potential of the first power line 108 is 0 volt, and the potential of the second power line 109 during the time period A is also 0 volt. Thereafter, the first scan line 107 is put in a high potential state, and the first switching element 101 and the second switching element 102 are turned on. All the transistors constituting the pixel circuit in FIG. 50 are assumingly of an n-channel type. In this instance, the signal line drive circuit 111 connected to the signal line 106 pulls a current signal Idata out of the signal line. Now that the first switching element 101 is in the on state, a connection is made between the signal line drive circuit 111 and the current retention unit 110 of the pixel 500, so that the current signal Idata flows from the second power line 109 to the signal line 106 via the driver element 103 and the first switching element 101. At this time, because the light-emitting element 105 is not applied with a forward voltage, no current flows thereto. Furthermore, as the second switching element 102 is in the on state, the voltages of the drain electrode and the source electrode of the driver element 103 are applied to both ends of the luminance signal retention capacitor 104. In other words, the potential difference Vds between the drain electrode and the source electrode is represented by the following equation (1).

$$Vds=\sqrt{(2I\text{data}/\beta)}+Vth \qquad \text{Equation (1)}$$

where β is a value proportional to the mobility of the driver element 103 and is represented by the following equation (2).

$$\beta=\mu Cox(W/L) \qquad \text{Equation (2)}$$

where μ is the mobility of the driver element 103, Cox is the gate oxide film capacity of the driver element 103, W is the channel width of the driver element 103, L is the channel length of the driver element 103, and Vth is the threshold voltage of the driver element 103.

Thereafter, if the first scan line 107 is turned to a low voltage state to turn off the first switching element 101 and the second switching element 102, and the second power line 109 is turned to a high voltage state such that the driver element 103 operates in the saturation region during the time period B, the current Ipix that flows to the light-emitting element 105 is made:

$$I\text{pix}=I\text{data} \qquad \text{Equation (3)}$$

owing to the potential between the gate electrode and the source electrode of the driver element 103 that is being maintained at the value of the equation (1) by the luminance signal retention capacitor 104. Therefore, the current Ipix that flows to the light-emitting element 105 does not contain the characteristic values of β and Vth of the driver element 103. Accordingly, it becomes possible to compensate for variations in the mobility and threshold voltage of the driver element 103 as well as for variations in transistor geometries.

Patent document 1: Japanese Patent Application Publication No. 2003-195810 (page 21; FIGS. 5 and 7)

DISCLOSURE OF THE INVENTION

Problem to be Solved by the Invention

Even in an active matrix organic EL display apparatus with an amorphous silicon transistor, such as the one in patent publication 1, which is rated as having a relatively high in-plane uniformity of mobility, the temperature dependency of the mobility is high. Because of this, there arises a problem that the luminance of a light-emitting element varies if the temperature changes depending on the place of its display area, or if the temperature of its usage environment changes. Furthermore, there is also a problem that, due to the misalignment of a mask on a production lot basis, which mask is used during the light exposure process when producing transistor substrates, variations in the transistor geometries and the like occur. In consideration of these, the development of a highly reliable compensation circuit according to the current writing method is important.

Moreover, also in the active matrix organic EL display apparatus that employs a polysilicon transistor with a large in-plane mobility variation, it is preferable to use a compensation circuit according to the current writing method as a means for correcting the variations in mobility.

On the other hand, there exists the instability of an element called threshold voltage shifts in an amorphous silicon transistor, and there exist threshold voltage variations as well as mobility variations in a polysilicon transistor. With the conventional technique as shown in FIG. 50, because Vth and β are simultaneously detected at the time of data current writing, if the initial threshold voltage of the driver element 103 is assumed to be 0 volt, the range of voltage which the power line drive circuit 111 needs to output is from 0 volt to $-\sqrt{(2\max(Idata)/\beta)}+\max(Vth)$ based on the equation (1). As is apparent from this, there has been a problem that, especially where the threshold voltage shift of the driver element 103 is large, the design withstand voltage of the output stage of the signal line drive circuit 111 needs to be made large.

The present invention has been made in view of these circumstances, and an object thereof is to provide an active matrix type display apparatus which enables a reduction in the design withstand voltage of the output stage of a signal line drive circuit by correcting the threshold voltage on a pixel-by-pixel basis.

Means to Solve the Problem

In order to solve the above problem, the present invention provides an active matrix type display apparatus including a plurality of pixels disposed in a matrix arrangement, each of the pixels including: a light-emitting element which emits light in response to a supplied current; a signal line connected to a signal line drive circuit which supplies a luminance signal corresponding to a luminance of light emission of the light-emitting element, the luminance signal being a current signal; a driver element which controls a current value of the luminance signal supplied to the light-emitting element; a luminance signal retention capacitor which retains, as a luminance signal voltage, a potential difference generated between a drain electrode and a source electrode of the driver element when the luminance signal is supplied to the driver element via the signal line; and a threshold voltage detection and addition unit which detects a threshold voltage of the driver element and causes a voltage obtained by adding the luminance signal voltage being retained in the luminance signal retention capacitor to the detected threshold voltage to be applied at a gate electrode of the driver element.

Furthermore, the present invention also provides an active matrix type display apparatus including a plurality of pixels disposed in a matrix arrangement, each of the pixels including: a light-emitting element having a first electrode and a second electrode, which emits light in response to a current supplied via the first and second electrodes; a first power line connected to the first electrode of the light-emitting element; a second power line; a signal line connected to a signal line drive circuit which supplies a luminance signal corresponding to a luminance of light emission of the light-emitting element, the luminance signal being a current signal; a first switching element, one of a drain electrode and a source electrode of which is connected to the signal line, and which has a gate electrode connected to a first scan line; a driver element, one of a drain electrode and a source electrode of which is connected to the other of the drain electrode and the source electrode of the first switching element, and the other of which is connected to the second electrode of the light-emitting element or to the second power line; a luminance signal retention capacitor having a first electrode and a second electrode, the second electrode being connected to the source electrode of the driver element; a second switching element, one of a drain electrode and a source electrode of which is connected to the first electrode of the luminance signal retention capacitor, and the other of which is connected to the signal line or to the drain electrode of the driver element; and a threshold voltage detection and addition unit having a first terminal connected to the gate electrode of the driver element, a second terminal connected to the first electrode of the luminance signal retention capacitor, and a third terminal connected to a second scan line, which detects a threshold voltage of the driver element and causes a voltage obtained by adding the threshold voltage to a potential of the second terminal to be applied at the first terminal.

According to the above configurations of the present invention, by correcting the threshold voltage on a pixel-by-pixel basis, a reduction can be made in the design withstand voltage of the output stage of the signal line drive circuit.

Here, the threshold voltage detection and addition unit may include a threshold voltage retention capacitor having a first electrode connected to the first terminal and a second electrode connected to the second terminal.

Furthermore, the driver element may be an n-channel type transistor, the threshold voltage detection and addition unit may include: a first diode element having an anode terminal connected to the first terminal and a cathode terminal connected to the second terminal; and a second diode element having an anode terminal connected to the third terminal and a cathode terminal connected to the first terminal, and a threshold voltage of the first diode element may be controlled such that a value obtained by dividing an absolute value of the threshold voltage of the first diode element by an absolute value of the threshold voltage of the driver element becomes a positive value of 1 or less.

The driver element may be a p-channel type transistor, the threshold voltage detection and addition unit may include: a first diode element having a cathode terminal connected to the first terminal and an anode terminal connected to the second terminal; and a second diode element having a cathode terminal connected to the third terminal and an anode terminal connected to the first terminal, and a threshold voltage of the first diode element may be controlled such that a value obtained by dividing an absolute value of the threshold voltage of the first diode element by an absolute value of the threshold voltage of the driver element becomes a positive value of 1 or less.

The threshold voltage detection and addition unit may further include: a fourth terminal connected to the source electrode of the driver element, and each of the pixels may include: a third switching element, either one of a drain electrode and a source electrode of which is connected to the first terminal, and the other of which is connected to the fourth terminal, and which has a gate electrode connected to the third terminal.

The threshold voltage detection and addition unit may further include: a fourth terminal connected to the drain electrode of the driver element, and may further include: a third switching element, one of a drain electrode and a source electrode of which is connected to the first terminal, and the other of which is connected to the fourth terminal.

The threshold voltage detection and addition unit may further include: a fifth terminal; and a fourth switching element, one of a drain electrode and a source electrode of which is connected to the second terminal, and the other of which is connected to the fifth terminal.

Moreover, the present invention also provides an active matrix type display apparatus including a plurality of pixels disposed in a matrix arrangement, each of the pixels including: a light-emitting element having a first electrode and a second electrode, which emits light in response to a current supplied via the first and second electrodes; a first power line connected to the first electrode of the light-emitting element; a second power line; a signal line connected to a signal line drive circuit which supplies a luminance signal corresponding to a luminance of light emission of the light-emitting element, the luminance signal being a current signal; a first switching element, one of a drain electrode and a source electrode of which is connected to the signal line, and which has a gate electrode connected to a first scan line; a reference driver element, one of a drain electrode and a source electrode of which is connected to the other of the drain electrode and the source electrode of the first switching element, and the other of which is connected to the second power line; a driver element having a source electrode connected to the second power line, a gate electrode connected to the gate electrode of the reference driver element, and a drain electrode connected to the second electrode of the light-emitting element; a luminance signal retention capacitor having a first electrode and a second electrode, the second electrode being connected to the source electrode of the reference driver element; a second switching element, one of a drain electrode and a source electrode of which is connected to the first electrode of the luminance signal retention capacitor, and the other of which is connected to the signal line or to the drain electrode of the reference driver element; and a threshold voltage detection and addition unit having a first terminal connected to the gate electrode of the reference driver element, a second terminal connected to the first electrode of the luminance signal retention capacitor, and a third terminal connected to a second scan line, which detects a threshold voltage of the reference driver element and causes a voltage obtained by adding the threshold voltage to a potential of the second terminal to be applied at the first terminal.

According to the above configuration of the present invention, by correcting the threshold voltage on a pixel-by-pixel basis, a reduction can be made in the design withstand voltage of the output stage of the signal line drive circuit.

Here, the threshold voltage detection and addition unit may include: a threshold voltage retention capacitor having a first electrode connected to the first terminal and a second electrode connected to the second terminal.

Furthermore, the reference driver element may be an n-channel type transistor, the threshold voltage detection and addition unit may include: a first diode element having an anode terminal connected to the first terminal and a cathode terminal connected to the second terminal; and a second diode element having an anode terminal connected to the third terminal and a cathode terminal connected to the first terminal, and a threshold voltage of the first diode element may be controlled such that a value obtained by dividing an absolute value of the threshold voltage of the first diode element by an absolute value of the threshold voltage of the reference driver element becomes a positive value of 1 or less.

The reference driver element may be a p-channel type transistor, the threshold voltage detection and addition unit may include: a first diode element having a cathode terminal connected to the first terminal and an anode terminal connected to the second terminal; and a second diode element having a cathode terminal connected to the third terminal and an anode terminal connected to the first terminal, and a threshold voltage of the first diode element may be controlled such that a value obtained by dividing an absolute value of the threshold voltage of the first diode element by an absolute value of the threshold voltage of the reference driver element becomes a positive value of 1 or less.

The threshold voltage detection and addition unit may further include: a fourth terminal connected to the source electrode of the reference driver element, and each of the pixels may include: a third switching element, either one of a drain electrode and a source electrode of which is connected to the second terminal, and the other of which is connected to the fourth terminal, and which has a gate electrode connected to the third terminal.

The threshold voltage detection and addition unit may further include: a fourth terminal connected to the drain electrode of the driver element, and may further include: a third switching element, one of a drain electrode and a source electrode of which is connected to the first terminal, and the other of which is connected to the fourth terminal.

The threshold voltage detection and addition unit may further include: a fifth terminal; and a fourth switching element, one of a drain electrode and a source electrode of which is connected to the second terminal, and the other of which is connected to the fifth terminal.

The switching element or the driver element may be constituted by a field-effect transistor.

The field-effect transistor may be constituted by a thin-film transistor.

Furthermore, the light-emitting element may be an organic EL element.

The above object, other objects, features and advantages of the present invention will become apparent from the following detailed description of its preferred embodiments with reference made to the accompanying drawings.

Effect of the Invention

According to an active matrix type display apparatus of the present invention, it becomes possible to set the design withstand voltage value of the output stage of the signal line drive circuit without depending on the allowable threshold voltage value of the driver element provided in each pixel, thereby realizing the lowering of the withstand voltage of the signal line drive circuit.

In addition, with the lowering of the withstand voltage of the signal line drive circuit, the downsizing and price reduction of the signal line drive circuit can also be realized.

DESCRIPTION OF REFERENCE NUMERALS

Figure 1A:
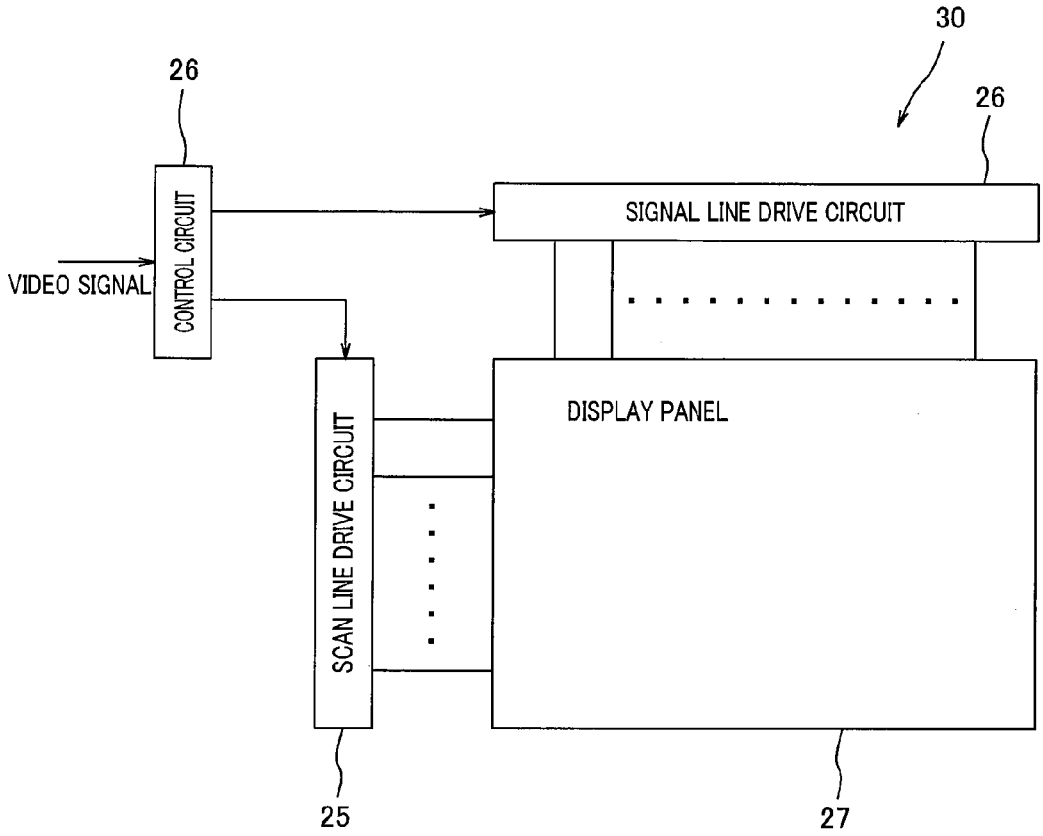
FIG. 1*a* is a block diagram showing the configuration of an active matrix type display apparatus according to an embodiment 1 of the present invention.

1 first switching element
2 second switching element
3 third switching element
4 fourth switching element
5 fifth switching element
6 driver element
7 threshold voltage retention capacitor
8 luminance signal retention capacitor
9 light-emitting element
10 first scan line
10*b* first scan line
11 second scan line
12 third scan line
13 signal line
14 first power line
15 second power line
20 threshold voltage detection and addition unit
21 current retention unit
22 reference driver element
23 signal line drive circuit
24 data writing unit
30 active matrix type display apparatus
50 pixel circuit (light-emitting element circuit)
200 first diode element
201 second diode element

BEST MODE FOR CARRYING OUT THE INVENTION

Preferred embodiments of the present invention will now be described with reference to the drawings.

Embodiment 1

[Configuration of Display Apparatus]

FIG. 1*a* is a block diagram showing the configuration of an active matrix type display apparatus (hereinafter simply referred to as "display apparatus") according to an embodiment 1 of the present invention. As illustrated in FIG. 1*a*, the display apparatus 30 includes a display panel 27 as well as a control circuit 26, a signal line drive circuit 23, and a scan line drive circuit 25 for driving this display panel 27.

The display panel 27 is a display device of an active matrix drive type. This display panel 27 and the signal line drive circuit 23 are connected via a plurality of signal lines, and the display panel 27 and the scan line drive circuit 25 are connected via a plurality of scan lines. Although not shown in FIG. 1*a*, these scan lines and signal lines are disposed in an alternately intersecting arrangement, and the later-described light-emitting element circuits are correspondingly disposed at their intersections. Thus, a plurality of light-emitting element circuits are disposed in a matrix arrangement.

The signal lines and the scan lines are respectively driven by the signal line drive circuit 23 and the scan line drive circuit 25. Additionally, the signal line drive circuit 23 and the scan line drive circuit 25 are controlled by the control circuit 26 which receives the video signals.

[Configuration of Light-Emitting Element Circuit]

Next, a description will be made of the configuration of the light-emitting element circuits disposed, as mentioned above, in the matrix arrangement.

Figure 1B:
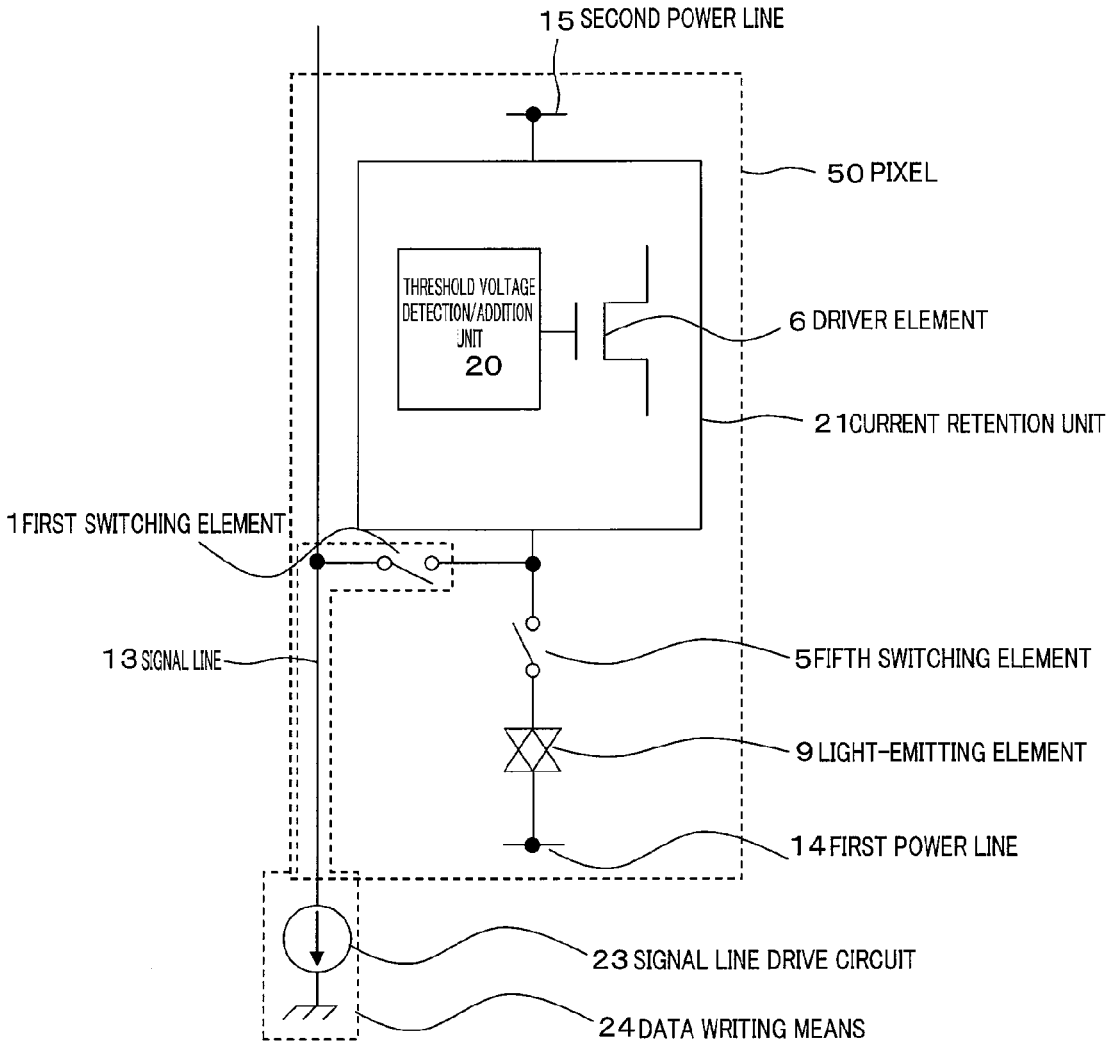
FIG. 1*b* is a block diagram showing the configuration of a light-emitting element circuit included in the display apparatus according to the embodiment 1 of the present invention.

FIG. 1*b* is a block diagram showing the configuration of a light-emitting element circuit included in the display apparatus according to the embodiment 1 of the present invention. As illustrated in FIG. 1*b*, the light-emitting element circuit denoted by the pixel 50 includes a light-emitting element 9 of an organic EL element that emits light in response to supplied current, and a current retention unit 21, which is provided with a driver element 6 for controlling the current value supplied to the light-emitting element 9, and a threshold voltage detection and addition unit 20 which detects the threshold voltage of the driver element 6 and causes the detected threshold voltage to be applied at the gate electrode of the driver element 6. This current retention unit 21 is connected to a signal line 13 via a first switching element 1 and to an electrode of the light-emitting element 9 via a fifth switching element 5, as well as to a second power line 15. The counter electrode of the light-emitting element 9 is connected to a first power line 14.

When the first switching element 1 is turned on while the fifth switching element 5 is in an off state, the current signal outputted to the signal line 13 by the signal line drive circuit 23 is supplied to the current retention unit 21. The function of the current retention unit 21 is to retain the potential difference generated between the drain electrode and the source electrode of the driver element 6 as a luminance signal voltage, and further to add the threshold voltage of the driver element 6 to the above luminance signal voltage and cause the resultant voltage to be applied at the gate electrode of the driver element 6.

A data writing means 24 is made up of the above signal line drive circuit 23 and first switching element 1.

Figure 2:
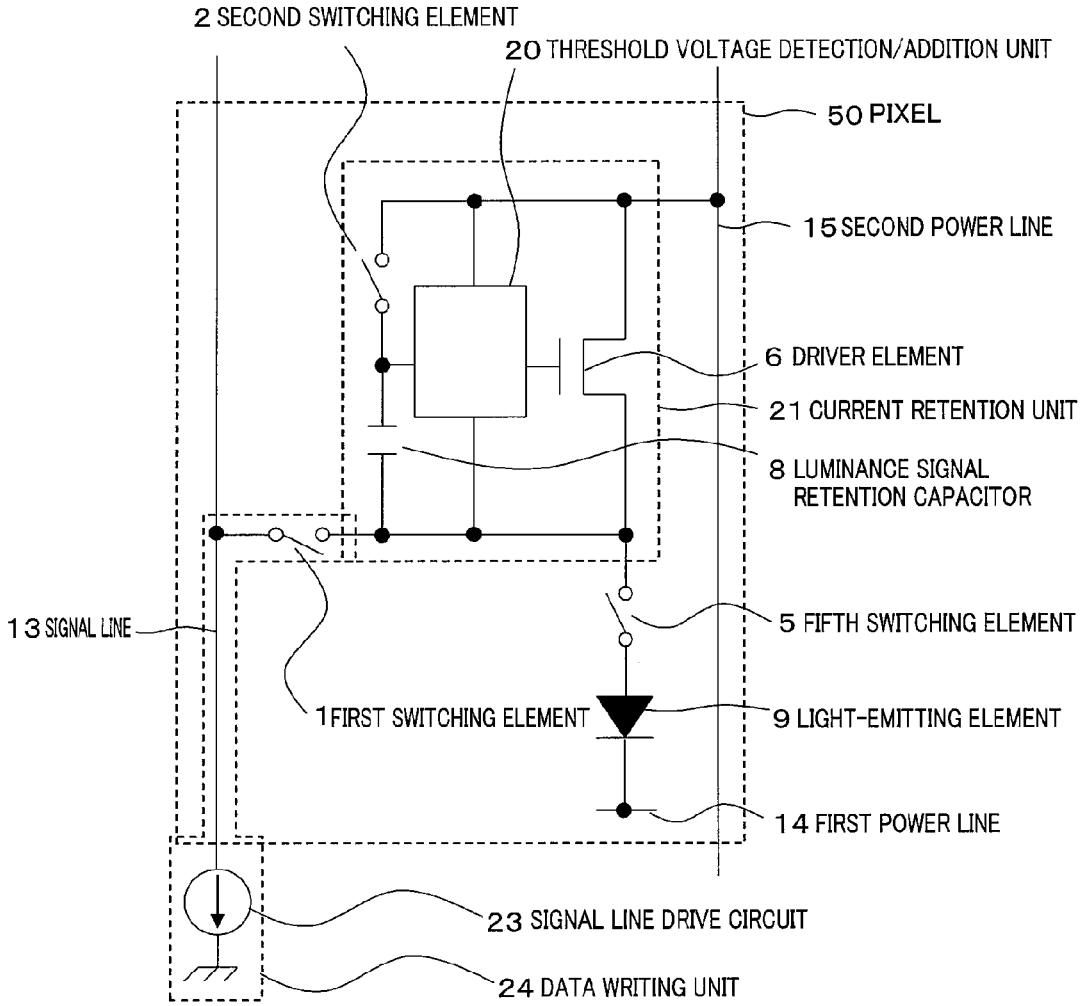
FIG. 2 is a block diagram showing the detailed configuration of a light-emitting element circuit included in the display apparatus according to the embodiment 1 of the present invention.

A further detailed configuration of the light-emitting element circuit is shown in FIGS. 2, 5, 7, 9, 11, and 13. As illustrated in FIG. 2, the current retention unit 21 includes a luminance signal retention capacitor 8 which retains, as a luminance signal voltage, the potential difference generated between the drain electrode and the source electrode of the driver element 6 when a luminance signal is supplied via the signal line 13, and a second switching element 2 provided between the threshold voltage detection and addition unit 20 and the second power line 15.

When the first switching element 1 is in the on state and the fifth switching element 5 is in the off state, the signal current outputted by the signal line drive circuit 23 flows through the driver element 6 by way of the signal line 13. At this time, because the second switching element 2 is in the on state, the voltage generated between the drain electrode and the source electrode of the driver element 6 is transmitted to the luminance signal retention capacitor 8. Thereafter, by turning the second switching element 2 off, the voltage is retained in the luminance signal retention capacitor 8.

While a signal current Idata is flowing through the driver element 6, the potential of the gate electrode of the driver element 6 is maintained by the threshold voltage detection and addition unit 20 at a higher level than the drain potential of the driver element 6 by as much as the threshold voltage of the driver element 6. Accordingly, the voltage generated and retained across both electrodes ends of the luminance signal retention capacitor 8 is represented by the following equation (4). It should be noted that β is calculated using the above equation (2).

$$\sqrt{(2I\text{data}/\beta)} \qquad \text{Equation (4)}$$

From this, it turns out that the output voltage at the current output stage of the signal line drive circuit 23 is unaffected by the threshold voltage of the driver element 6.

Figure 13:
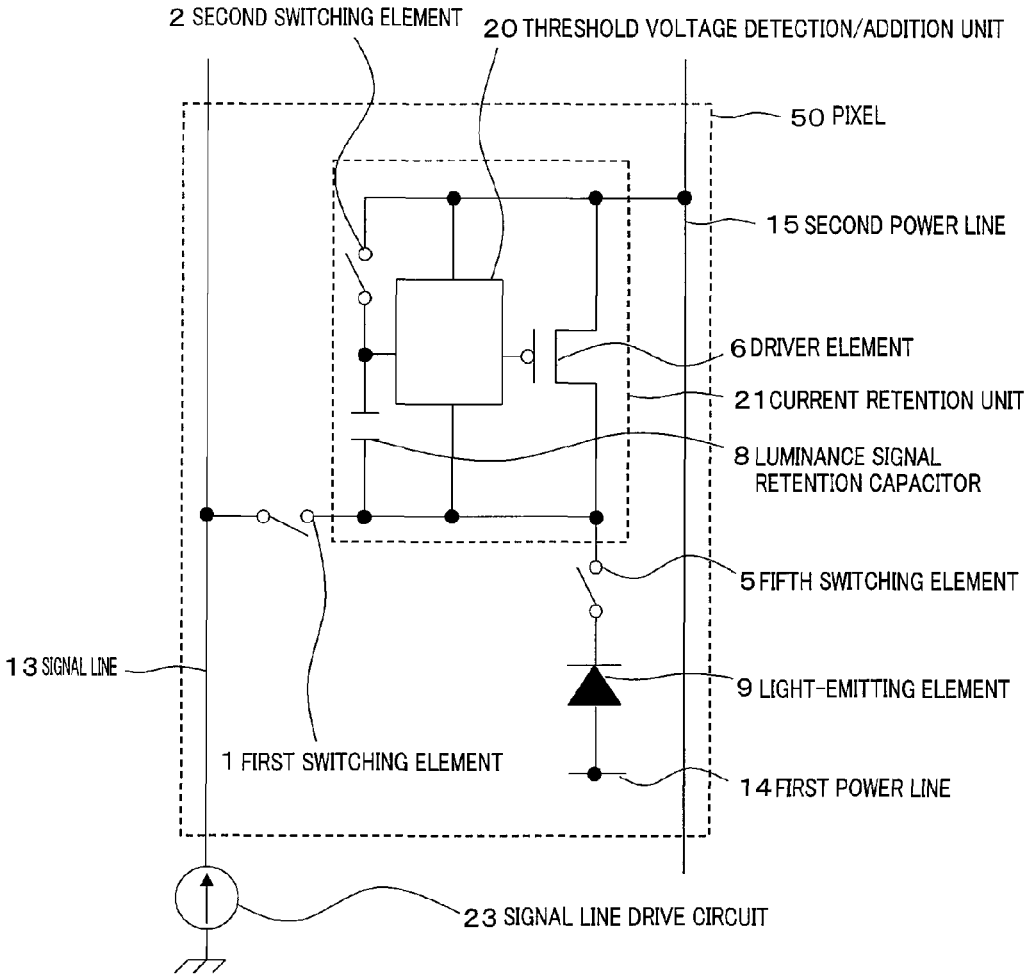
FIG. 13 is a block diagram showing the detailed configuration of a light-emitting element circuit included in the display apparatus according to the embodiment 1 of the present invention.
Figure 14:
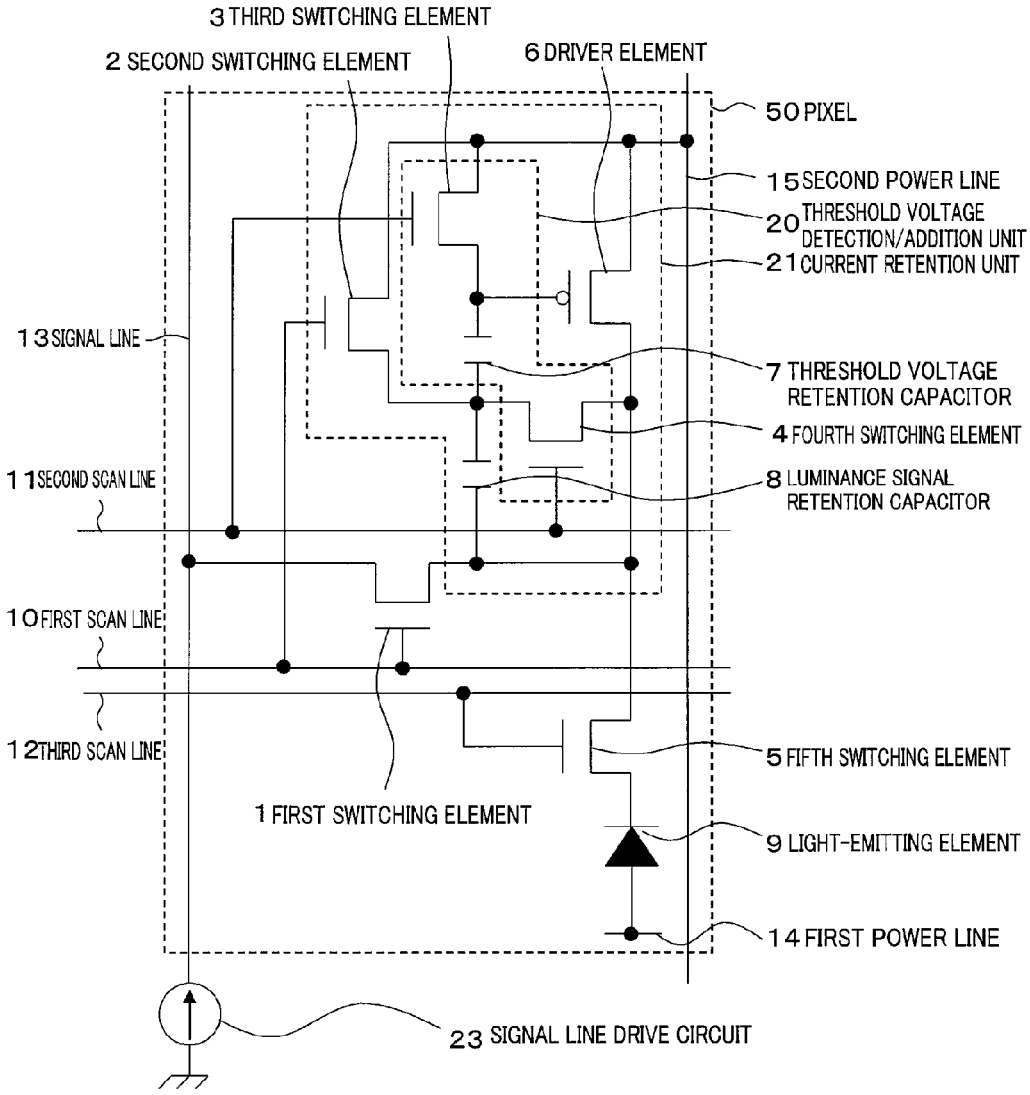
FIG. 14 is a circuit diagram showing the configuration of a light-emitting element circuit where the light-emitting element circuit of FIG. 13 is made up of an FET.

An example is shown in FIG. 13 in which the polarity of the light-emitting element 9 is reversed as compared with this example of FIG. 2.

Figure 5:
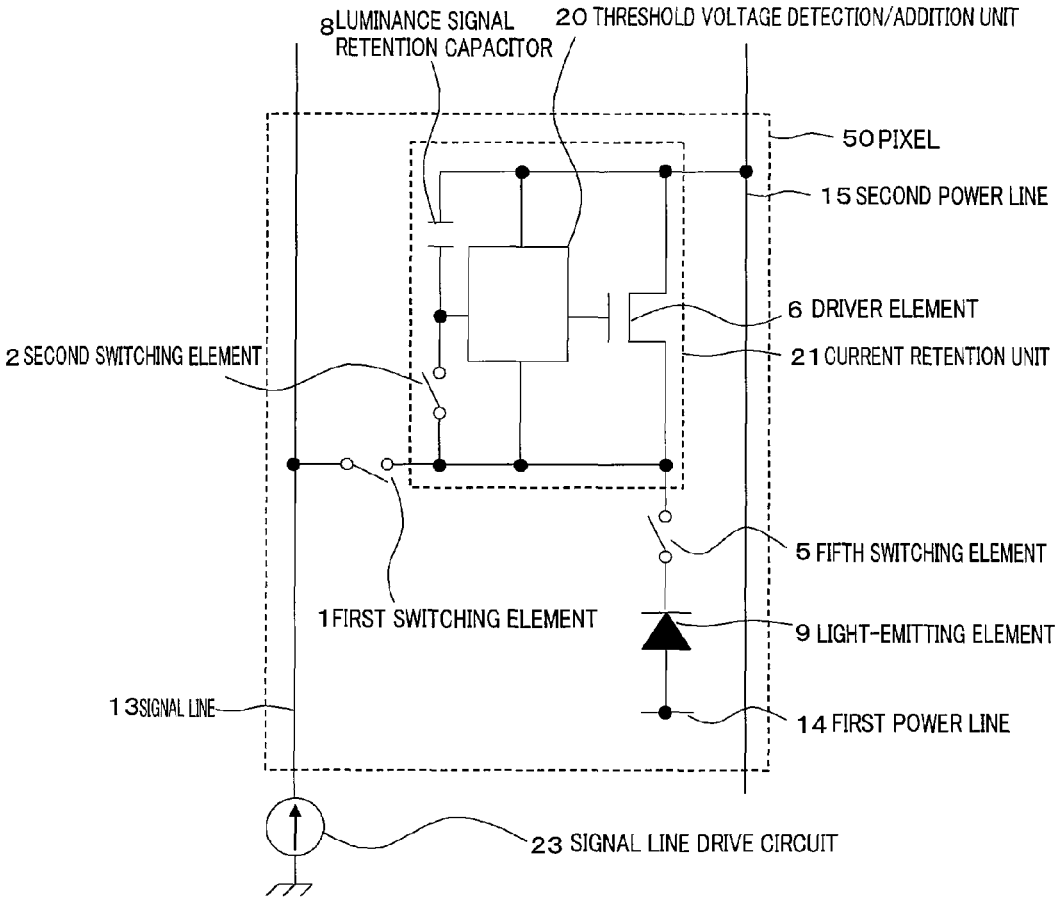
FIG. 5 is a block diagram showing the detailed configuration of a light-emitting element circuit included in the display apparatus according to the embodiment 1 of the present invention.
Figure 9:
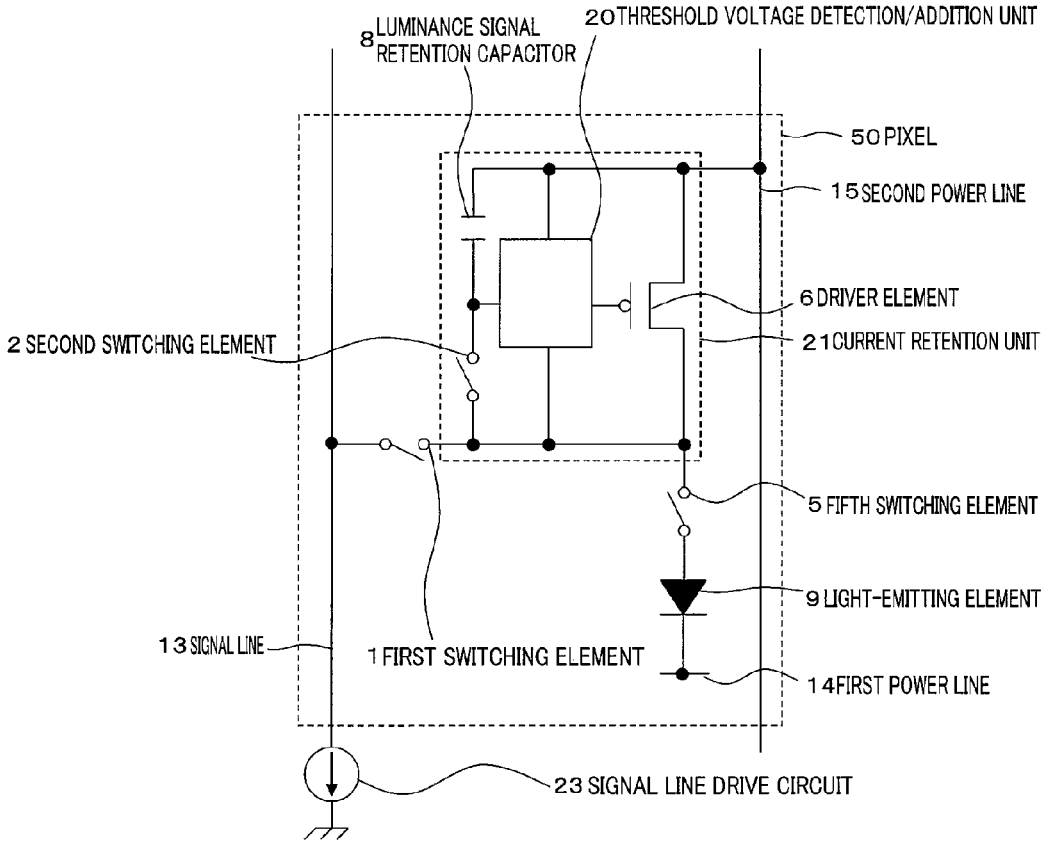
FIG. 9 is a block diagram showing the detailed configuration of a light-emitting element circuit included in the display apparatus according to the embodiment 1 of the present invention.
Figure 10:
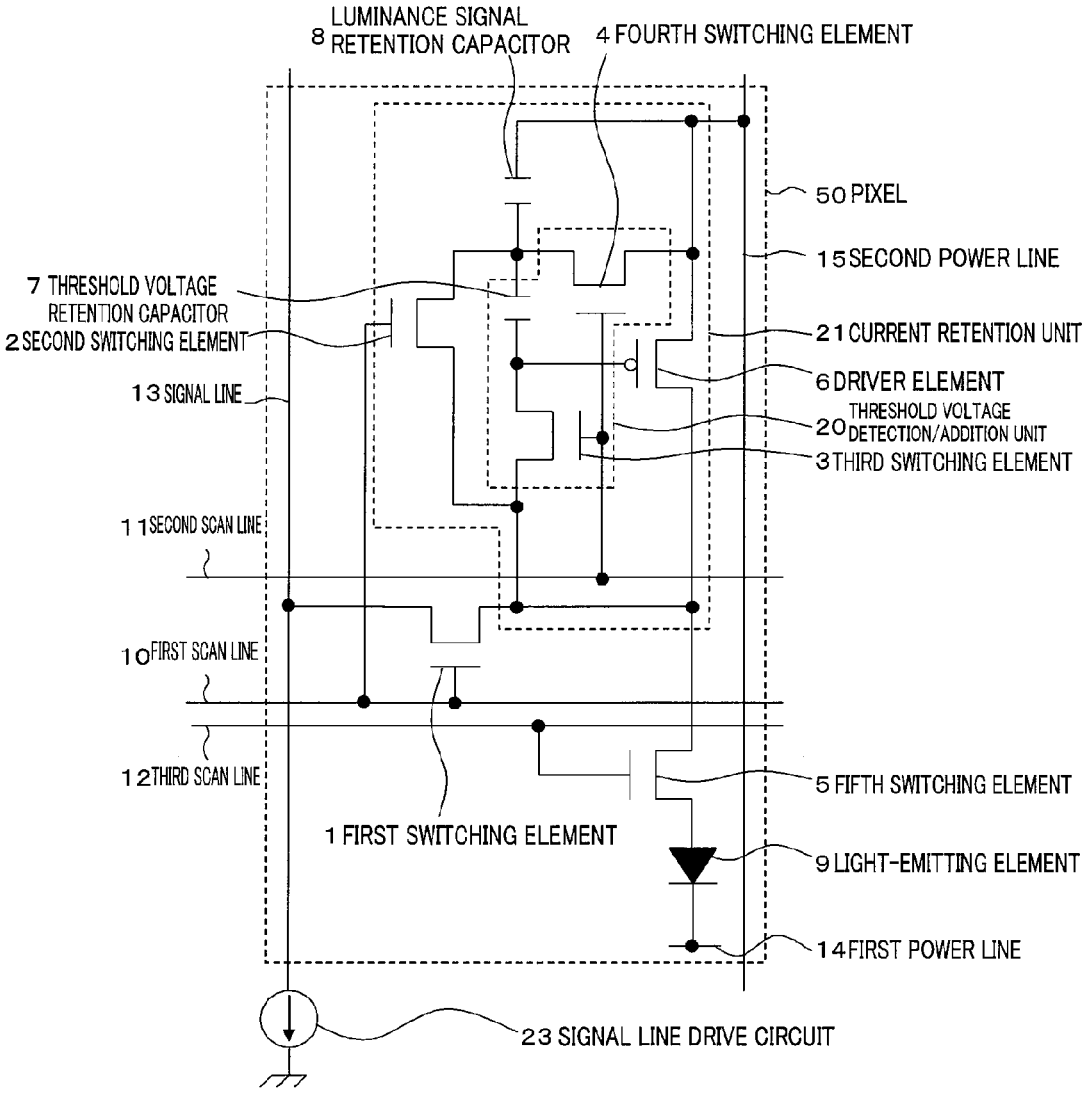
FIG. 10 is a circuit diagram showing the configuration of a light-emitting element circuit where the light-emitting element circuit of FIG. 9 is made up of an FET.

In addition, in the example illustrated in FIG. 5, the current retention unit 21 includes a second switching element 2 provided between the threshold voltage detection and addition unit 20 and the first switching element 1. An example is shown in FIG. 9 in which the light-emitting element 9 is opposite in polarity as compared with this example of FIG. 5.

Figure 7:
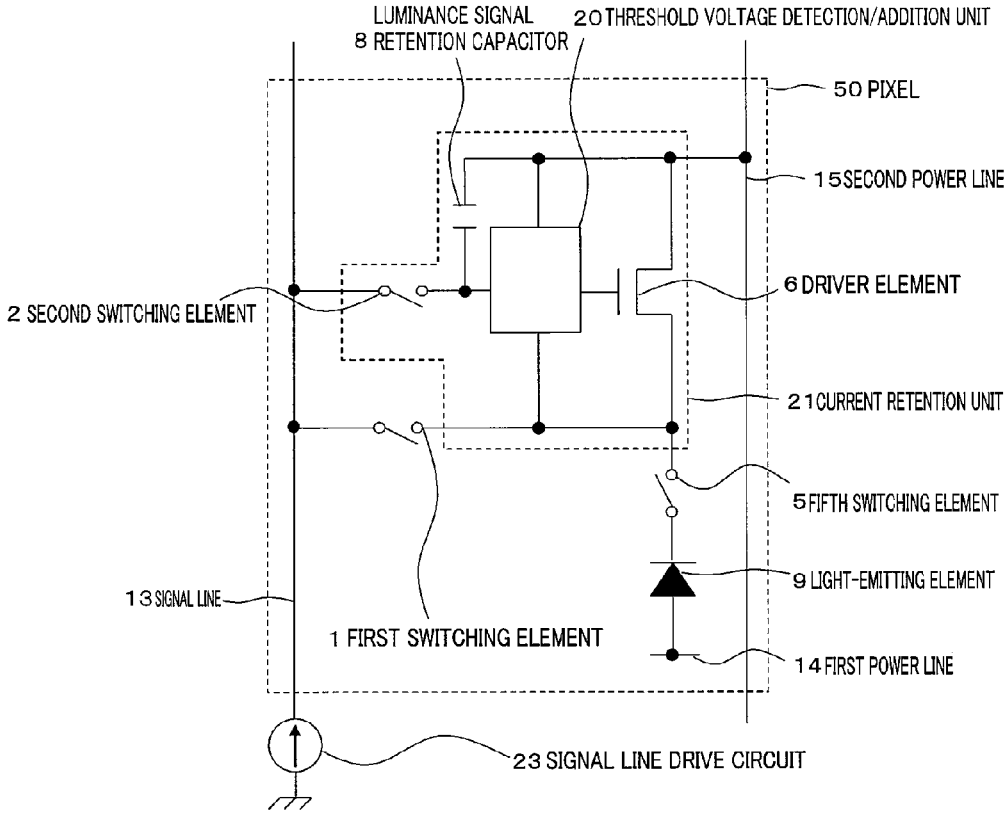
FIG. 7 is a block diagram showing the detailed configuration of a light-emitting element circuit included in the display apparatus according to the embodiment 1 of the present invention.
Figure 11:
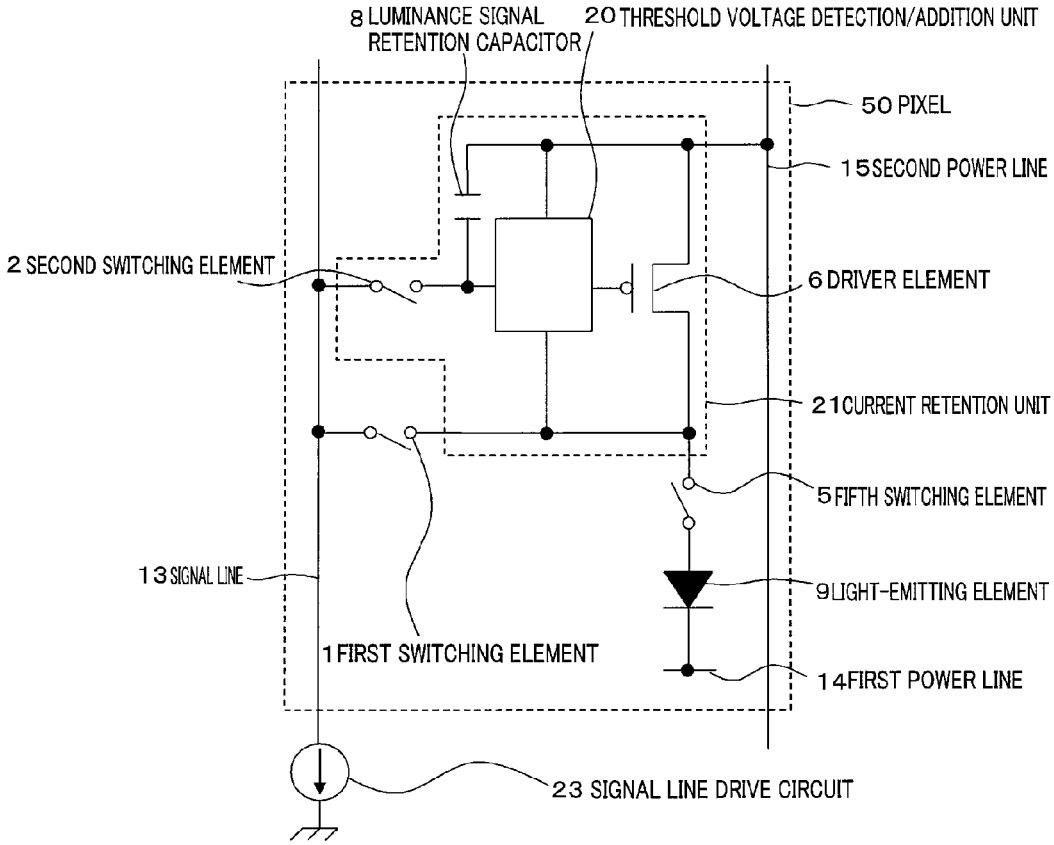
FIG. 11 is a block diagram showing the detailed configuration of a light-emitting element circuit included in the display apparatus according to the embodiment 1 of the present invention.

Furthermore, in the example illustrated in FIG. 7, the current retention unit 21 includes a second switching element 2 provided between the threshold voltage detection and addition unit 20 and the signal line 13. An example is shown in FIG. 11 in which the light-emitting element 9 is opposite in polarity as compared with this example of FIG. 5.

Figure 3:
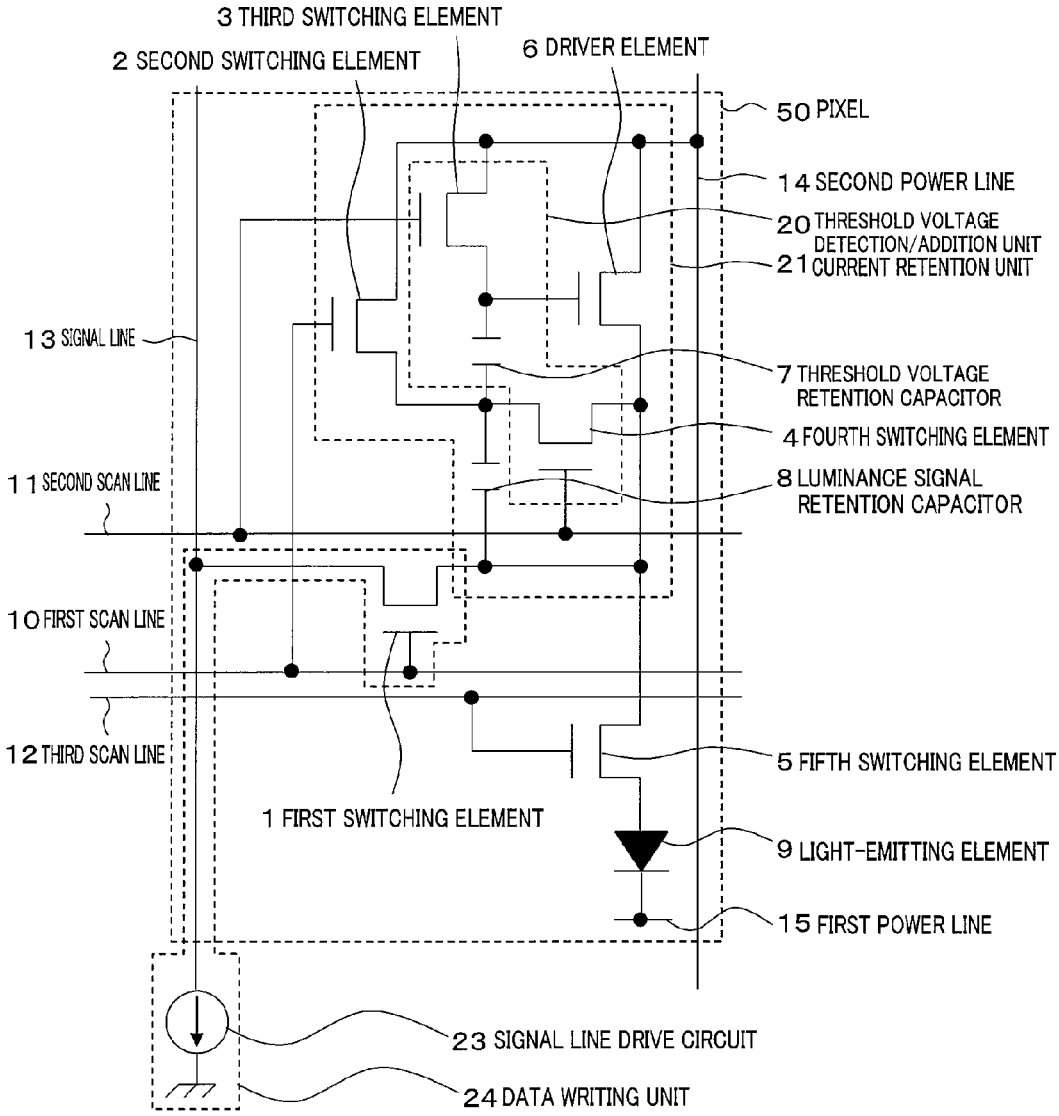
FIG. 3 is a circuit diagram showing the configuration of a light-emitting element circuit where the light-emitting element circuit of FIG. 2 is made up of an FET.
Figure 6:
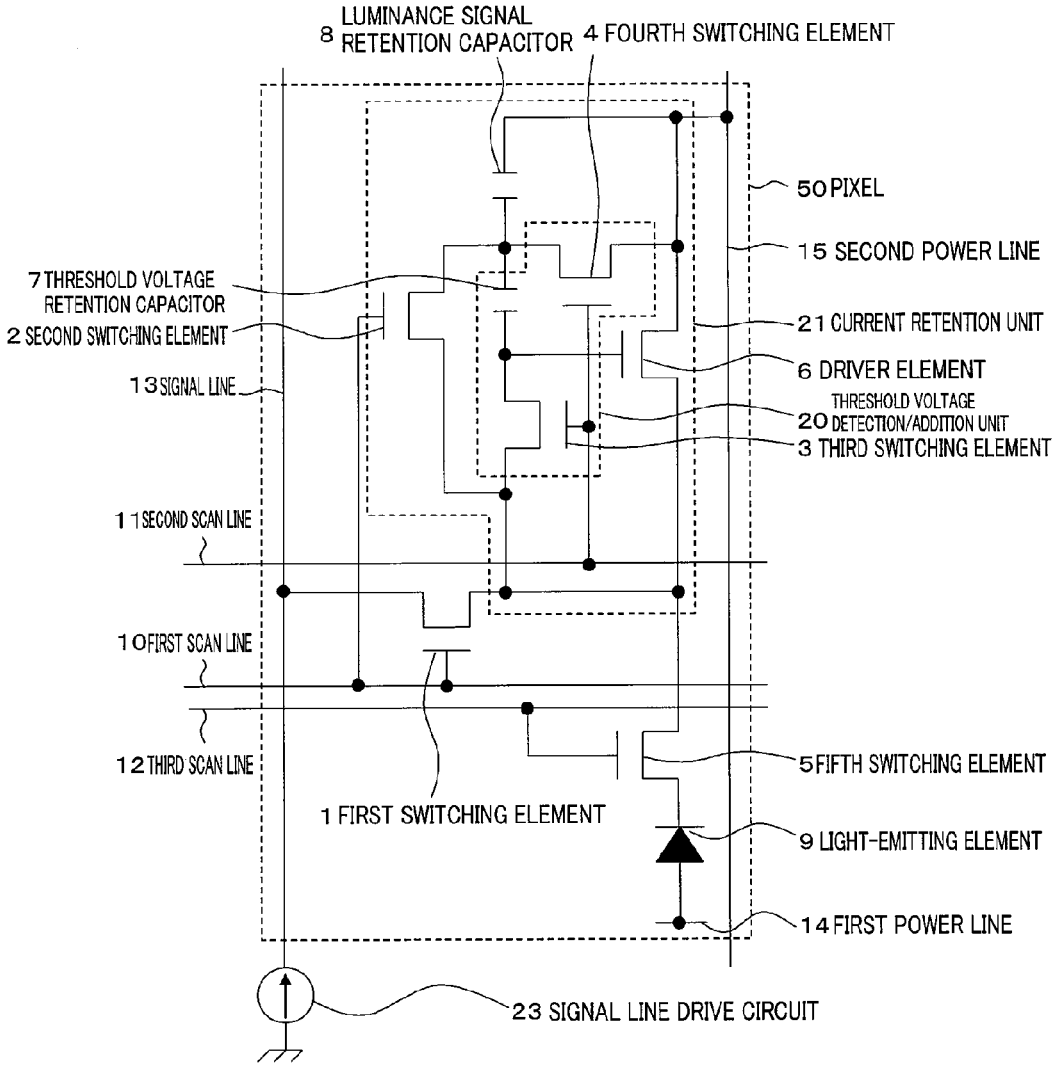
FIG. 6 is a circuit diagram showing the configuration of a light-emitting element circuit where the light-emitting element circuit of FIG. 5 is made up of an FET.
Figure 8A:
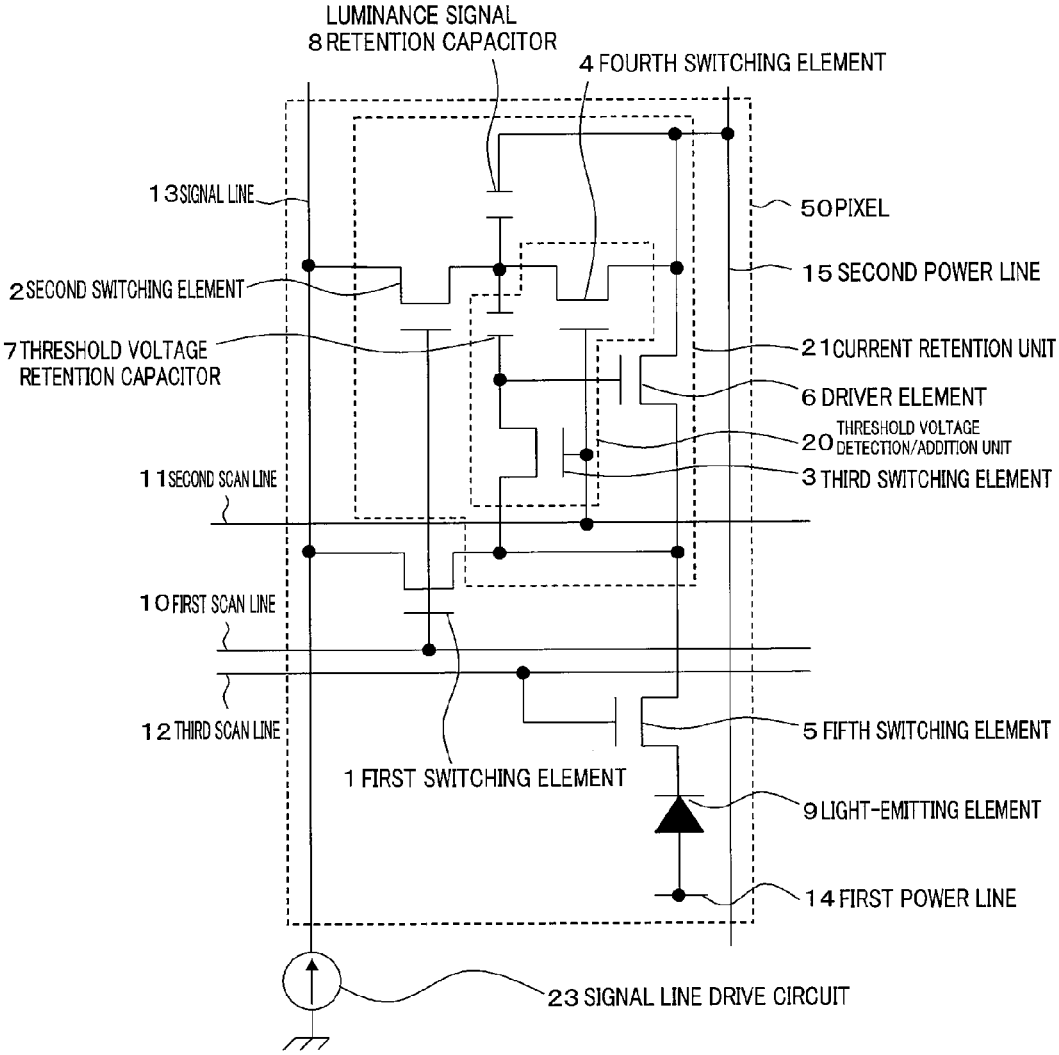
FIG. 8*a* is a circuit diagram showing the configuration of a light-emitting element circuit where the light-emitting element circuit of FIG. 7 is made up of an FET.

FIGS. 3, 6, 8*a* (and 8*b*), 10, 12*a* (and 12*b*), and 14 are circuit diagrams respectively showing the configurations of light-emitting element circuits where the light-emitting element circuits in FIGS. 2, 5, 7, 9, 11, and 13 are made up of an FET. This FET is constituted by a thin-film transistor.

In the example illustrated in FIG. 3, the threshold voltage detection and addition unit 20 provided in the current retention unit 21 includes a third switching element 3 for controlling connection between the gate electrode and the drain electrode of the driver element 6, a fourth switching element 4 for controlling connection between both electrodes of the luminance signal retention capacitor 8, and a threshold voltage retention capacitor 7 disposed between the gate electrode of the driver element 6 and the first electrode of the luminance signal retention capacitor 8.

The on-off operations of the first switching element 1 and the second switching element 2 are controlled by a first scan line 10, and the on-off operations of the third switching element 3 and the fourth switching element 4 are controlled by a second scan line 11. Additionally, the on-off operations of the fifth switching element 5 are controlled by a third scan line 12. These first to third scan lines 10 to 12 are driven by a scan line drive circuit.

Also in the examples shown in FIGS. 6, 8*a*, 10, 12*a*, and 14, as in the case of FIG. 3, the threshold voltage detection and addition unit 20 includes a third switching element 3, a fourth switching element 4, and a threshold voltage retention capacitor 7.

Figure 8B:
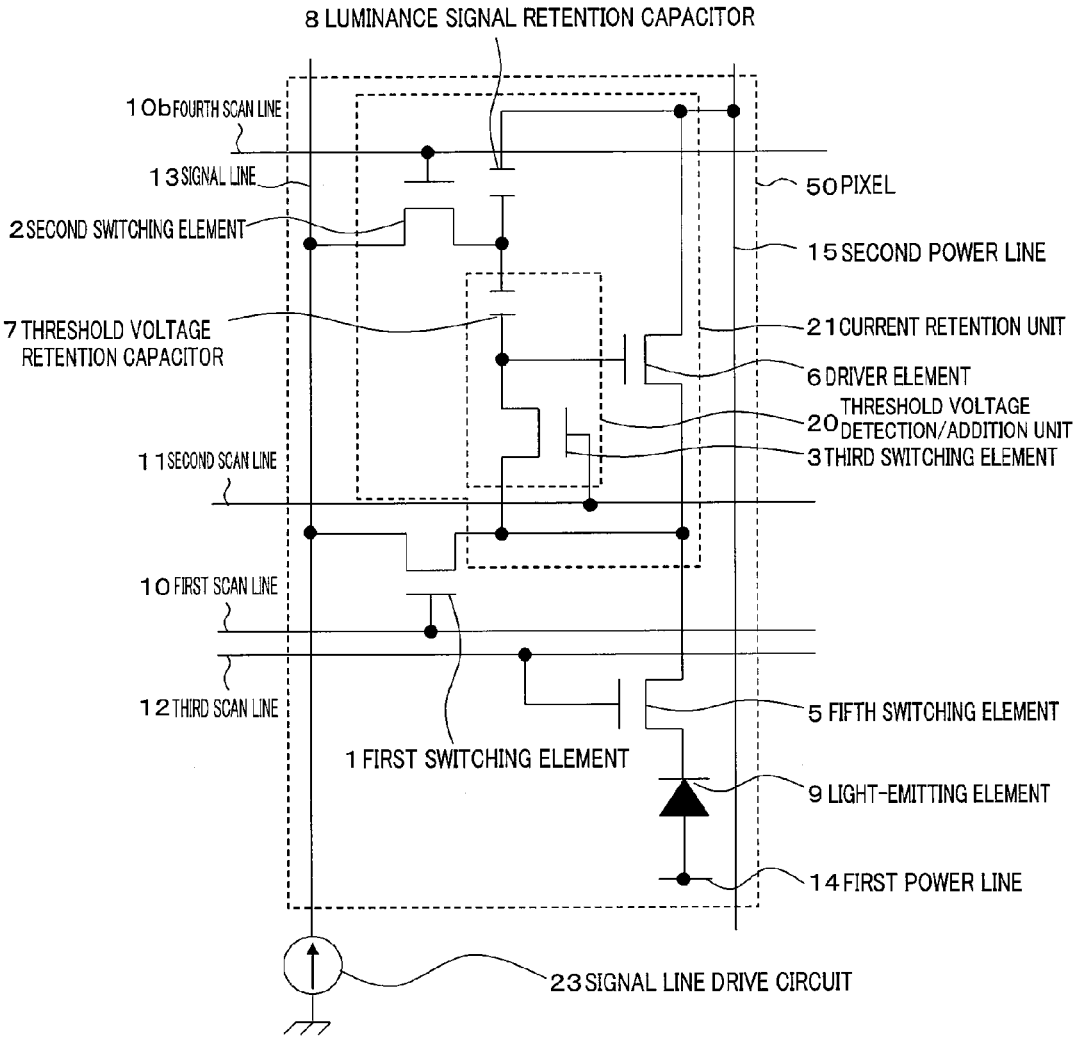
FIG. 8*b* is a circuit diagram showing the configuration of a light-emitting element circuit where the light-emitting element circuit of FIG. 7 is made up of an FET.
Figure 12A:
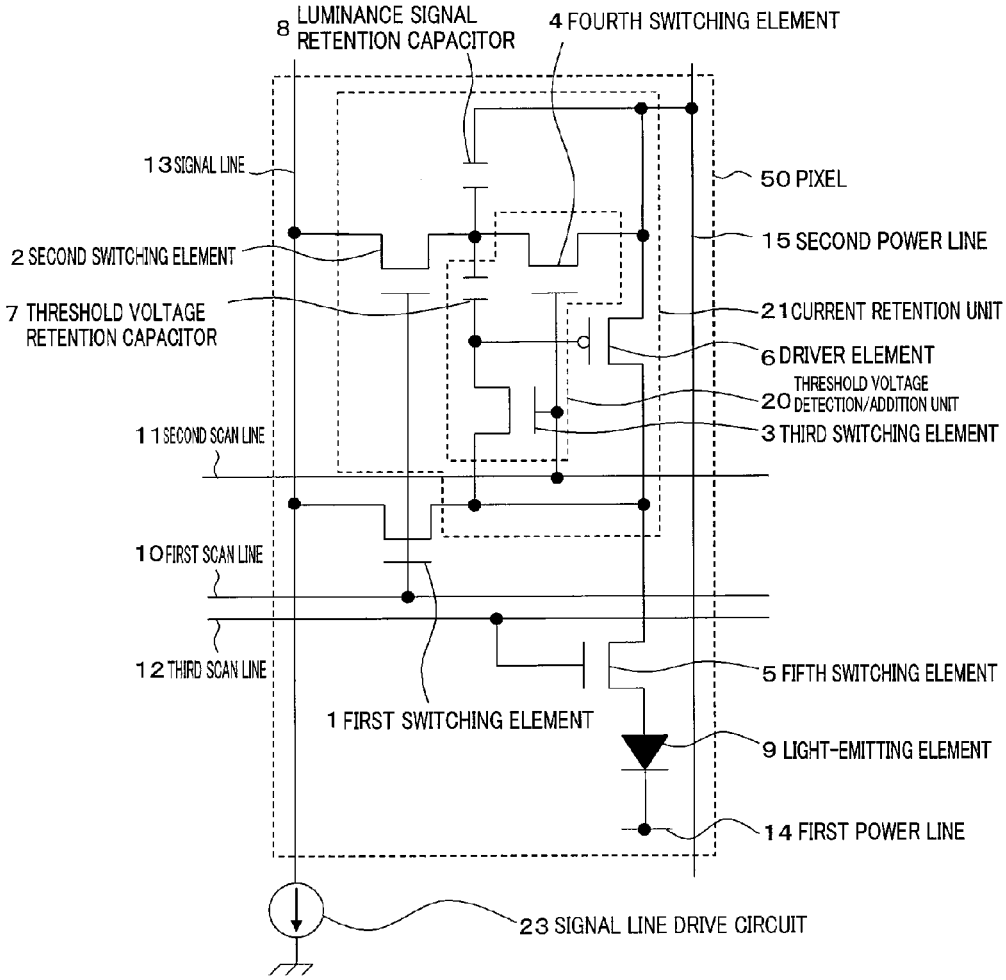
FIG. 12*a* is a circuit diagram showing the configuration of a light-emitting element circuit where the light-emitting element circuit of FIG. 11 is made up of an FET.
Figure 12B:
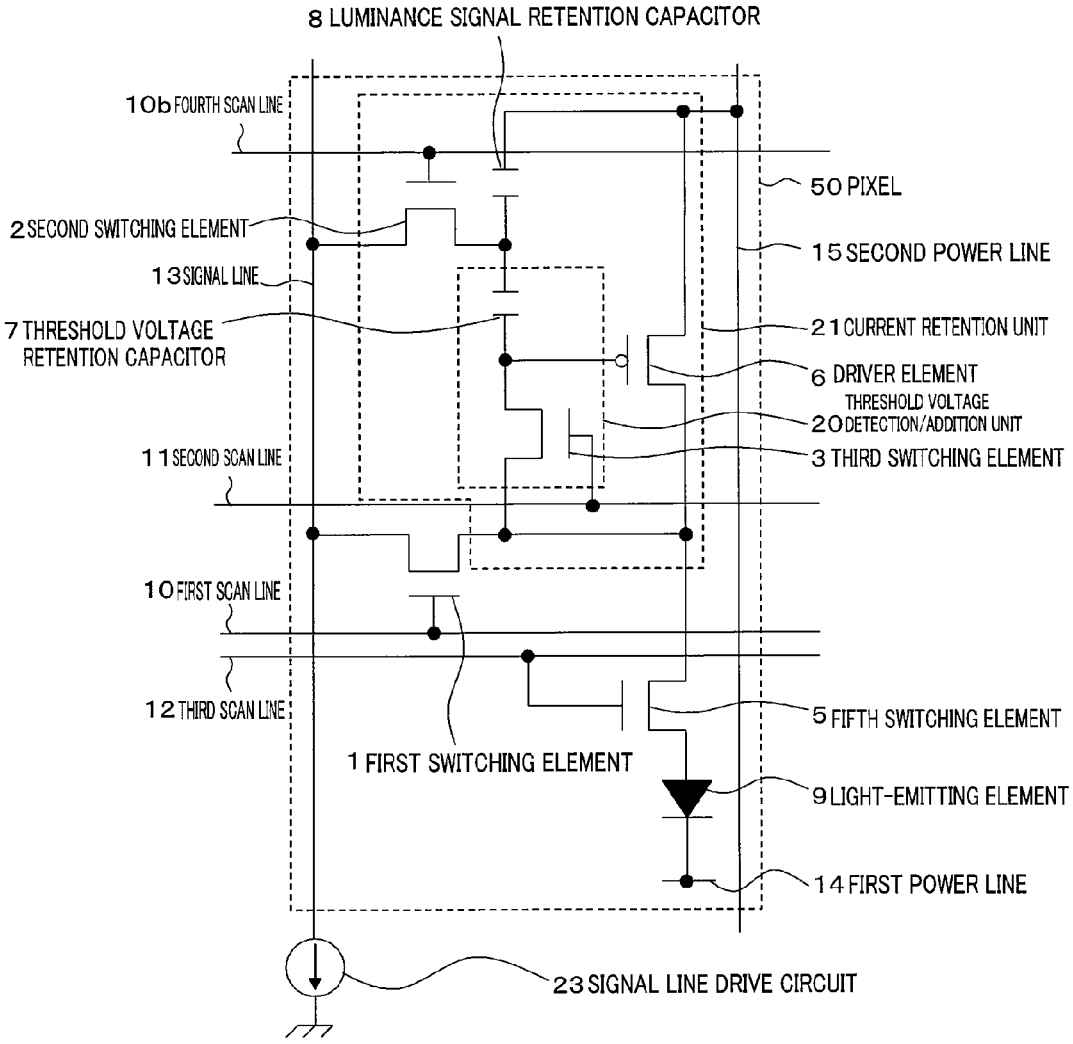
FIG. 12*b* is a circuit diagram showing the configuration of a light-emitting element circuit where the light-emitting element circuit of FIG. 11 is made up of an FET.

The configurations shown in FIGS. 8*b* and 12*b* are examples that differ from the cases of FIGS. 8*a* and 12*a* in that the second switching element 2 is controlled by a fourth scan line 10*b*, and that the fourth switching element 4 is omitted.

Figure 8C:
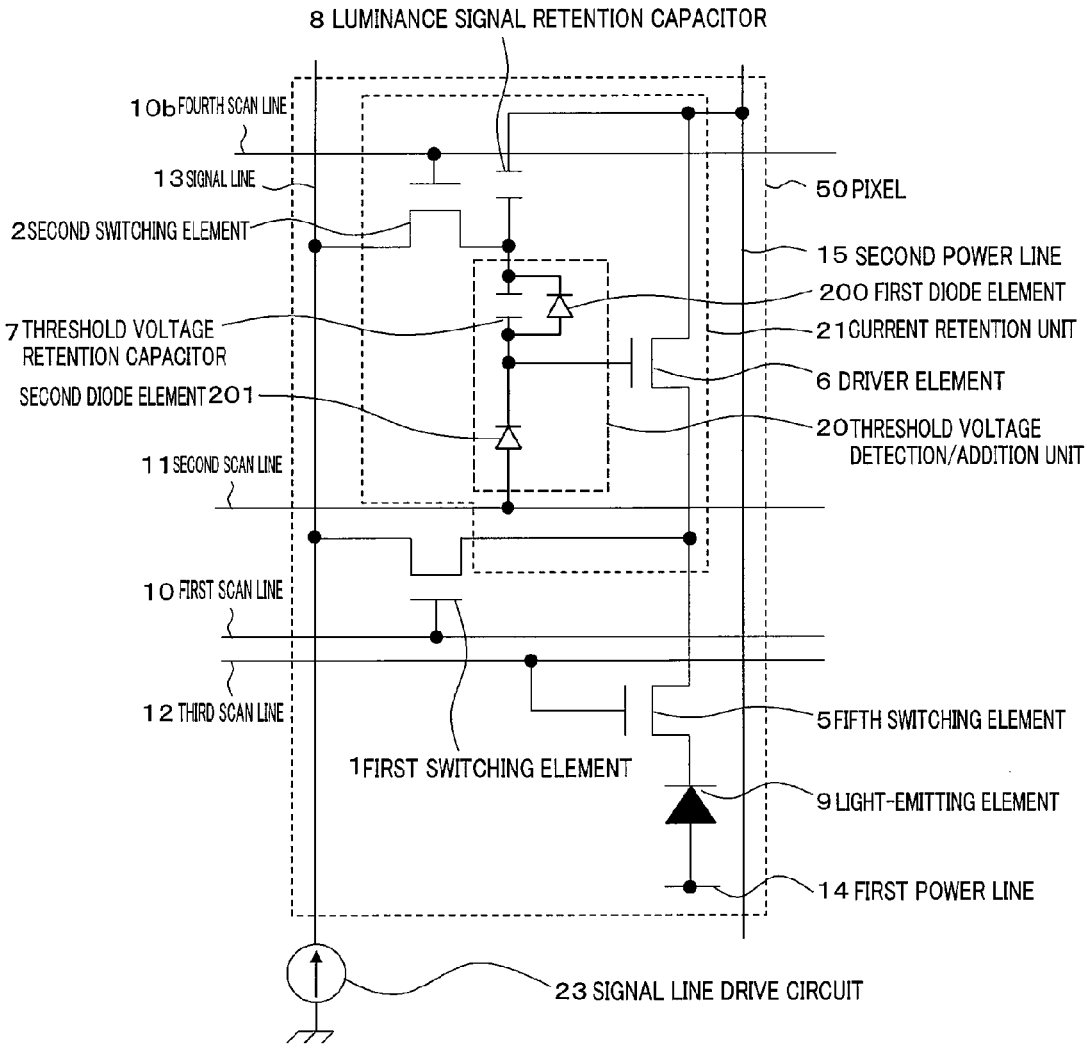
FIG. 8*c* is a circuit diagram showing the configuration of a light-emitting element circuit where the light-emitting element circuit of FIG. 7 is made up of an FET.

Furthermore, the configuration shown in FIG. 8*c* is an example that differs from the case of FIG. 8*b* in that a first diode element 200 and a second diode element 201 are provided, and that the third switching element 3 is omitted. As is understood from FIG. 8*c*, the anode terminal of the first diode element 200 is connected to the gate electrode of the driver element 6, and the cathode terminal of the first diode element 200 is connected to the first electrode of the luminance signal retention capacitor 8. Additionally, the anode terminal of the second diode element 201 is connected to the second scan line 11, and the cathode terminal of the second diode element 201 is connected to the gate electrode of the driver element 6. And, in the present embodiment, the threshold voltage of the first diode element 200 is controlled such that the value obtained by dividing an absolute value of the threshold voltage of the first diode element 200 by an absolute value of the threshold voltage of the driver element 6 becomes a positive value of 1 or less.

Although an illustration and detailed description is omitted here, even a later-described configuration (embodiment 4) with the employment of a reference driver element may also incorporate such first and second diode elements as mentioned above. In this case, the threshold voltage of the first diode element may be controlled such that the value obtained by dividing an absolute value of the threshold voltage of the first diode element by an absolute value of the threshold voltage of the reference driver element becomes a positive value of 1 or less.

With the light-emitting element circuit in FIG. 3 taken as a typical example, its operation will now be described with reference to the drive waveform shown in FIG. 4. In the example of configuration illustrated in FIG. 3, it is assumed that all the FETs are of an n-channel type. This, however, is for the sake of convenience of explanation, and the FETs may all be of a p-channel type or a mixture of n-channel and p-channel types.

Figure 4:
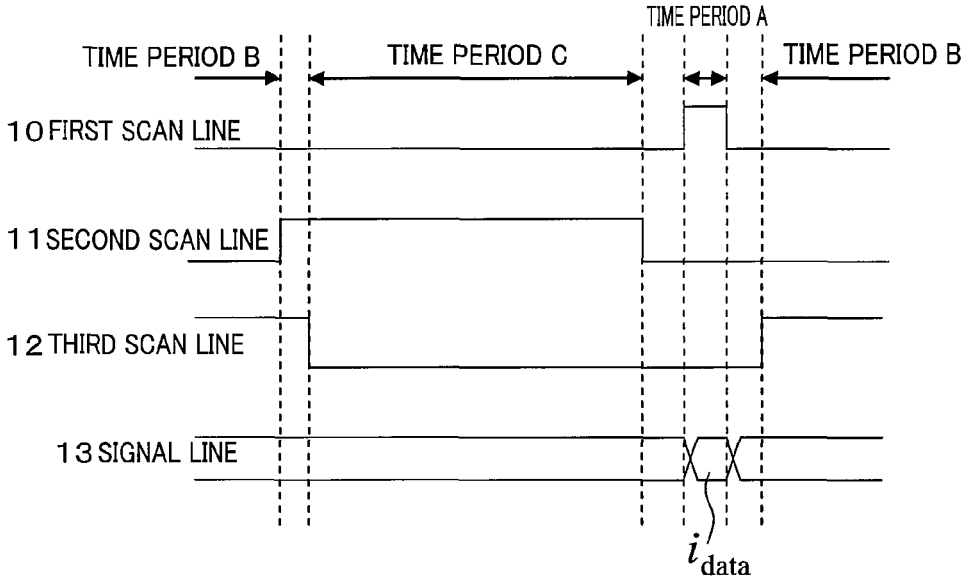
FIG. 4 is a view showing the drive waveform of a light-emitting element circuit included in the display apparatus according to the embodiment 1 of the present invention.

As illustrated in FIG. 4, before the beginning of a time period C, the second scan line 11 and the third scan line 12 are turned to a high voltage state to simultaneously turn on the third switching element 3, the fourth switching element 4, and the fifth switching element 5. At this time, both electrodes of the luminance signal retention capacitor 8 are short-circuited by the fourth switching element 4, resulting in a 0-volt potential difference. Furthermore, the gate electrode and the drain electrode of the driver element 6 are short-circuited by the third switching element 3 and, because the fifth switching element 5 is in the on state, a sufficiently large voltage is applied between the drain electrode and the source electrode of the driver element 6. This voltage is stored in the threshold voltage retention capacitor 7 by the action of the third switching element 3 and the fourth switching element 4.

Then, the third scan line 12 is put in a low voltage state. The fifth switching element 5 is hereby turned off, initiating the time period C. At this point in time of the beginning of the time period C, because the potential difference between the gate electrode and the source electrode of the driver element 6 is maintained sufficiently large by the threshold voltage retention capacitor 7, the driver element 6 is in the on state.

The current that flows through the driver element 6 flows via the fourth switching element 4 to the threshold voltage retention capacitor 7, because the first switching element 1 and the fifth switching element 5 are in the off state. As a result, the potential difference that has been stored in the threshold voltage retention capacitor 7 gradually gets smaller until it eventually becomes the threshold voltage of the driver element 6. At this point in time, the driver element 6 becomes off. Now, by putting the second scan line in a low voltage state and turning the third switching element 3 and the fourth switching element 4 to an off state, the recording of the threshold voltage of the driver element 6 on the threshold voltage retention capacitor 7 is completed, and the time period C ends. At this time, the potential difference stored between both electrodes of the luminance signal retention capacitor 8 is 0 volt.

Then, the first scan line 10 is turned to a high voltage state to start a time period A. Assuming that the output current of the signal line drive circuit 23 is Idata, Idata is supplied to the current retention unit 21 via the first switching element 1 during the time period A. At this time, because the second switching element 2 is in the on state, the potential difference between the drain electrode and the source electrode of the driver element 6 is transmitted to the luminance signal retention capacitor 8. This potential difference Vds is represented by the following equation (5).

$$Vds=\sqrt{(2I\text{data}/\beta)} \qquad \text{Equation (5)}$$

In other words, the potential difference Vgs between the gate electrode and the source electrode of the driver element 6 is made by the threshold voltage retention capacitor 7 and the luminance signal retention capacitor 8:

$$Vgs=\sqrt{(2I\text{data}/\beta)}+Vth \qquad \text{Equation (6)}$$

The amplitude of Vds, determined by the amplitude of Idata of 0-max(Idata) obtained from the above equation (5), is the voltage width that the signal line drive circuit 23 needs to output. This voltage width, unlike the voltage width of the conventional technique obtained in accordance with the above equation (1), is not dependent on the threshold voltage of the driver element 6.

Especially where the current writing method is accomplished using an amorphous silicon TFT, because of the significant phenomenon of shifts in threshold voltage, the design of a signal line drive circuit must be made on the assumption of a large threshold voltage value in the conventional technique. In contrast, with the signal line drive circuit 23 in the present embodiment, because the threshold voltage of the driver element 6 needs not be compensated for, but only its mobility needs to be compensated, it becomes possible to lower the design withstand voltage value.

Embodiment 2

The light-emitting element circuit included in a display apparatus according to an embodiment 2, unlike in the case of the embodiment 1, has a fifth switching element 5 provided between the current retention unit and the second power line. A description will now be made of the configuration of this light-emitting element circuit in the embodiment 2.

Figure 15:
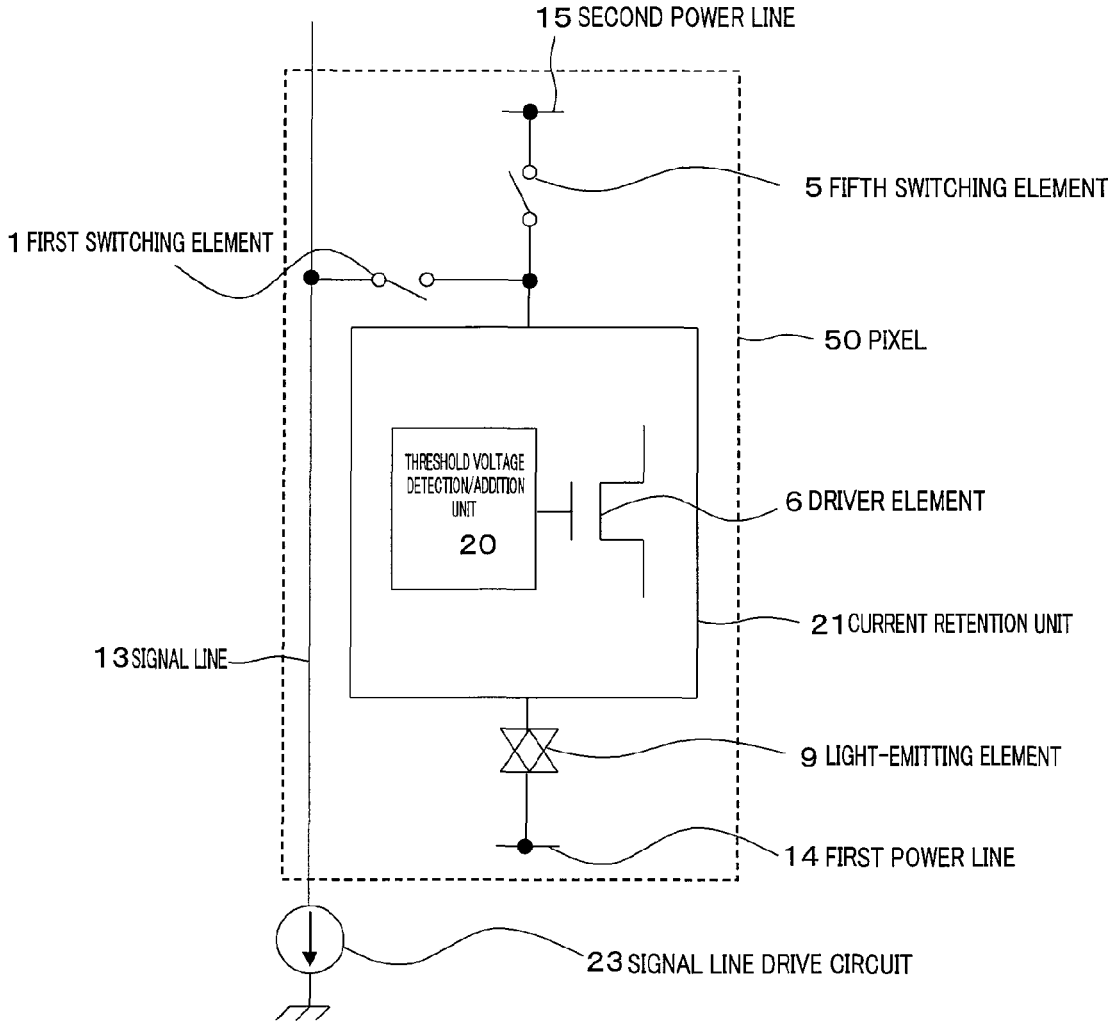
FIG. 15 is a block diagram showing the configuration of a light-emitting element circuit included in a display apparatus according to an embodiment 2 of the present invention.

FIG. 15 is a block diagram showing the configuration of a light-emitting element circuit contained in the display apparatus according to the embodiment 2 of the present invention. As illustrated in FIG. 15, a current retention unit 21 included in the light-emitting element circuit denoted by the pixel 50 is connected to a signal line 13 via a first switching element 1 and to a second power line 15 via a fifth switching element 5, and to an electrode of a light-emitting element 9.

The rest of the configuration of the light-emitting element circuit is the same as in the case of the embodiment 1, and thus its description will be omitted.

With this light-emitting element circuit, if the first switching element 1 is turned on while the fifth switching element 5 is in an off state, the current signal outputted to the signal line 13 by the signal line drive circuit 23 is supplied to the current retention unit 21. The current retention unit 21 retains the potential difference then generated between the drain electrode and the source electrode of the driver element 6 as a luminance signal voltage, and causes the value obtained by adding the threshold voltage of the driver element 6 to the luminance signal voltage to be applied at the gate electrode of the driver element 6.

Figure 16:
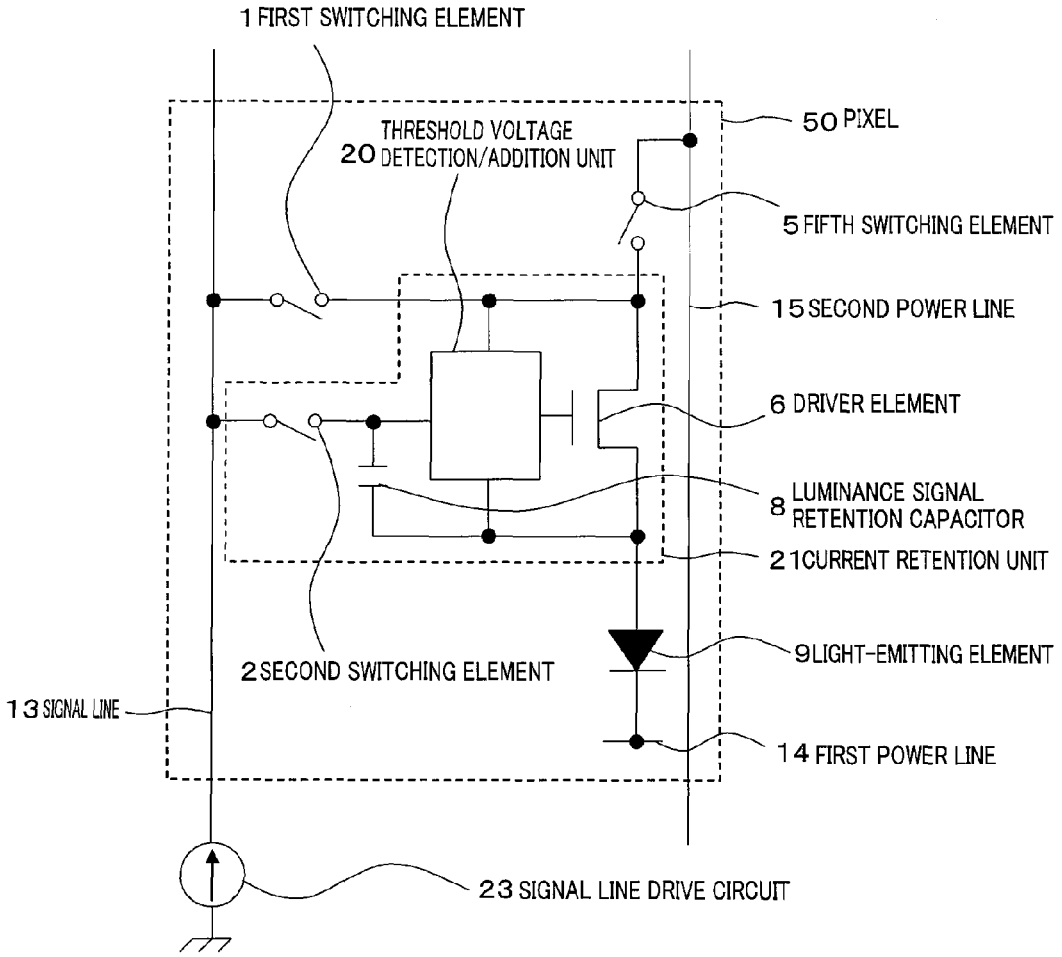
FIG. 16 is a block diagram showing the detailed configuration of a light-emitting element circuit included in the display apparatus according to the embodiment 2 of the present invention.

A further detailed configuration of the light-emitting element circuit is shown in FIGS. 16, 18, 20 and 22. As illustrated in FIG. 16, the current retention unit 21 includes a second switching element 2 provided between the threshold voltage detection and addition unit 20 and the signal line 13, and a luminance signal retention capacitor 8 which retains, as a luminance signal voltage, the potential difference generated between the drain electrode and the source electrode of the driver element 6 when a luminance signal is supplied via the signal line 13.

Also in this embodiment 2, as in the case of the embodiment 1, when the first switching element 1 is in an on state and the fifth switching element 5 is in an off state, the signal current outputted by the signal line drive circuit 23 flows through the driver element 6 by way of the signal line 13. At this time, because the second switching element 2 is in the on state, the voltage generated between the drain electrode and the source electrode of the driver element 6 is transmitted to the luminance signal retention capacitor 8. Thereafter, by turning the second switching element 2 off, the voltage is retained in the luminance signal retention capacitor 8.

While a signal current Idata is flowing through the driver element 6, the potential of the gate electrode of the driver element 6 is maintained by the threshold voltage detection and addition unit 20 at a higher level than the drain potential of the driver element 6 by as much as the threshold voltage of the driver element 6. Accordingly, the voltage generated and retained across both electrodes ends of the luminance signal retention capacitor 8 is represented by the above equation (4).

Therefore, also in the embodiment 2, the output voltage of the current output stage of the signal line drive circuit 23 is unaffected by the threshold voltage of the driver element 6.

Figure 22:
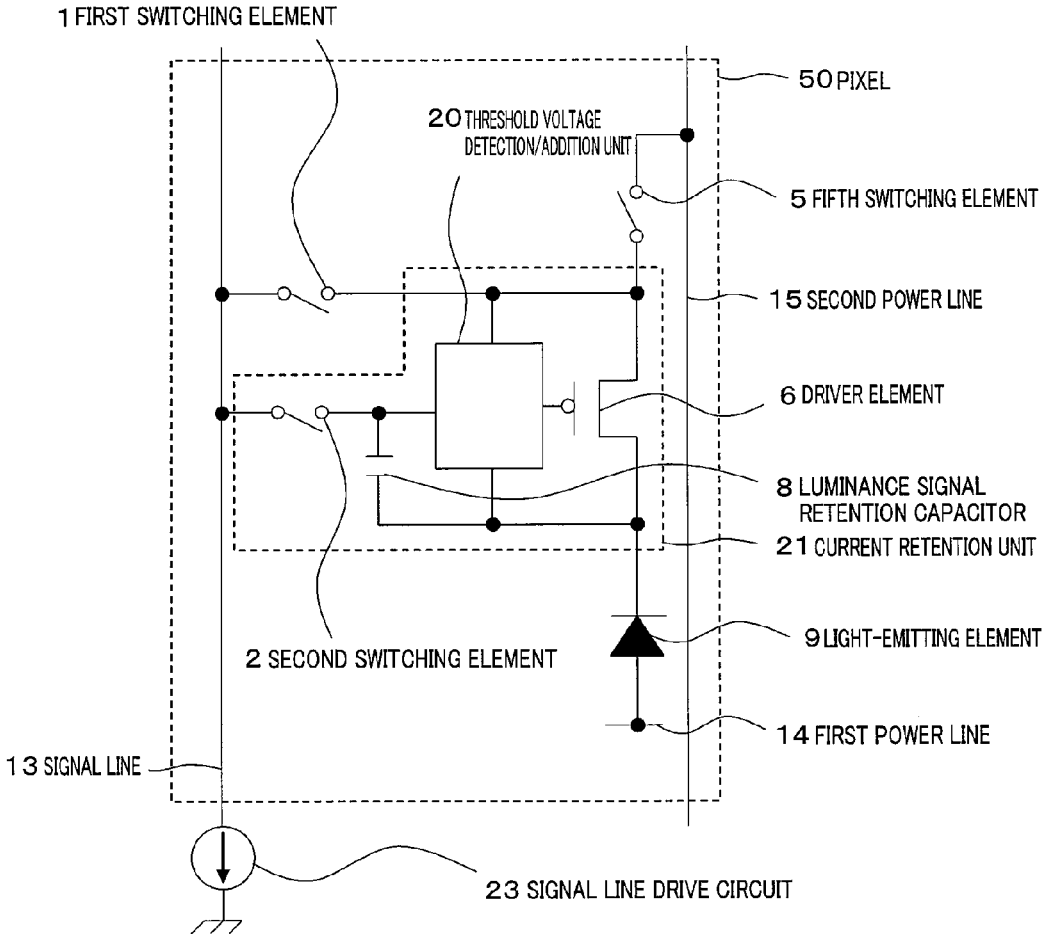
FIG. 22 is a block diagram showing the detailed configuration of a light-emitting element circuit included in the display apparatus according to the embodiment 2 of the present invention.

An example is shown in FIG. 22 in which the polarity of the light-emitting element 9 is reversed as compared with this example of FIG. 16.

Figure 18:
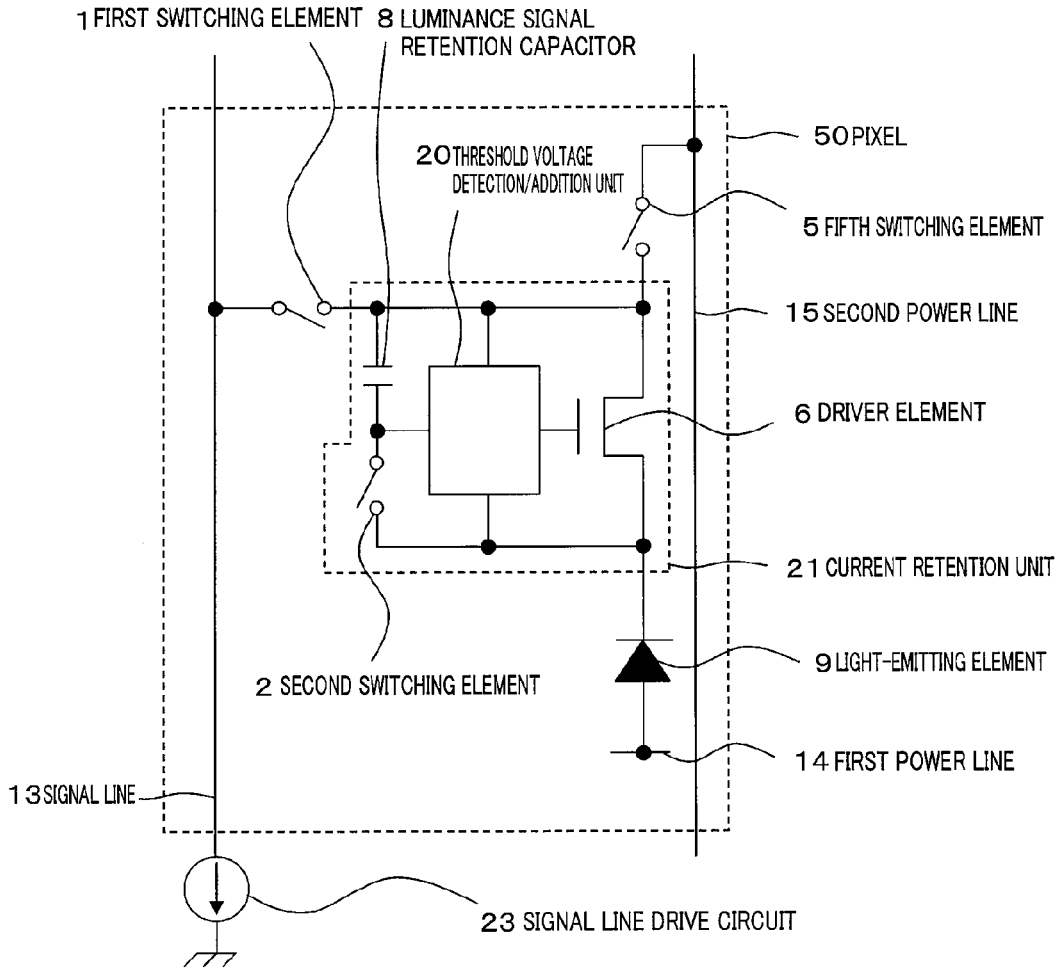
FIG. 18 is a block diagram showing the detailed configuration of a light-emitting element circuit included in the display apparatus according to the embodiment 2 of the present invention.
Figure 20:
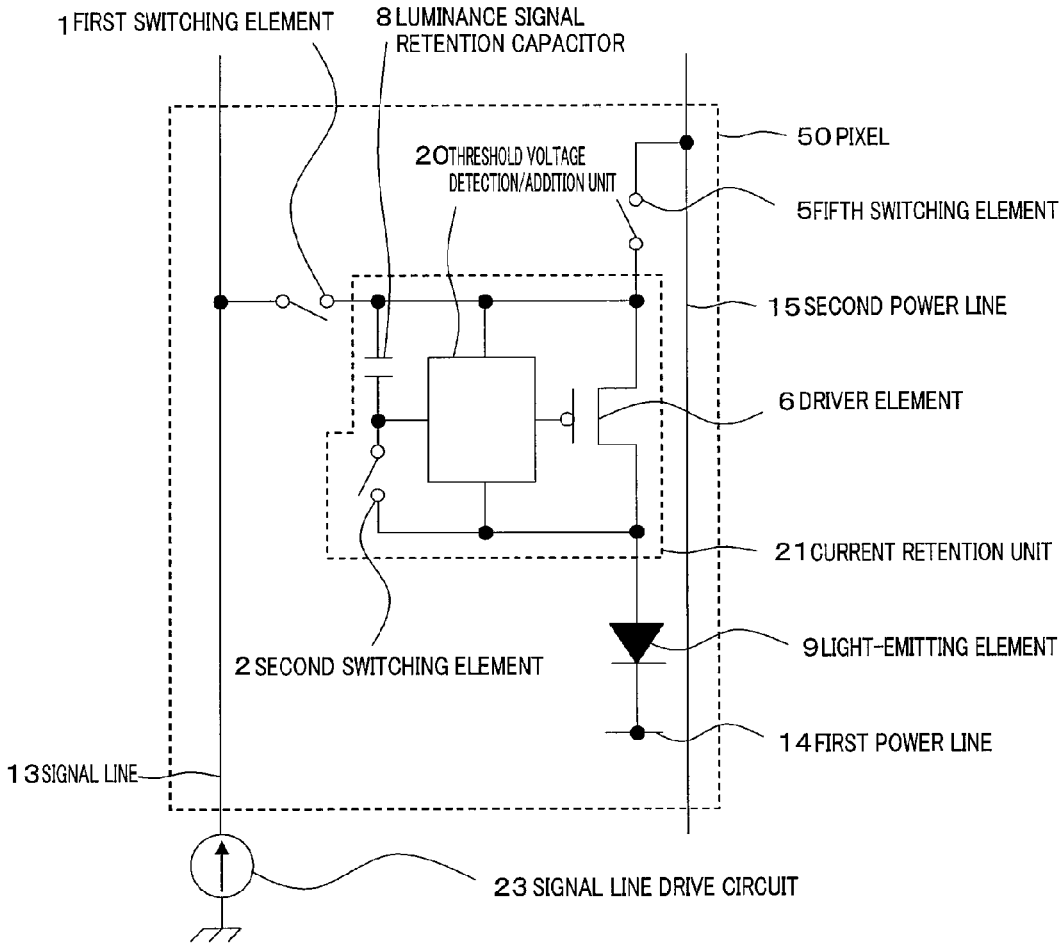
FIG. 20 is a block diagram showing the detailed configuration of a light-emitting element circuit included in the display apparatus according to the embodiment 2 of the present invention.

Additionally, in the example illustrated in FIG. 18, the current retention unit 21 includes a second switching element 2 provided between the luminance signal retention capacitor 8 and the light-emitting element 9. FIG. 20 shows an example in which the light-emitting element 9 is opposite in polarity as compared with this example of FIG. 18.

FIGS. 17, 19, 21, and 23 are circuit diagrams respectively showing the configurations of light-emitting element circuits where the light-emitting element circuits in FIGS. 16, 18, 20, and 22 are made up of an FET.

Figure 17:
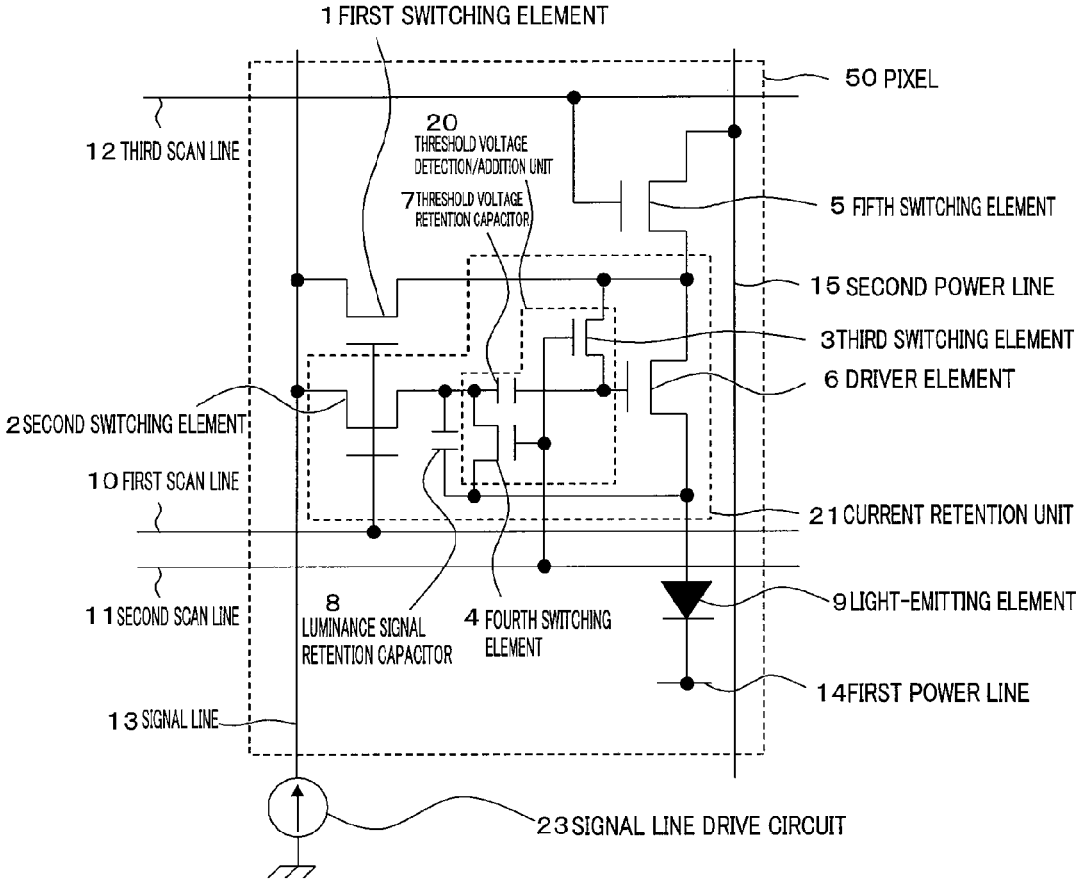
FIG. 17 is a circuit diagram showing the configuration of a light-emitting element circuit where the light-emitting element circuit of FIG. 16 is made up of an FET.

In the example illustrated in FIG. 17, the threshold voltage detection and addition unit 20 provided in the current retention unit 21 includes a third switching element 3 for controlling connection between the gate electrode and the drain electrode of the driver element 6, a fourth switching element 4 for controlling connection between both electrodes of the luminance signal retention capacitor 8, and a threshold voltage retention capacitor 7 disposed between the gate electrode of the driver element 6 and the first electrode of the luminance signal retention capacitor 8.

The on-off operations of the first switching element 1 and the second switching element 2 are controlled by a first scan line 10, and the on-off operations of the third switching element 3 and the fourth switching element 4 are controlled by a second scan line 11. Additionally, the on-off operations of the fifth switching element 5 are controlled by a third scan line 12. These first to third scan lines 10 to 12 are driven by a scan line drive circuit.

Figure 19:
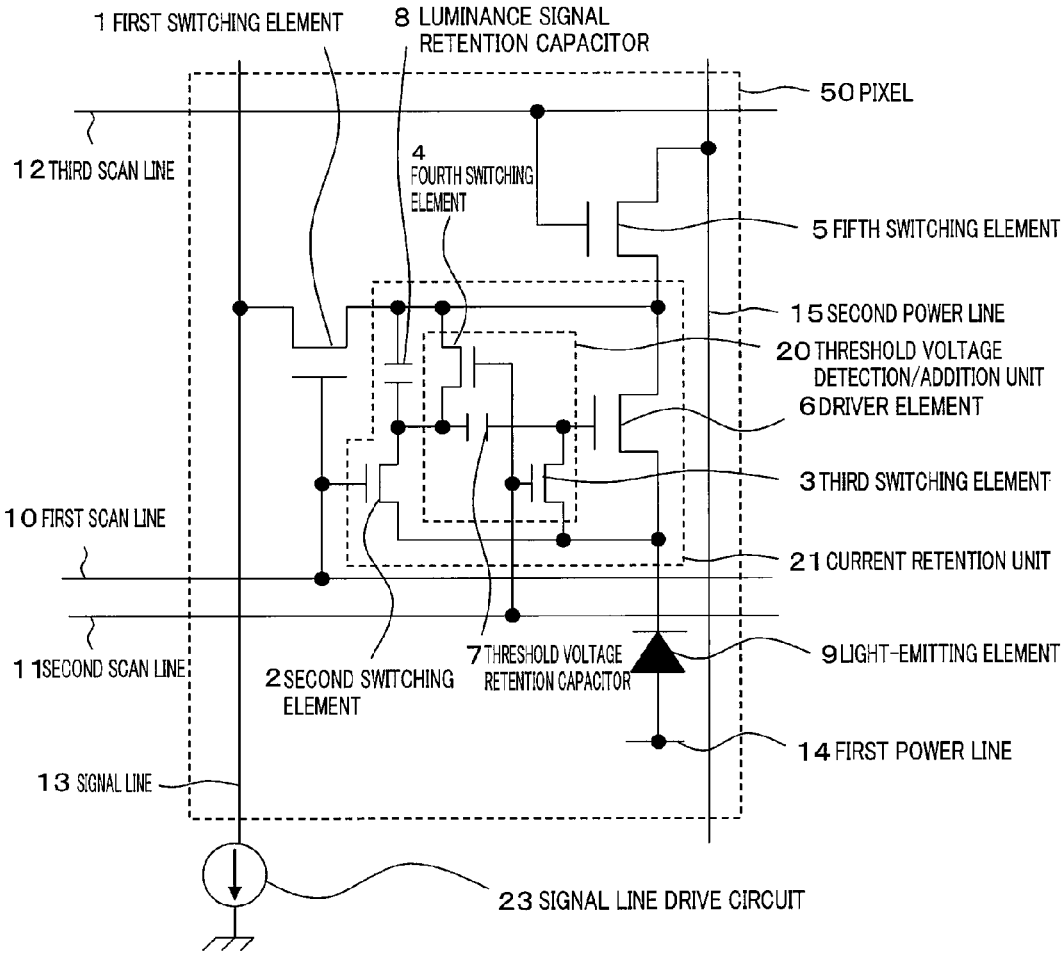
FIG. 19 is a circuit diagram showing the configuration of a light-emitting element circuit where the light-emitting element circuit of FIG. 18 is made up of an FET.
Figure 21:
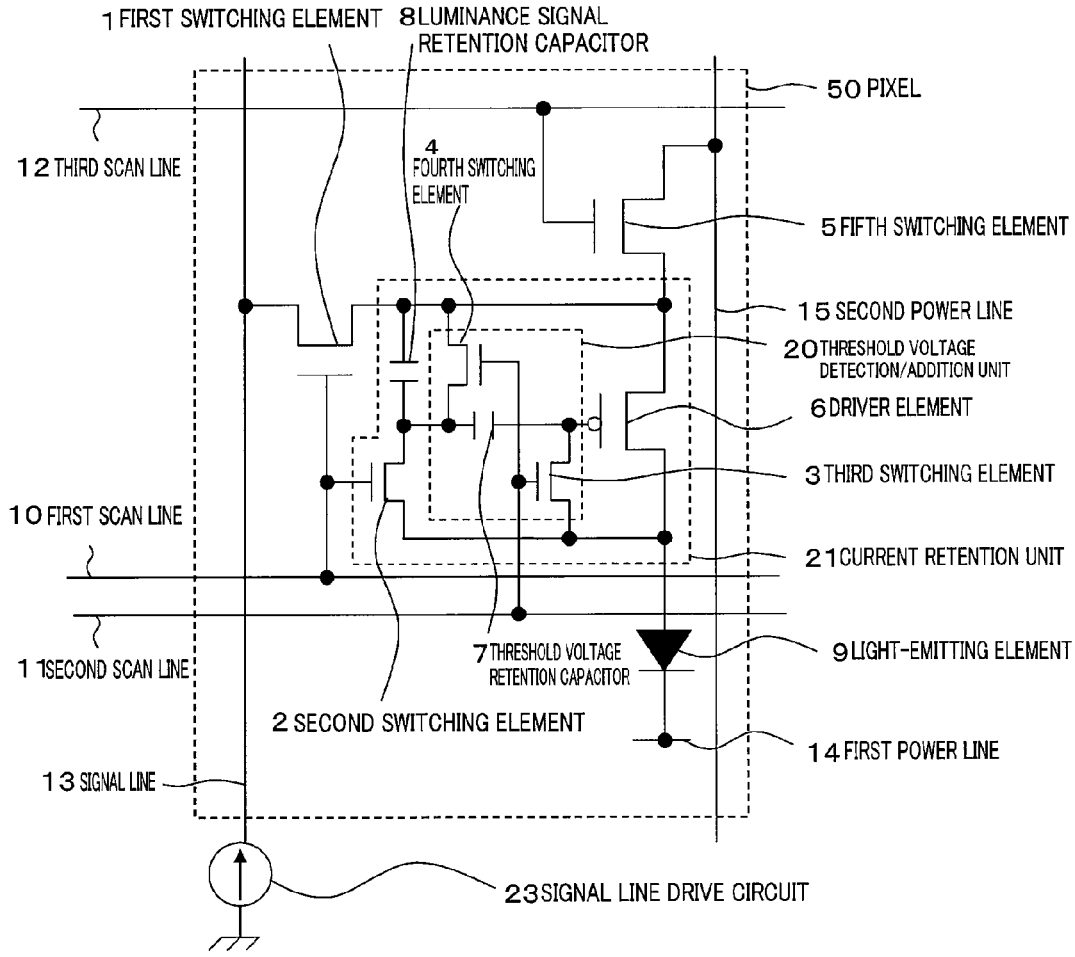
FIG. 21 is a circuit diagram showing the configuration of a light-emitting element circuit where the light-emitting element circuit of FIG. 20 is made up of an FET.
Figure 23:
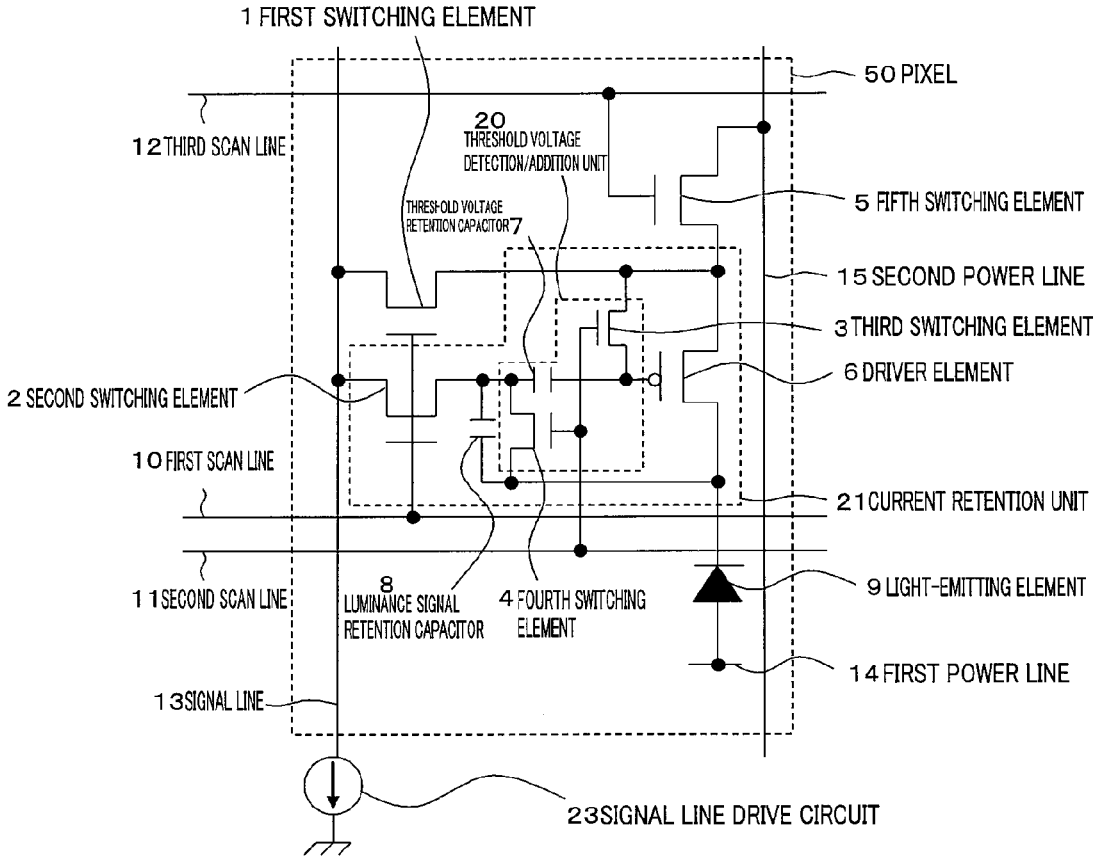
FIG. 23 is a circuit diagram showing the configuration of a light-emitting element circuit where the light-emitting element circuit of FIG. 22 is made up of an FET.

Also in the examples shown in FIGS. 19, 21, and 23, as in the case of FIG. 17, the threshold voltage detection and addition unit 20 includes a third switching element 3, a fourth switching element 4, and a threshold voltage retention capacitor 7.

The operations of these light-emitting element circuits in FIGS. 17, 19, 21, and 23 are the same as in the case of the embodiment 1. In other words, their drive waveform is as shown in FIG. 4, and the potential difference Vds retained by the luminance signal retention capacitor 8 during the time period A of FIG. 4 is represented by the above equation (5), and the potential difference Vgs between the gate electrode and the source electrode of the driver element 6 is represented by the above equation (6).

Also in the embodiment 2, as in the case of embodiment 1, the voltage width that the signal line drive circuit 23 needs to output is not dependent on the threshold voltage of the driver element 6. Consequently, the signal line drive circuit 23 needs not compensate for the threshold voltage of the driver element 6, but only needs to compensate for the mobility, making it possible to lower its design withstand voltage value.

Embodiment 3

The light-emitting element circuit included in a display apparatus according to an embodiment 3, unlike in the case of the embodiment 1, is not provided with a fifth switching element. A description will now be made of the configuration of the light-emitting element circuit in this embodiment 3.

Figure 24:
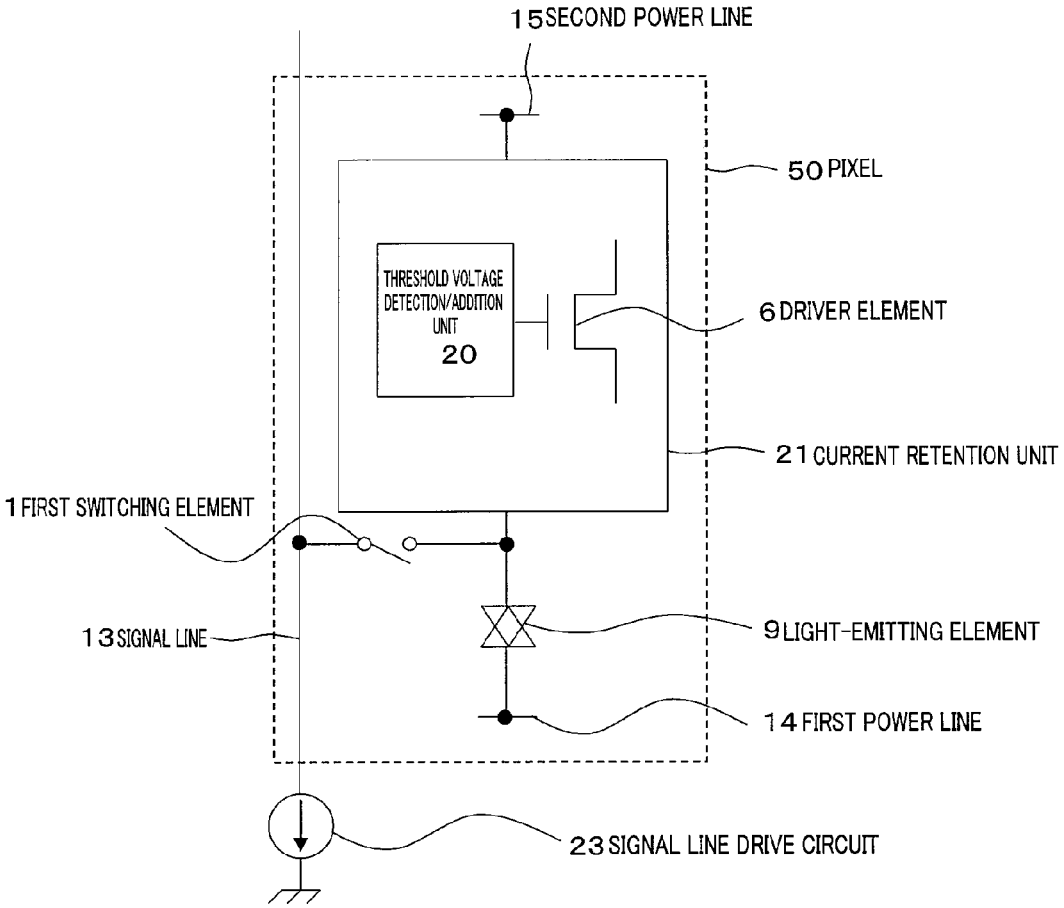
FIG. 24 is a block diagram showing the configuration of a light-emitting element circuit included in a display apparatus according to an embodiment 3 of the present invention.

FIG. 24 is a block diagram showing the configuration of a light-emitting element circuit included in the display apparatus according to the embodiment 3 of the present invention. As illustrated in FIG. 24, a current retention unit 21 included in the light-emitting element circuit denoted by the pixel 50 is connected to a signal line 13 via a first switching element 1, and to a second power line 15 and to an electrode of a light-emitting element 9.

The rest of the configuration of the light-emitting element circuit is the same as in the case of the embodiment 1, and thus its description will be omitted.

With this light-emitting element circuit, if the first switching element 1 is turned on, the current signal outputted to the signal line 13 by the signal line drive circuit 23 is supplied to the current retention unit 21. The current retention unit 21 causes the value obtained by adding the threshold voltage of the driver element 6 to the potential generated between the drain electrode and the source electrode of the driver element 6 to be applied at the gate electrode of the driver element 6, and allows the summed value to be retained by a capacitor.

Figure 25:
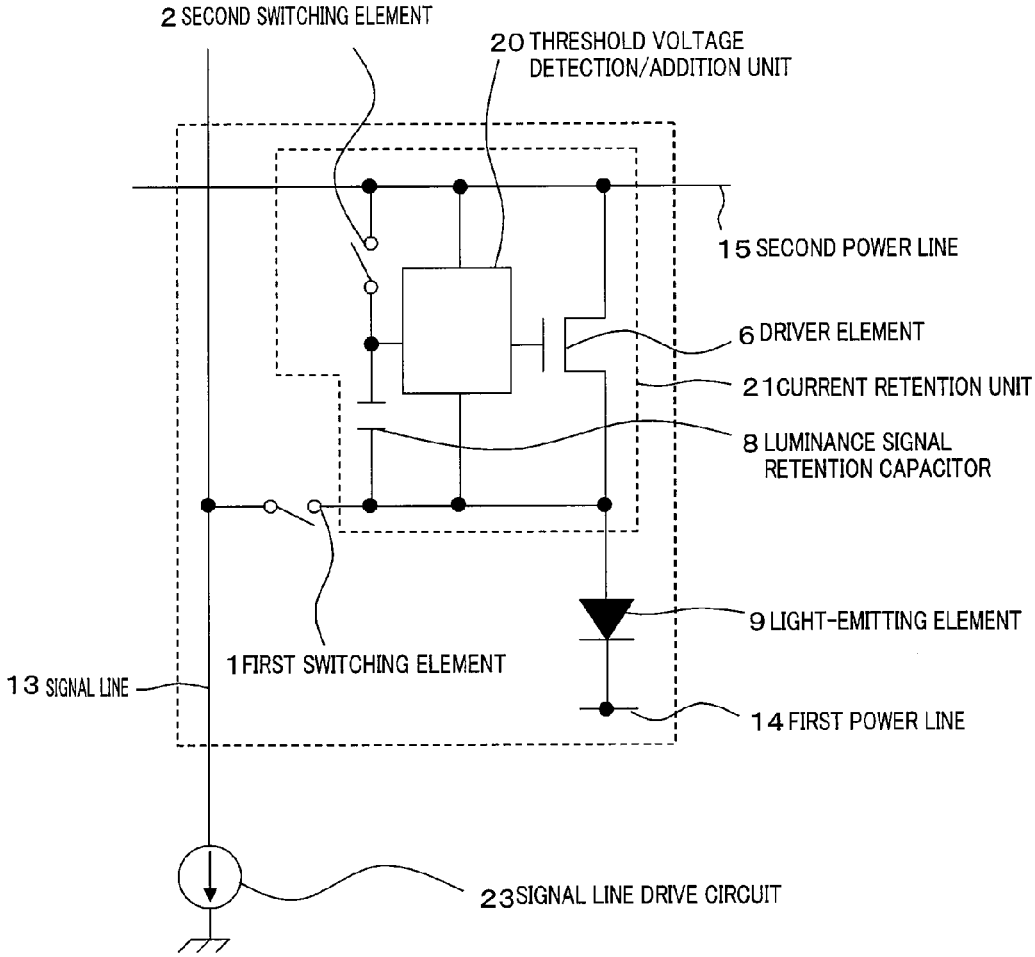
FIG. 25 is a block diagram showing the detailed configuration of a light-emitting element circuit included in the display apparatus according to the embodiment 3 of the present invention.

A further detailed configuration of the light-emitting element circuit is shown in FIGS. 25, 28, 30, 34, 36, and 38. As illustrated in FIG. 25, the current retention unit 21 includes a second switching element 2 provided between the threshold voltage detection and addition unit 20 and the second power line 15, and a luminance signal retention capacitor 8 which retains, as a luminance signal voltage, the potential difference generated between the drain electrode and the source electrode of the driver element 6 when a luminance signal is supplied via the signal line 13.

If the first switching element 1 is turned on, and the first power line 14 or the second power line 15 is at a potential which causes the light-emitting element 9 to be turned off, the signal current which the signal line drive circuit 23 outputs flows through the driver element 6 by way of the signal line 13. At this time, because the second switching element 2 is in an on state, the voltage generated between the drain electrode and the source electrode of the driver element 6 is transmitted to the luminance signal retention capacitor 8. Thereafter, by turning the second switching element 2 to the off state, the voltage is retained in the luminance signal retention capacitor 8.

While a signal current Idata is flowing through the driver element 6, the potential of the gate electrode of the driver element 6 is maintained by the threshold voltage detection and addition unit 20 at a higher level than the drain potential of the driver element 6 by as much as the threshold voltage of the driver element 6. Thus, the voltage generated and retained across both electrodes ends of the luminance signal retention capacitor 8 is represented by the above equation (4).

Therefore, also in the embodiment 2, the output voltage of the current output stage of the signal line drive circuit 23 is unaffected by the threshold voltage of the driver element 6.

Figure 38:
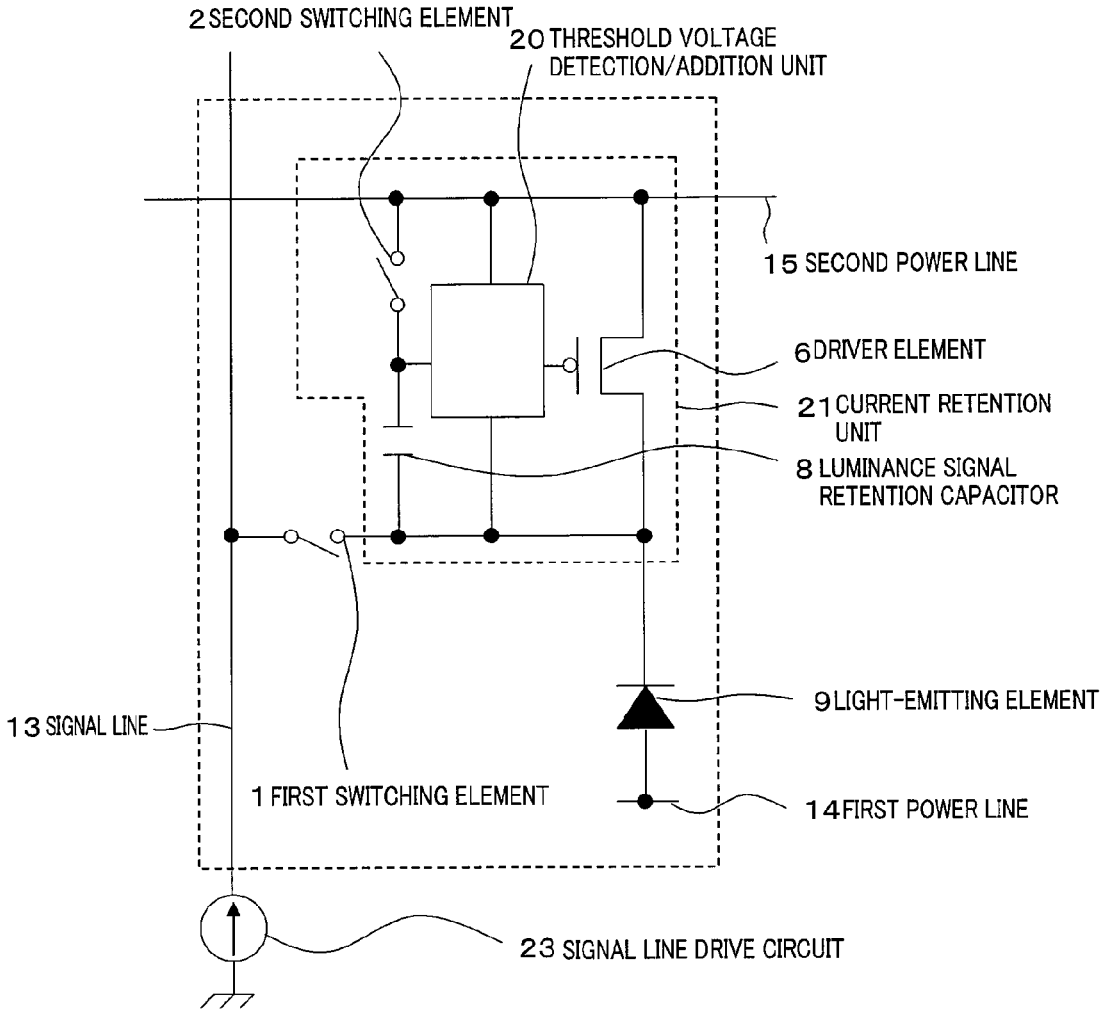
FIG. 38 is a block diagram showing the detailed configuration of a light-emitting element circuit included in the display apparatus according to the embodiment 3 of the present invention.
Figure 39:
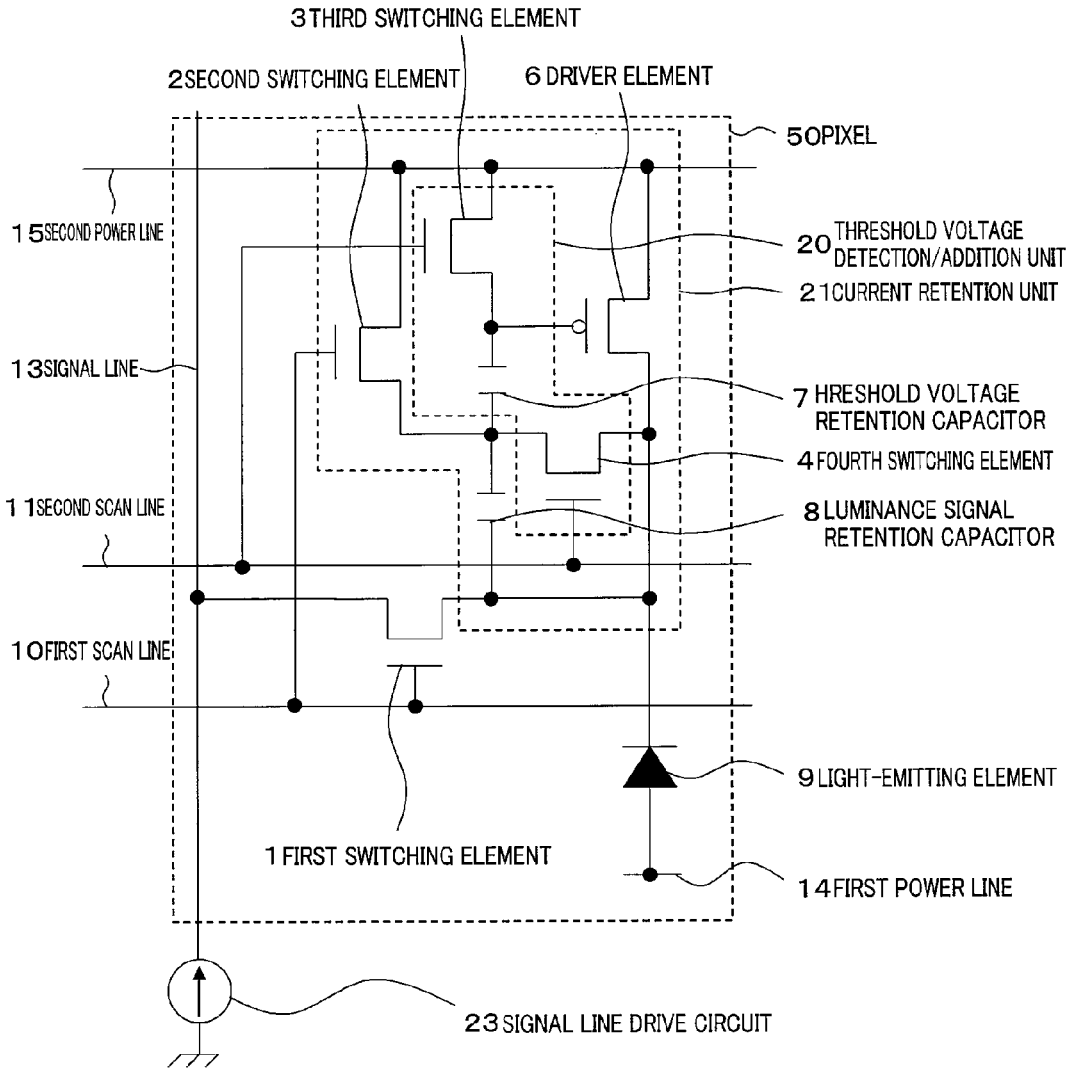
FIG. 39 is a circuit diagram showing the configuration of a light-emitting element circuit where the light-emitting element circuit of FIG. 38 is made up of an FET.

An example is shown in FIG. 38 in which the polarity of the light-emitting element 9 is reversed as compared with this example of FIG. 25.

Figure 28:
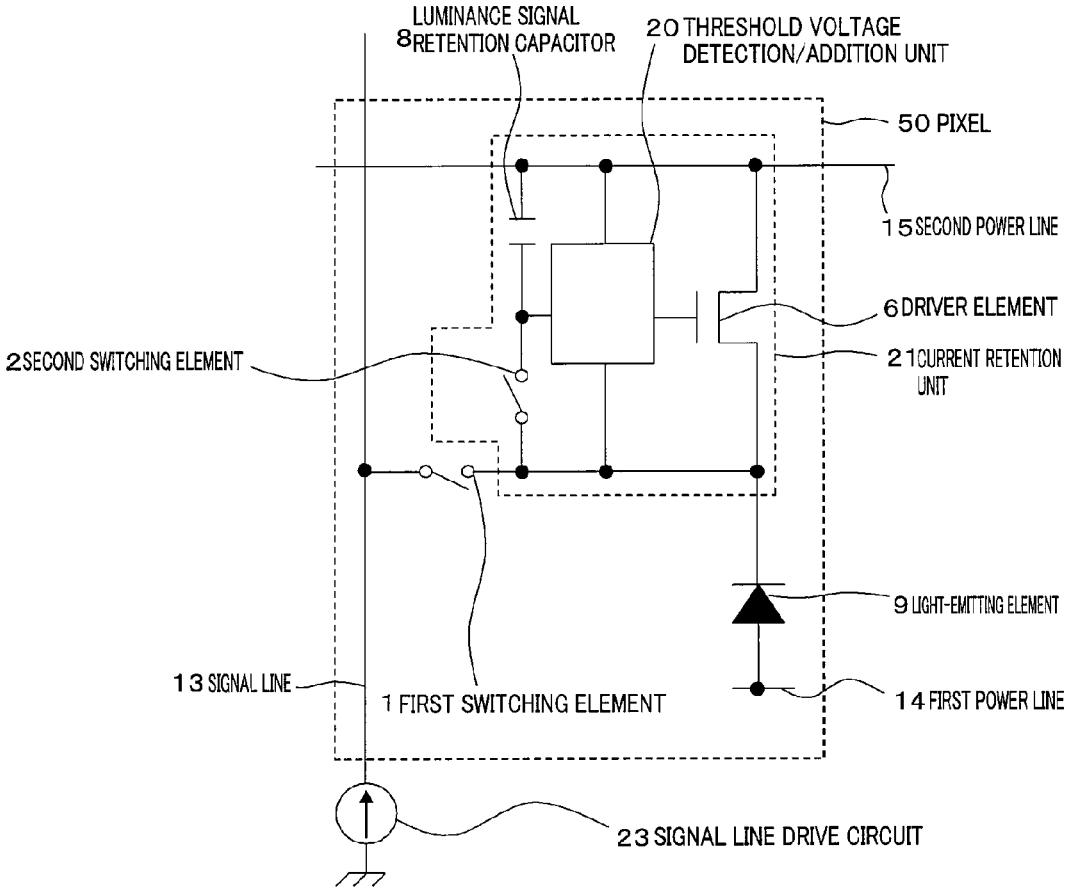
FIG. 28 is a block diagram showing the detailed configuration of a light-emitting element circuit included in the display apparatus according to the embodiment 3 of the present invention.
Figure 34:
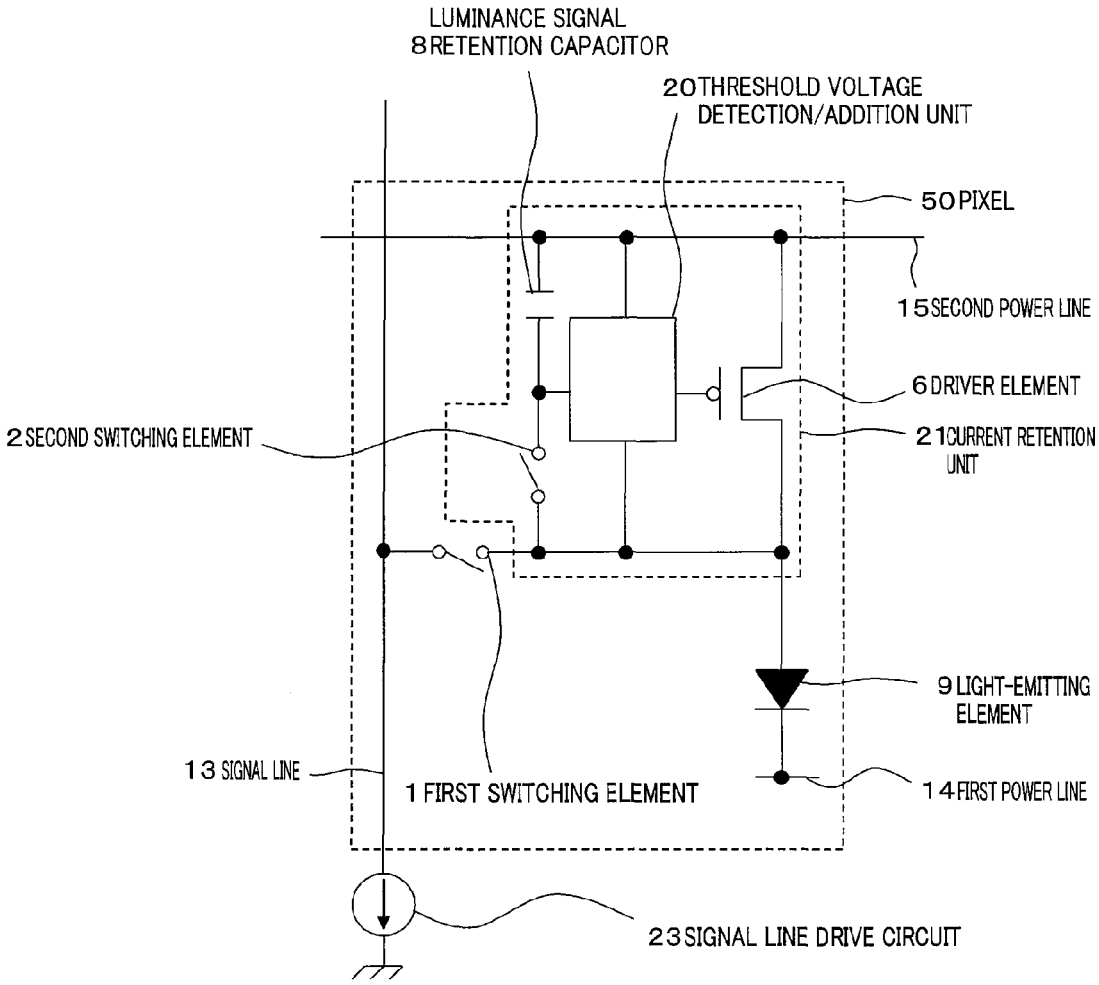
FIG. 34 is a block diagram showing the detailed configuration of a light-emitting element circuit included in the display apparatus according to the embodiment 3 of the present invention.
Figure 35:
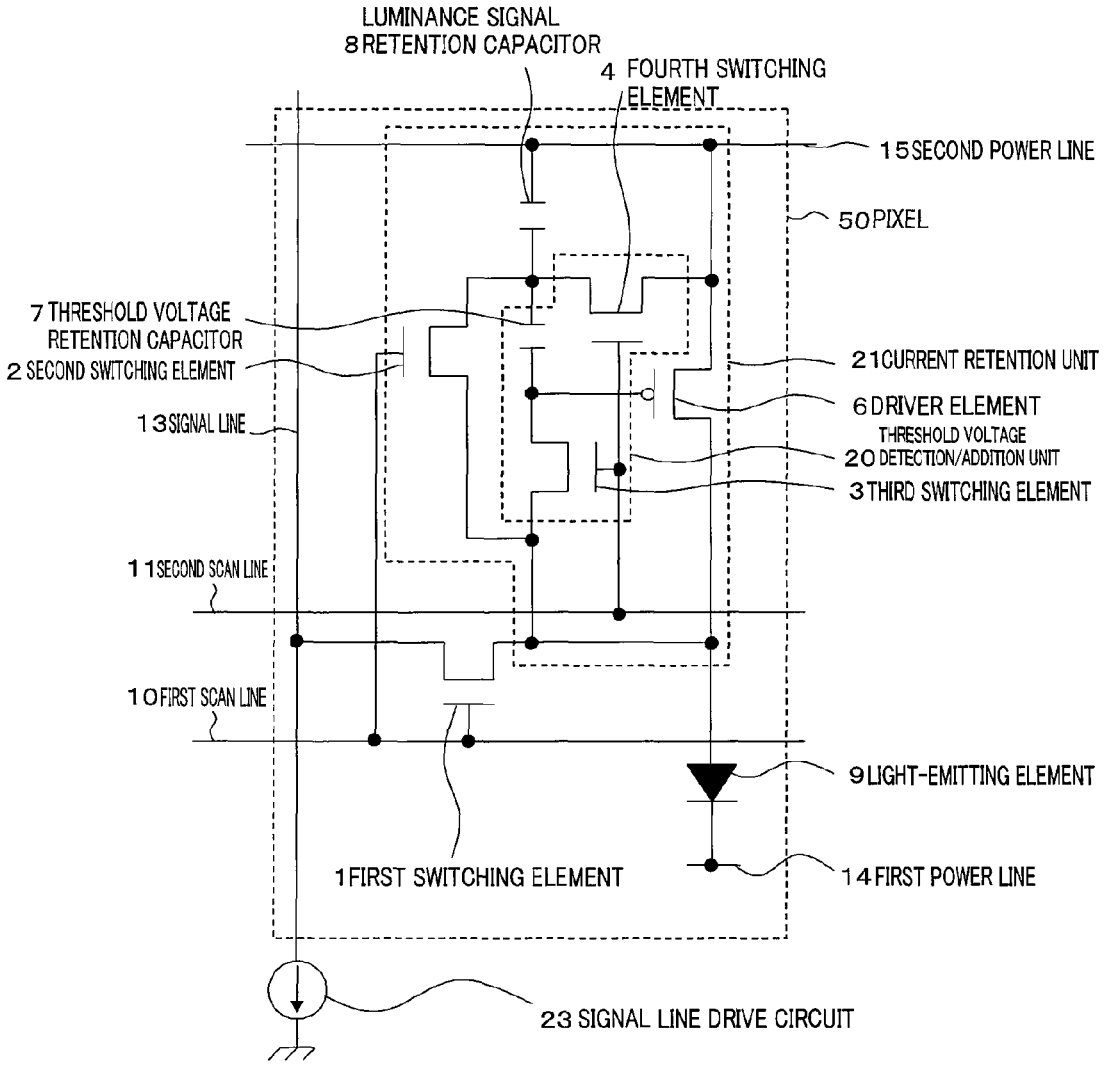
FIG. 35 is a circuit diagram showing the configuration of a light-emitting element circuit where the light-emitting element circuit of FIG. 34 is made up of an FET.

In addition, in the example illustrated in FIG. 28, the current retention unit 21 includes a second switching element 2 disposed between the luminance signal retention capacitor 8 and the first switching element 1. FIG. 34 shows an example in which the light-emitting element 9 is opposite in polarity as compared with this example of FIG. 28.

Figure 30:
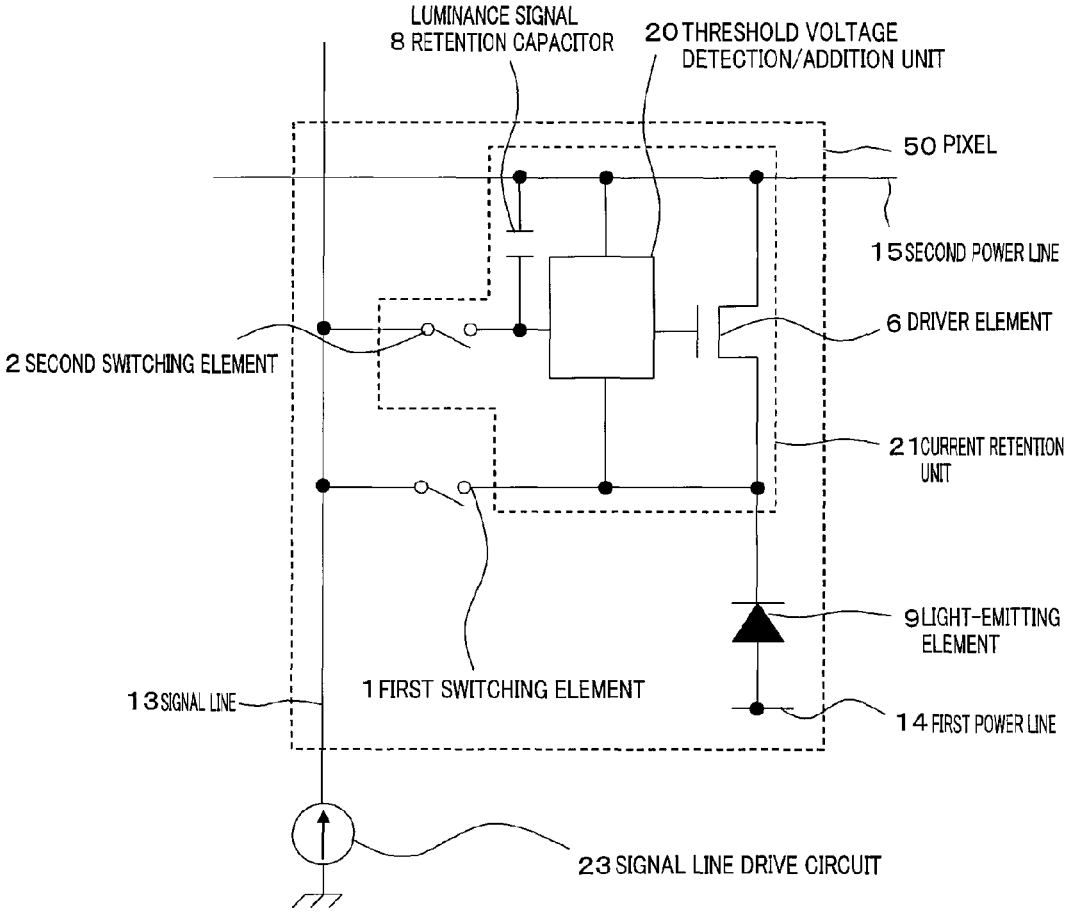
FIG. 30 is a block diagram showing the detailed configuration of a light-emitting element circuit included in the display apparatus according to the embodiment 3 of the present invention.
Figure 36:
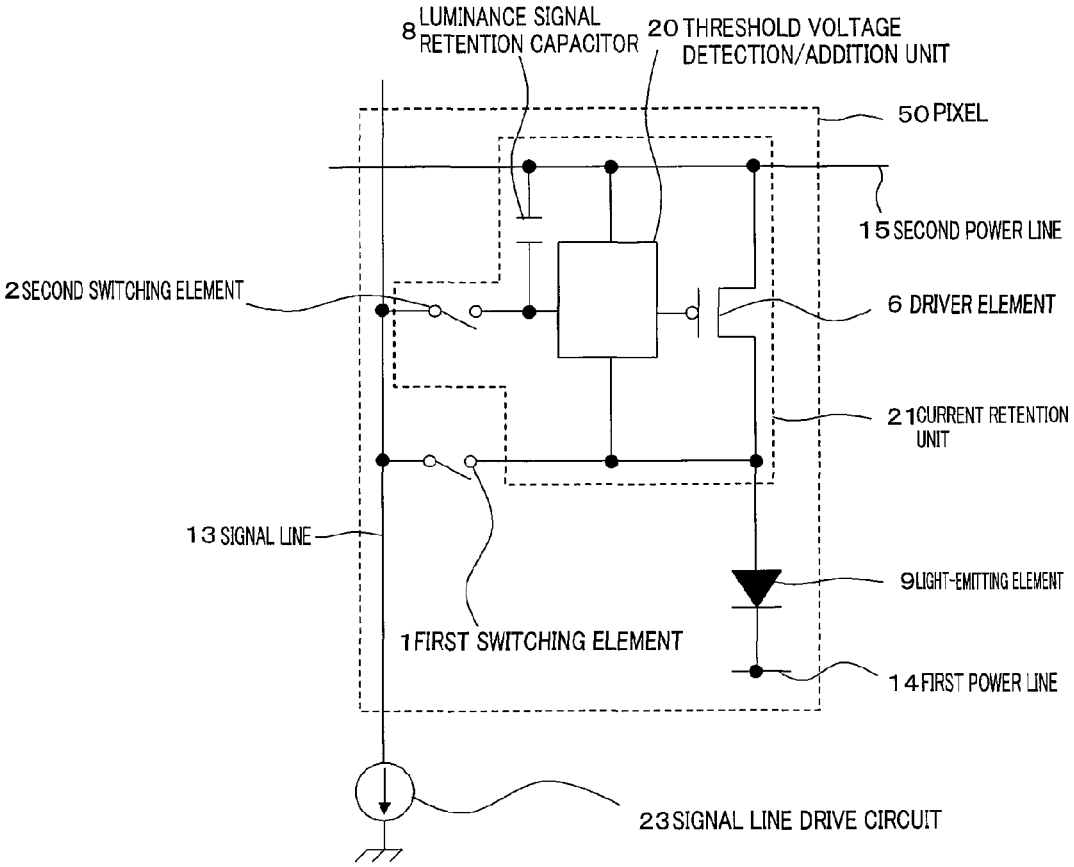
FIG. 36 is a block diagram showing the detailed configuration of a light-emitting element circuit included in the display apparatus according to the embodiment 3 of the present invention.
Figure 37:
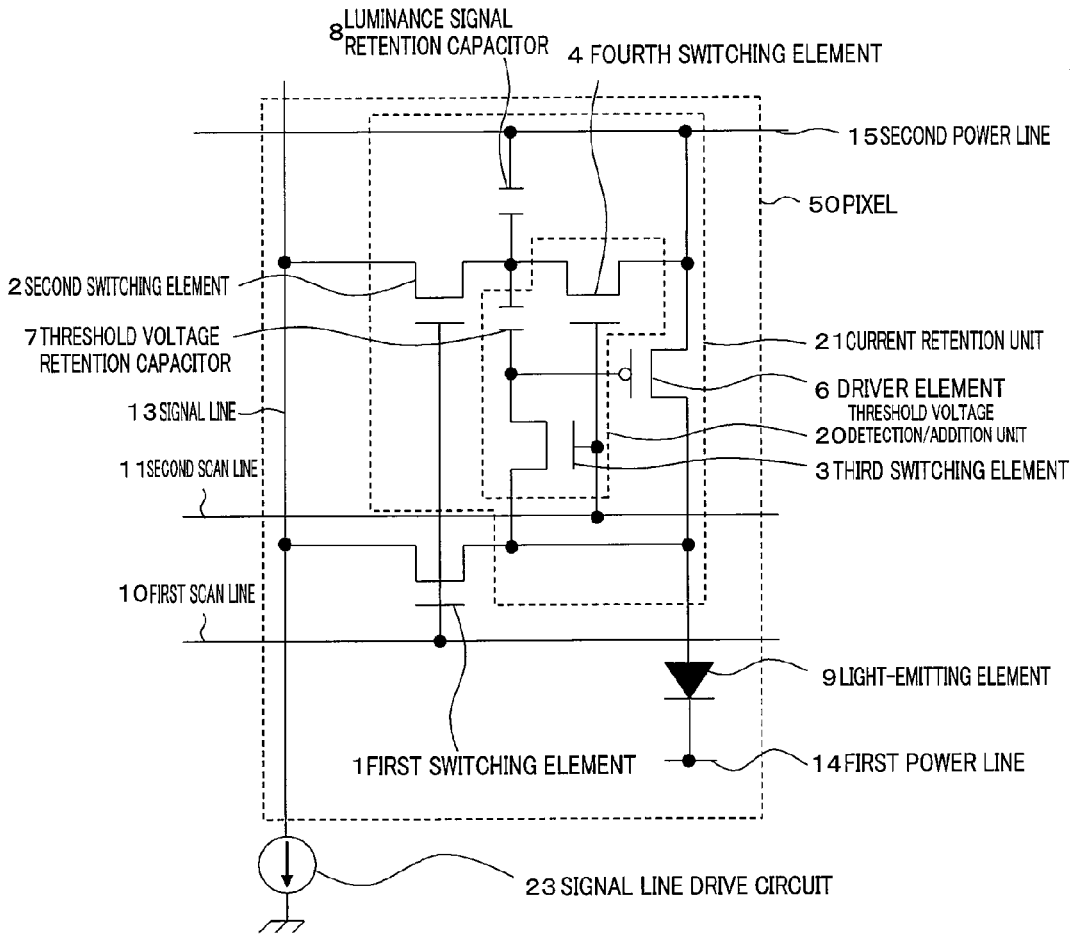
FIG. 37 is a circuit diagram showing the configuration of a light-emitting element circuit where the light-emitting element circuit of FIG. 36 is made up of an FET.

Furthermore, in the example illustrated in FIG. 30, the current retention unit 21 includes a second switching element 2 disposed between the luminance signal retention capacitor 8 and the signal line 13. FIG. 36 shows an example in which the light-emitting element 9 is opposite in polarity as compared with this example of FIG. 30.

Figure 26:
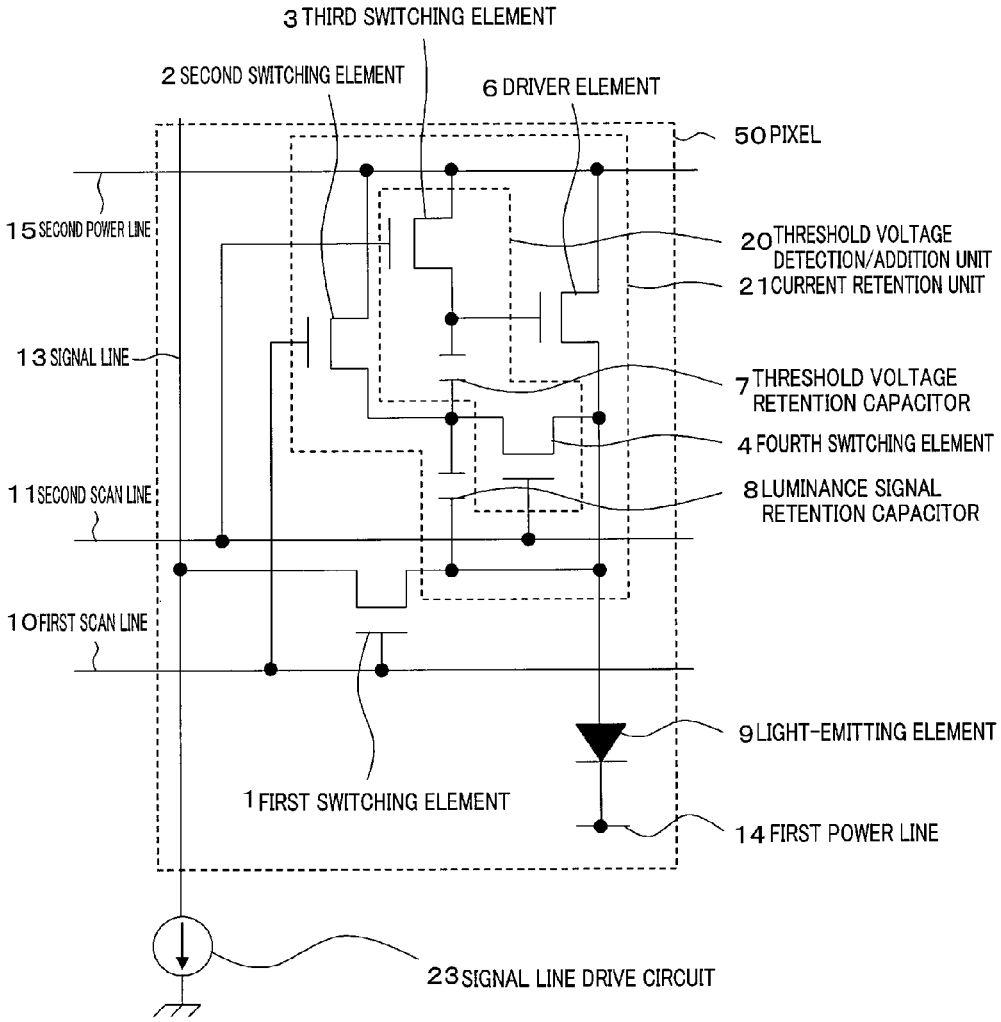
FIG. 26 is a circuit diagram showing the configuration of a light-emitting element circuit where the light-emitting element circuit of FIG. 25 is made up of an FET.
Figure 29:
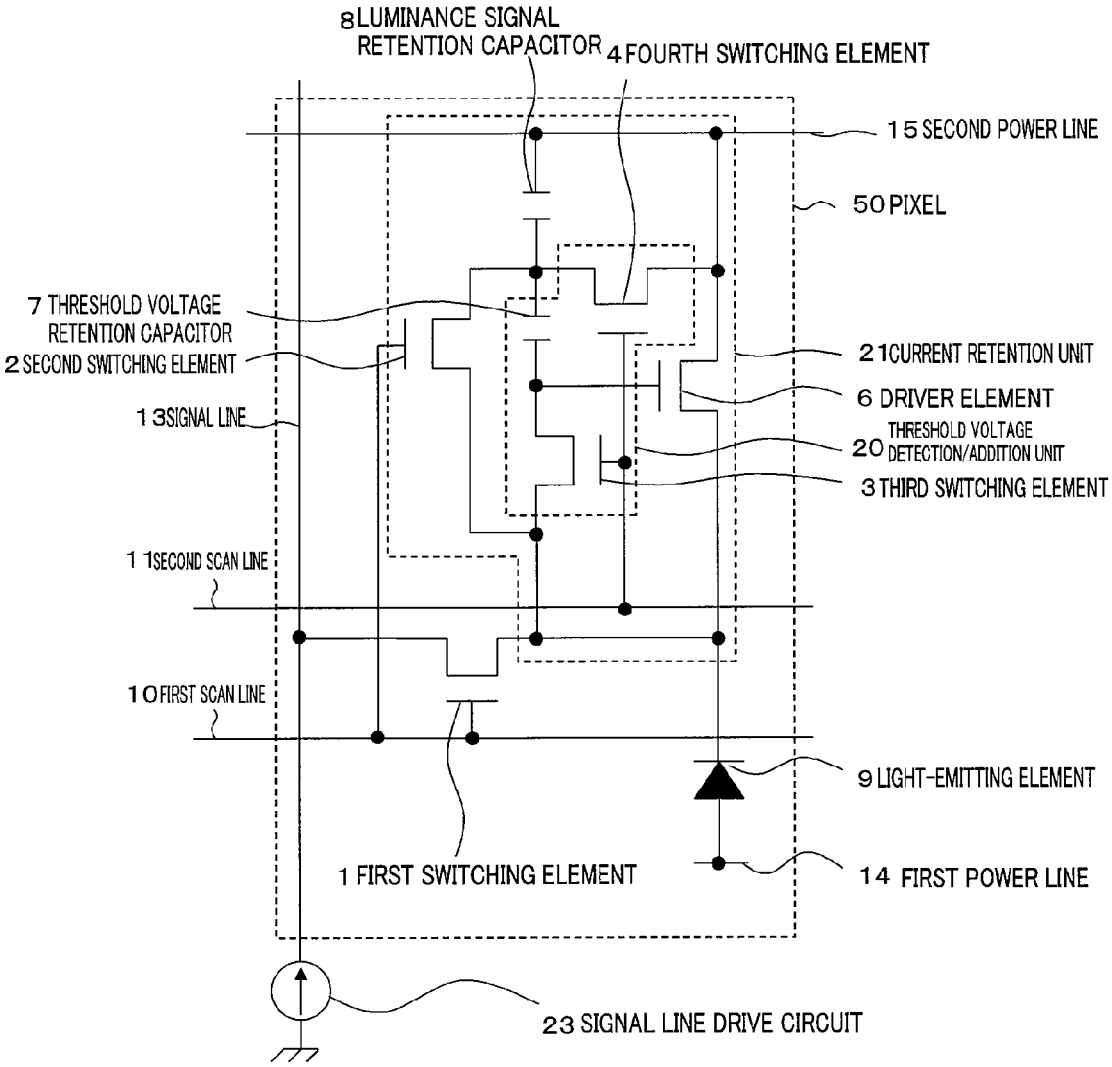
FIG. 29 is a circuit diagram showing the configuration of a light-emitting element circuit where the light-emitting element circuit of FIG. 28 is made up of an FET.
Figure 31:
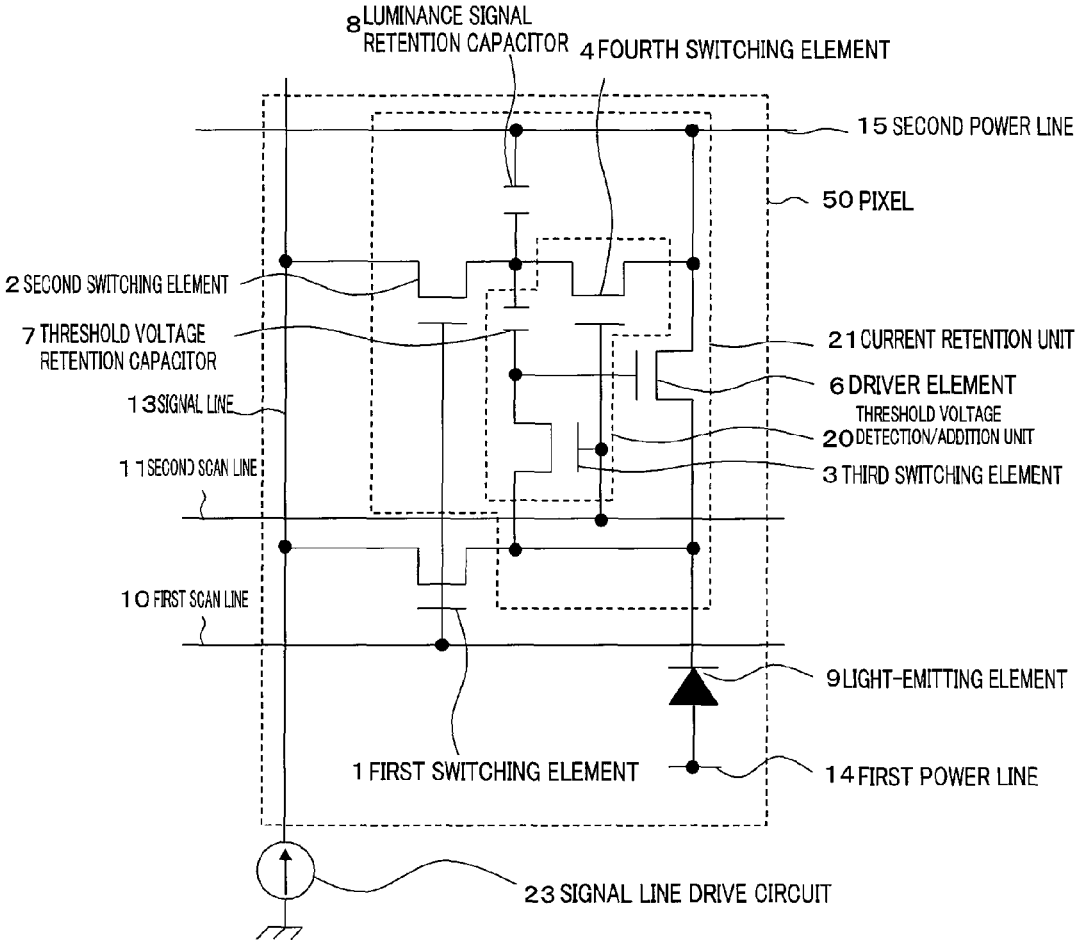
FIG. 31 is a circuit diagram showing the configuration of a light-emitting element circuit where the light-emitting element circuit of FIG. 30 is made up of an FET.

FIGS. 26, 29, 31 (and 32), 35, 37, and 39 are circuit diagrams respectively showing the configurations of light-emitting element circuits where the light-emitting element circuits in FIGS. 25, 28, 30, 34, 36, and 38 are made up of an FET.

In the example illustrated in FIG. 26, the threshold voltage detection and addition unit 20 provided in the current retention unit 21 includes a third switching element 3 for controlling connection between the gate electrode and the drain electrode of the driver element 6, a fourth switching element 4 for controlling connection between both electrodes of the luminance signal retention capacitor 8, and a threshold voltage retention capacitor 7 provided between the gate electrode of the driver element 6 and the first electrode of the luminance signal retention capacitor 8.

The on-off operations of the first switching element 1 and the second switching element 2 are controlled by the first scan line 10, and the on-off operations of the third switching element 3 and the fourth switching element 4 are controlled by the second scan line 11. These first and second scan lines 10 and 11 are driven by a scan line drive circuit.

Also in the examples shown in FIGS. 29, 31, 35, 37, and 39, as in the example of FIG. 26, the threshold voltage detection and addition unit 20 includes a third switching element 3, a fourth switching element 4, and a threshold voltage retention capacitor 7.

Figure 32:
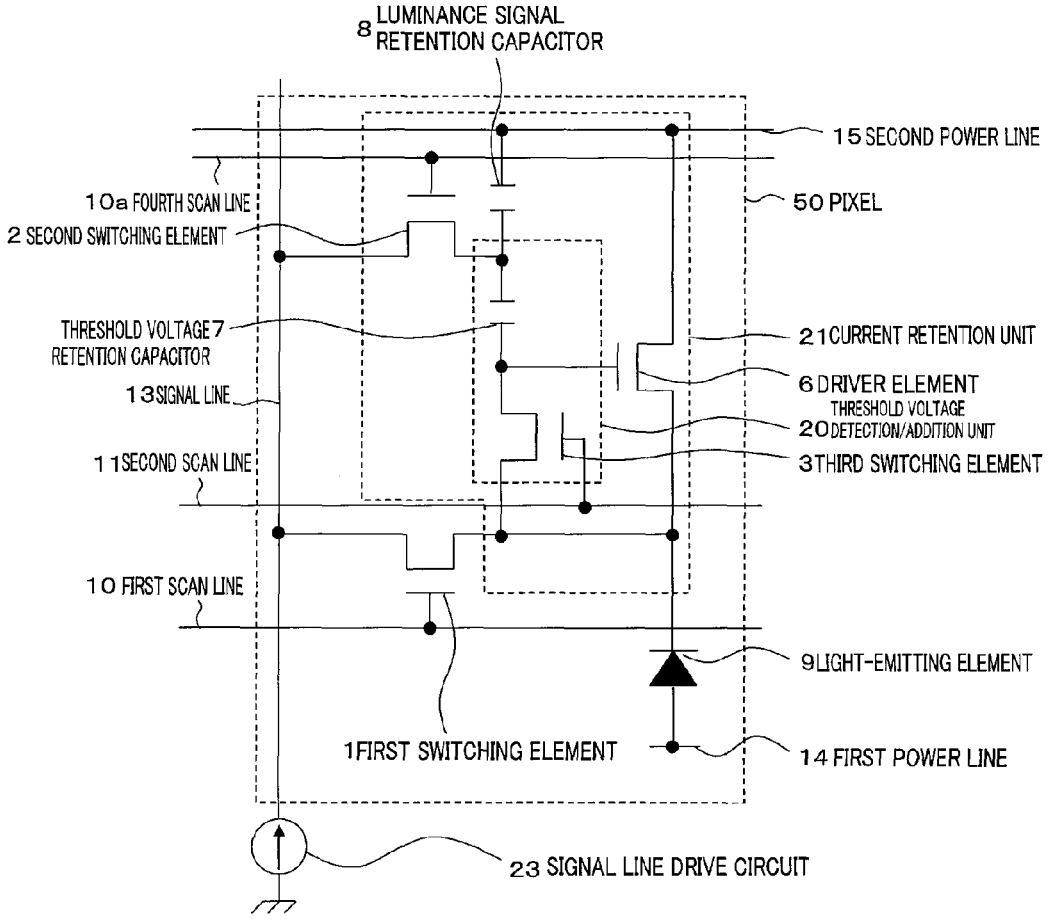
FIG. 32 is a circuit diagram showing the configuration of a light-emitting element circuit where the light-emitting element circuit of FIG. 30 is made up of an FET.

The configuration shown in FIG. 32 is an example that differs from the case of FIG. 31 in that the second switching element 2 is controlled by the fourth scan line 10, and that the fourth switching element 4 is omitted.

With the light-emitting element circuit illustrated in FIG. 26 taken as a typical example, its operation will now be described with reference to the drive waveform shown in FIG. 27. All the FETs are assumed to be of an n-channel type in the configuration example shown in FIG. 26. This, however, is for the sake of convenience of explanation, and the FETs may all be of a p-channel type or a mixture of n-channel and p-channel types.

Figure 27:
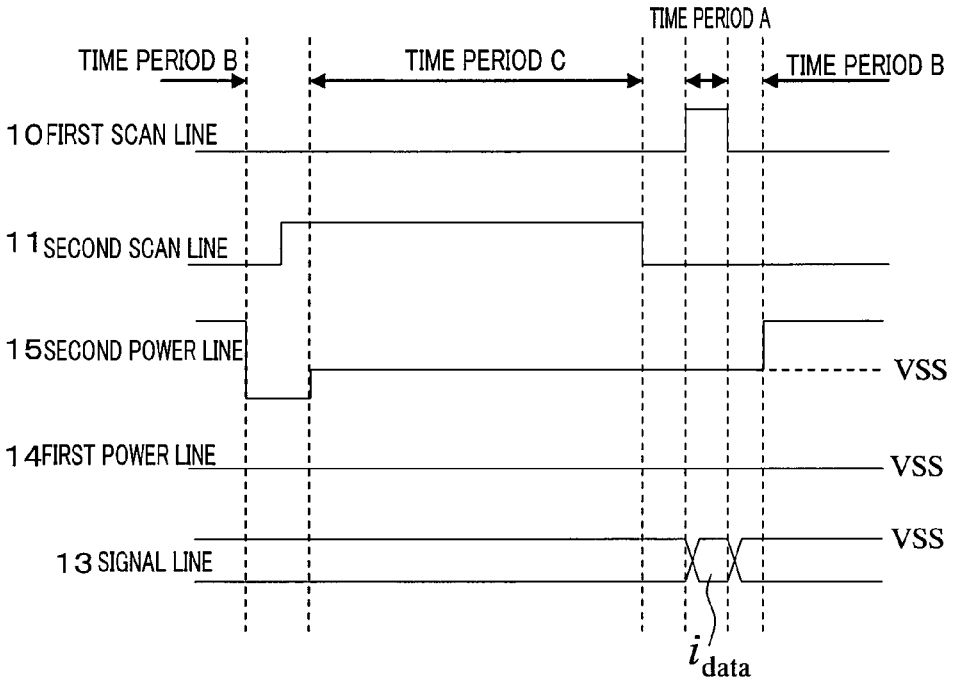
FIG. 27 is a view showing the drive waveform of a light-emitting element circuit included in the display apparatus according to the embodiment 3 of the present invention.

As illustrated in FIG. 27, before the beginning of a time period C, the second scan line 11 is turned to a high voltage state to simultaneously turn on the third switching element 3 and the fourth switching element 4. At this time, both electrodes of the luminance signal retention capacitor 8 are short-circuited by the fourth switching element 4, resulting in a 0-volt potential difference. In addition, the gate electrode and the drain electrode of the driver element 6 are short-circuited by the third switching element 3, and as s result, a sufficiently large voltage is applied between the drain electrode and the source electrode of the driver element 6. This voltage is stored in the threshold voltage retention capacitor 7 by the action of the third switching element 3 and the fourth switching element 4.

Then, by turning the second power line to a low voltage state such that the potential difference between the first power line and the second power line becomes equal to or lower than the rectification starting voltage of the light-emitting element 9, the light-emitting element 9 is turned off and the time period C begins. At this point in time of the beginning of the time period C, because the potential difference between the gate electrode and the source electrode of the driver element 6 is maintained sufficiently large by the threshold voltage retention capacitor 7, the driver element 6 is in the on state.

The current that flows through the driver element 6 flows via the fourth switching element 4 to the threshold voltage retention capacitor 7 and to the light-emitting element 9, because the first switching element 1 is in the off state. As a result, the potential difference that has been stored in the threshold voltage retention capacitor 7 gradually gets smaller until it eventually becomes the threshold voltage of the driver element 6. At this point in time, the driver element 6 becomes off. Now, by putting the second scan line in a low voltage state and turning the third switching element 3 and the fourth switching element 4 to an off state, the recording of the threshold voltage of the driver element 6 on the threshold voltage retention capacitor 7 is completed, and the time period C ends. At this time, the potential difference stored between both electrodes of the luminance signal retention capacitor 8 is 0 volt.

Then, the first scan line 10 is turned to a high voltage state to start a time period A. Assuming that the output current of the signal line drive circuit 23 is Idata, Idata is supplied to the current retention unit 21 via the first switching element 1 during the time period A. At this time, because the second switching element 2 is in the on state, the potential difference between the drain electrode and the source electrode of the driver element 6 is transmitted to the luminance signal retention capacitor 8. This potential difference Vds is represented by the above equation (5), and the potential difference Vgs between the gate electrode and the source electrode of the driver element 6 is represented by the above equation (6).

Thus, also in the embodiment 3, as in the case of embodiment 1, the voltage width that the signal line drive circuit 23 needs to output is not dependent on the threshold voltage of the driver element 6. Consequently, the signal line drive circuit 23 needs not compensate for the threshold voltage of the driver element 6, but only needs to compensate for the mobility, making it possible to lower its design withstand voltage value.

Figure 33:
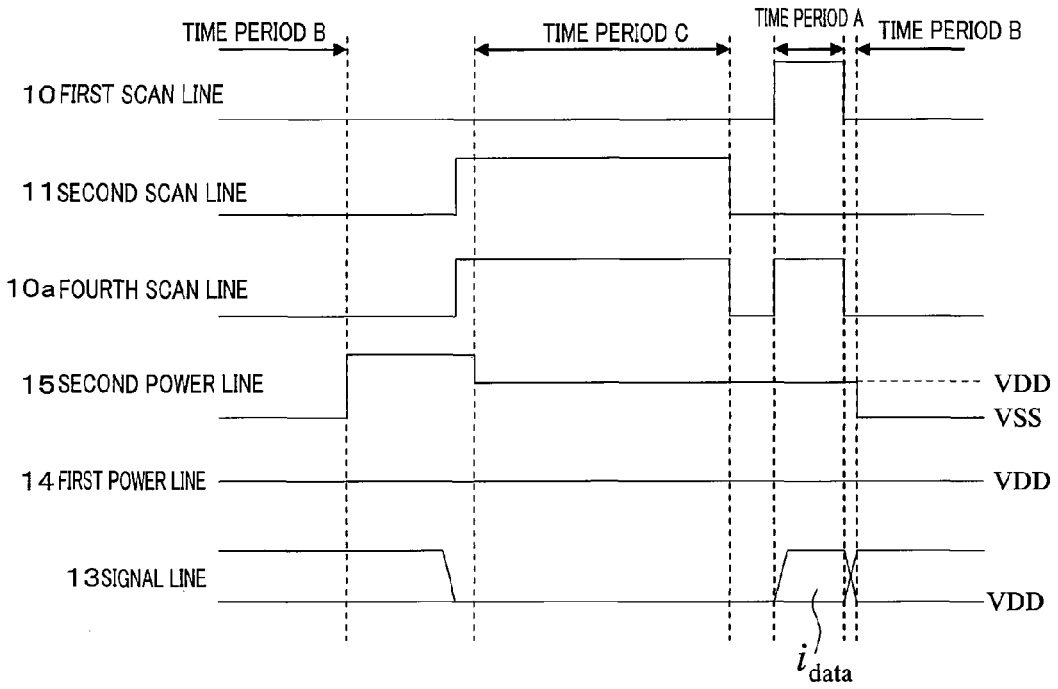
FIG. 33 is a view showing the drive waveform of a light-emitting element circuit included in the display apparatus according to the embodiment 3 of the present invention.

In the case of the light-emitting element circuit shown in FIG. 32, because it has a fourth scan line 10*b*, the drive waveform is as shown in FIG. 33.

Embodiment 4

The light-emitting element circuit included in a display apparatus according to an embodiment 4, unlike in the case of the embodiment 1, is not provided with a fifth switching element, but includes, along with a driver element, a reference driver element having characteristics equivalent to this driver element. A description will now be made of the configuration of the light-emitting element circuit in this embodiment 4.

Figure 40:
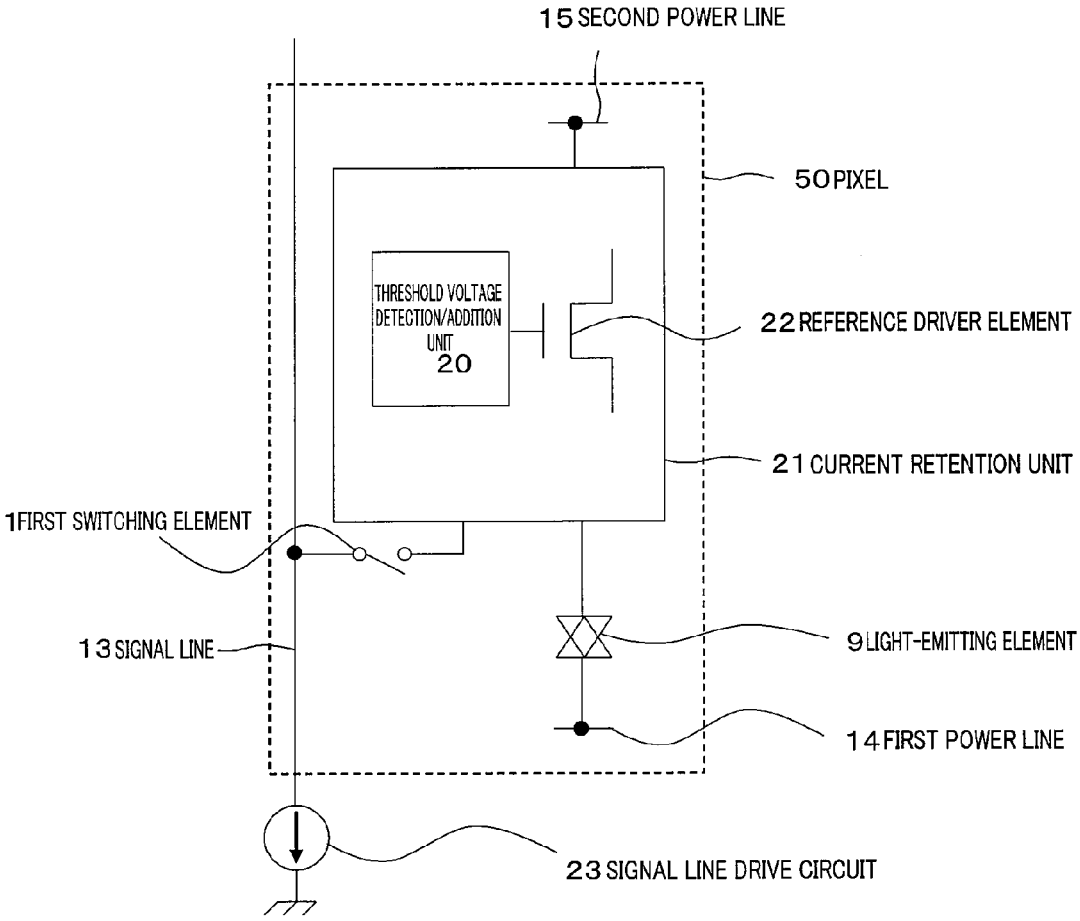
FIG. 40 is a block diagram showing the configuration of a light-emitting element circuit included in a display apparatus according to an embodiment 4 of the present invention.

FIG. 40 is a block diagram showing the configuration of a light-emitting element circuit included in the display apparatus according to the embodiment 4 of the present invention. As illustrated in FIG. 40, a current retention unit 21 included in the light-emitting element circuit denoted by the pixel 50 includes a driver element (not shown) which controls the current value supplied to the light-emitting element 9, a reference driver element 22, and a threshold voltage detection and addition unit 20 which detects the threshold voltage of the reference driver element 22 and causes the detected threshold voltage to be applied at the gate electrode of the driver element and of the reference driver element 22. This current retention unit 21 is connected to a power line 13 via a first switching element 1, and to a second power line 15 and to an electrode of the light-emitting element 9.

The rest of the configuration of the light-emitting element circuit is the same as in the case of the embodiment 1, and thus its description will be omitted.

With this light-emitting element circuit, if the first switching element 1 is turned on, the current signal outputted to the signal line 13 by the signal line drive circuit 23 is supplied to the current retention unit 21. The current retention unit 21 causes the value obtained by adding the threshold voltage of the reference driver element 22 to the potential generated between the drain electrode and the source electrode of the reference driver element 22 to emerge at the gate electrode of the driver element and of the reference driver element 22, and causes the summed value to be retained by a capacitor.

Figure 41:
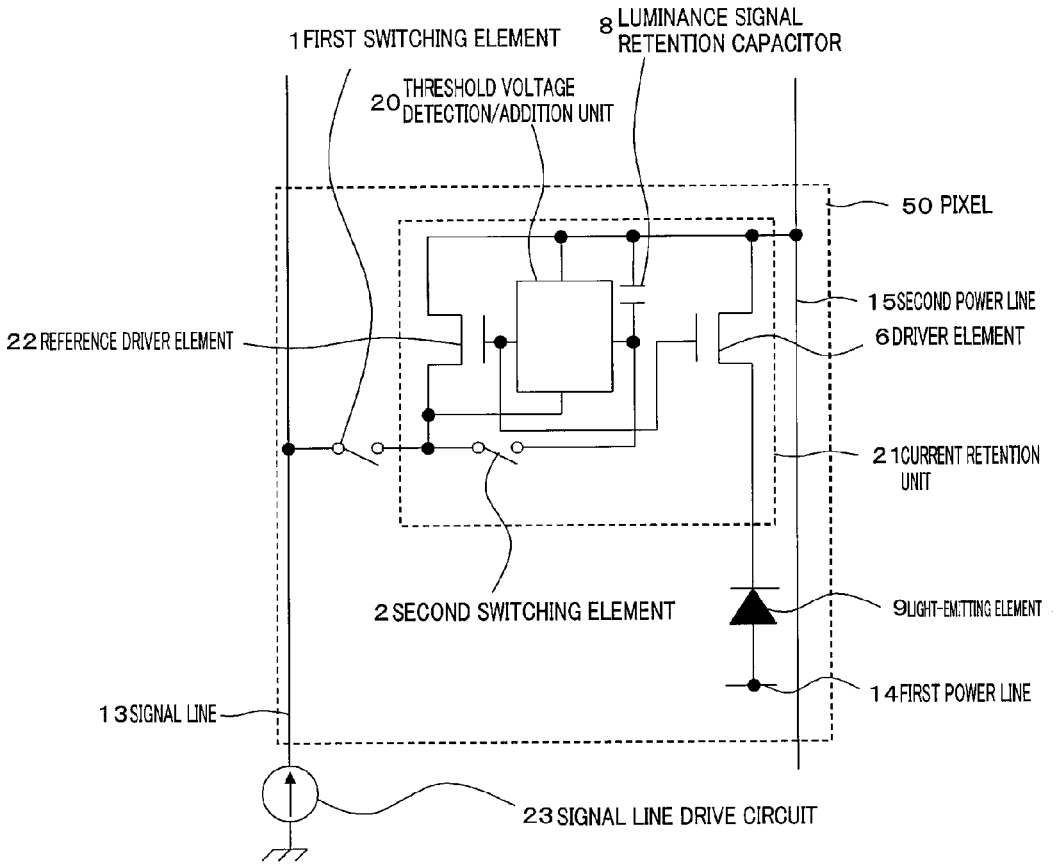
FIG. 41 is a block diagram showing the detailed configuration of a light-emitting element circuit included in the display apparatus according to the embodiment 4 of the present invention.

A further detailed configuration of the light-emitting element circuit is shown in FIGS. 41, 44, 46, and 48. As illustrated in FIG. 41, the current retention unit 21 includes a second switching element 2 disposed between the threshold voltage detection and addition unit 20 and the second power line 15, and a luminance signal retention capacitor 8 which retains, as a luminance signal voltage, the potential difference generated between the drain electrode and the source electrode of the reference driver element 22 when a luminance signal is supplied via the signal line 13.

When the first switching element 1 is turned on, the signal current which the signal line drive circuit 23 outputs flows through the reference driver element 22 by way of the signal line 13. At this time, because the second switching element 2 is in the on state, the voltage generated between the drain electrode and the source electrode of the reference driver element 22 is transmitted to the luminance signal retention capacitor 8. By thereafter turning the second switching element 2 off, the voltage is retained in the luminance signal retention capacitor 8.

While a signal current Idata is flowing through the reference driver element 22, the potential of the gate electrode of the reference driver element 22 is maintained by the threshold voltage detection and addition unit 20 at a higher level than the drain potential of the reference driver element 22 by as much as the threshold voltage of the reference driver element 22. Accordingly, the voltage generated and retained across both electrodes ends of the luminance signal retention capacitor 8 is represented by the above equation (4).

Therefore, also in the embodiment 2, the output voltage of the current output stage of the signal line drive circuit 23 is unaffected by the threshold voltage of the reference driver element 22.

Figure 46:
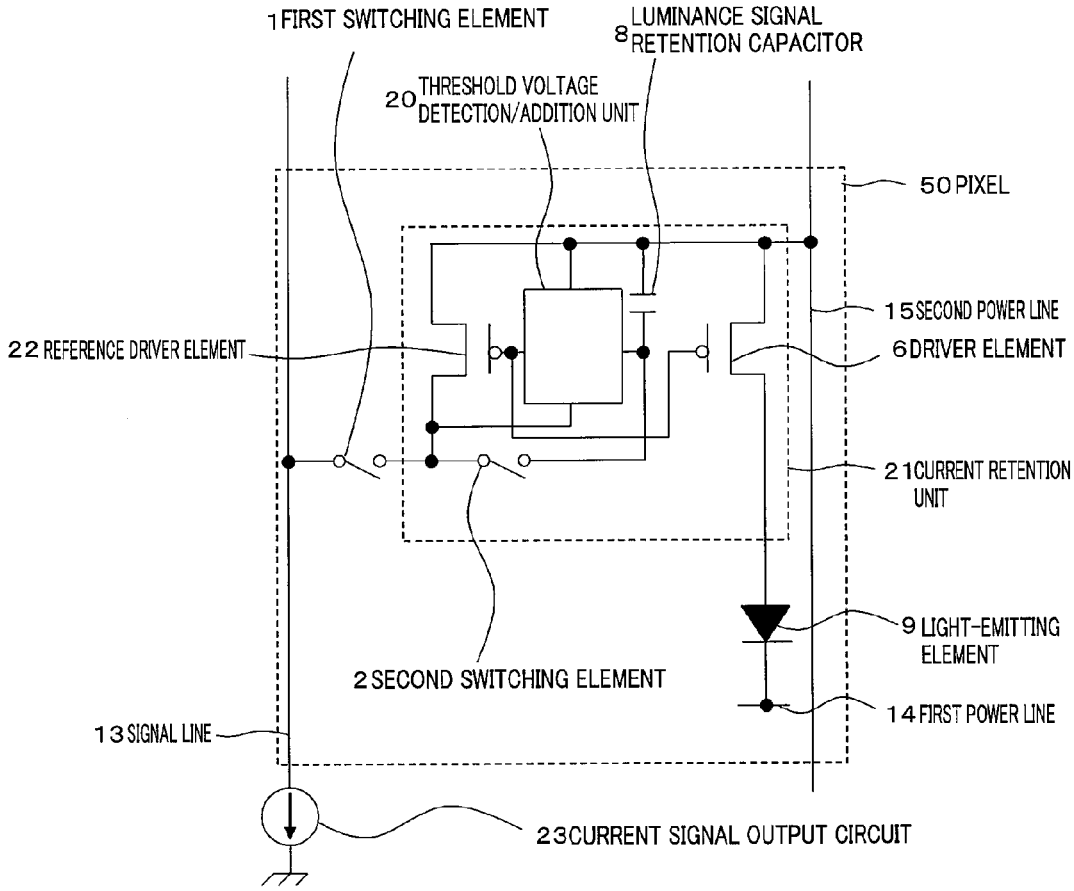
FIG. 46 is a block diagram showing the detailed configuration of a light-emitting element circuit included in the display apparatus according to the embodiment 4 of the present invention.

An example is shown in FIG. 46 in which the polarity of the light-emitting element 9 is reversed as compared with this example of FIG. 41.

Figure 44:
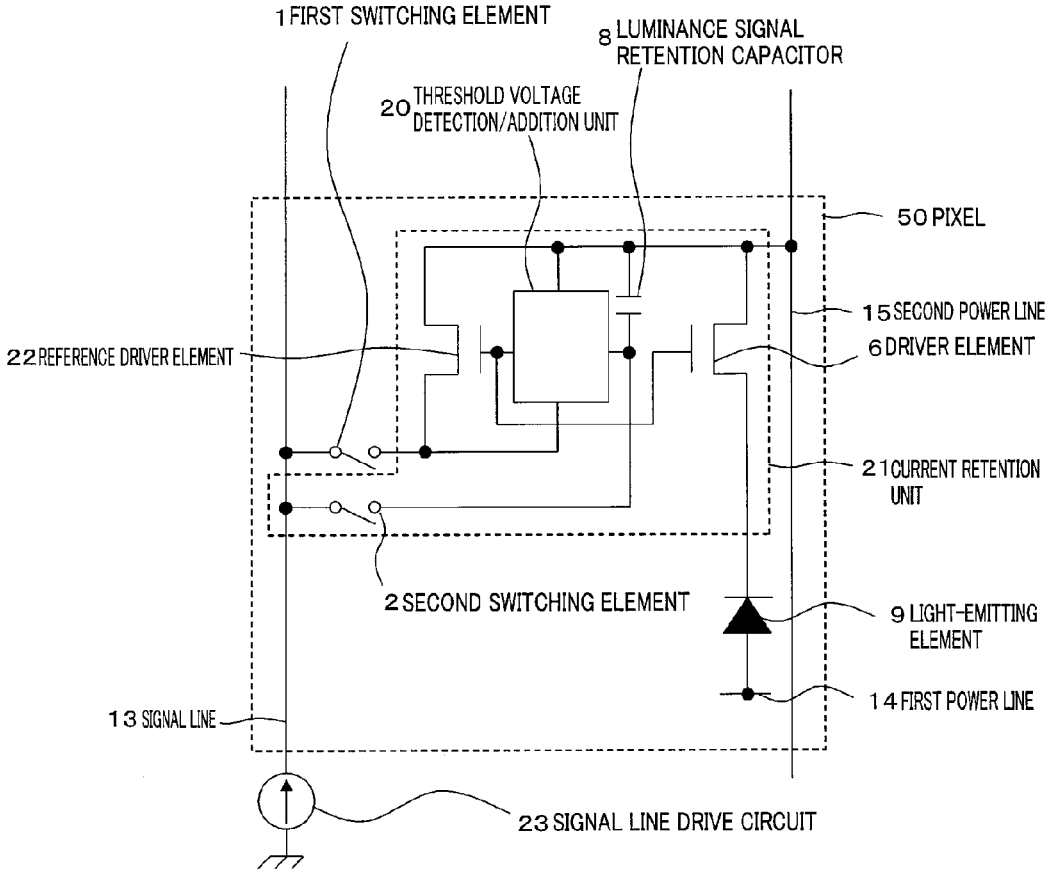
FIG. 44 is a block diagram showing the detailed configuration of a light-emitting element circuit included in the display apparatus according to the embodiment 4 of the present invention.
Figure 48:
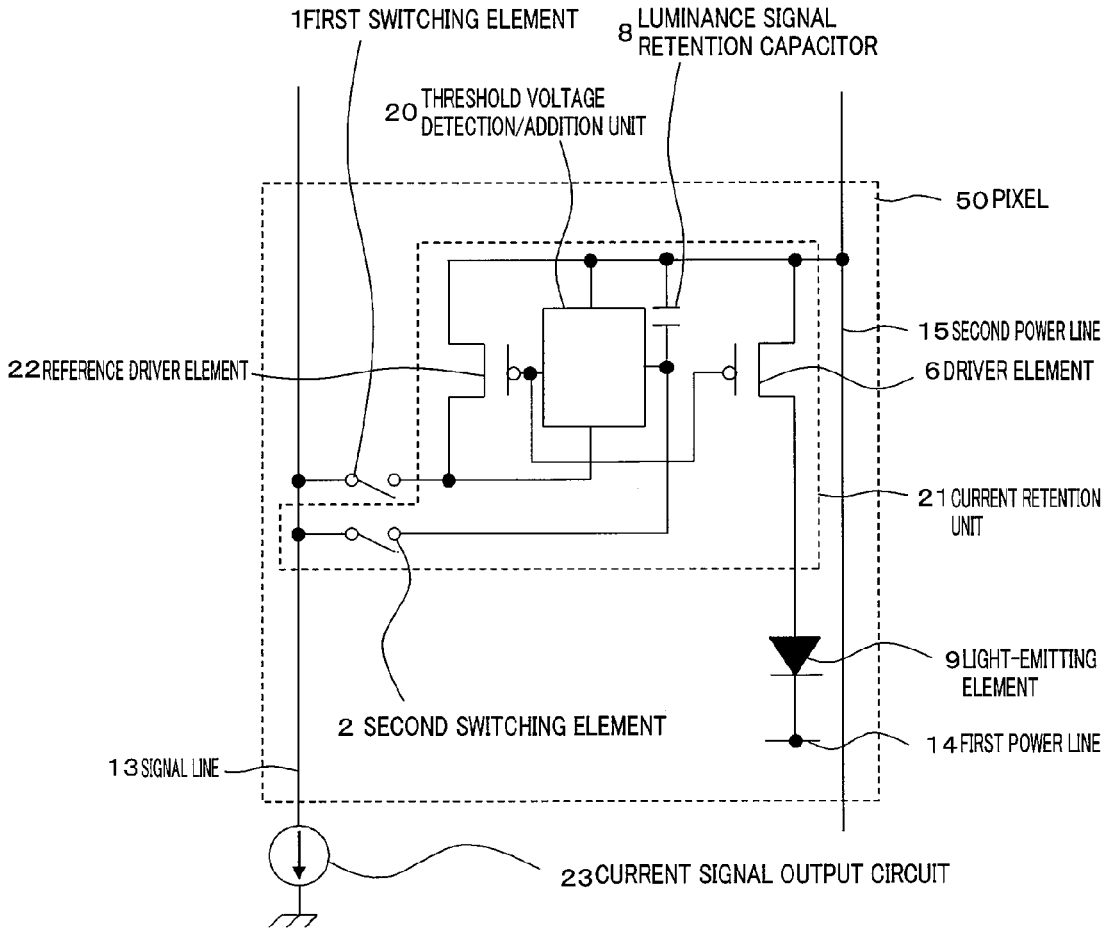
FIG. 48 is a block diagram showing the detailed configuration of a light-emitting element circuit included in the display apparatus according to the embodiment 4 of the present invention.

In addition, in the example illustrated in FIG. 44, the current retention unit 21 includes a second switching element 2 disposed between the luminance signal retention capacitor 8 and the signal line 13. FIG. 48 shows an example in which the light-emitting element 9 is opposite in polarity as compared with this example of FIG. 44.

FIGS. 42, 45, 47, and 49 are circuit diagrams respectively showing the configurations of light-emitting element circuits where the light-emitting element circuits in FIGS. 41, 43, 45, and 48 are made up of an FET.

Figure 42:
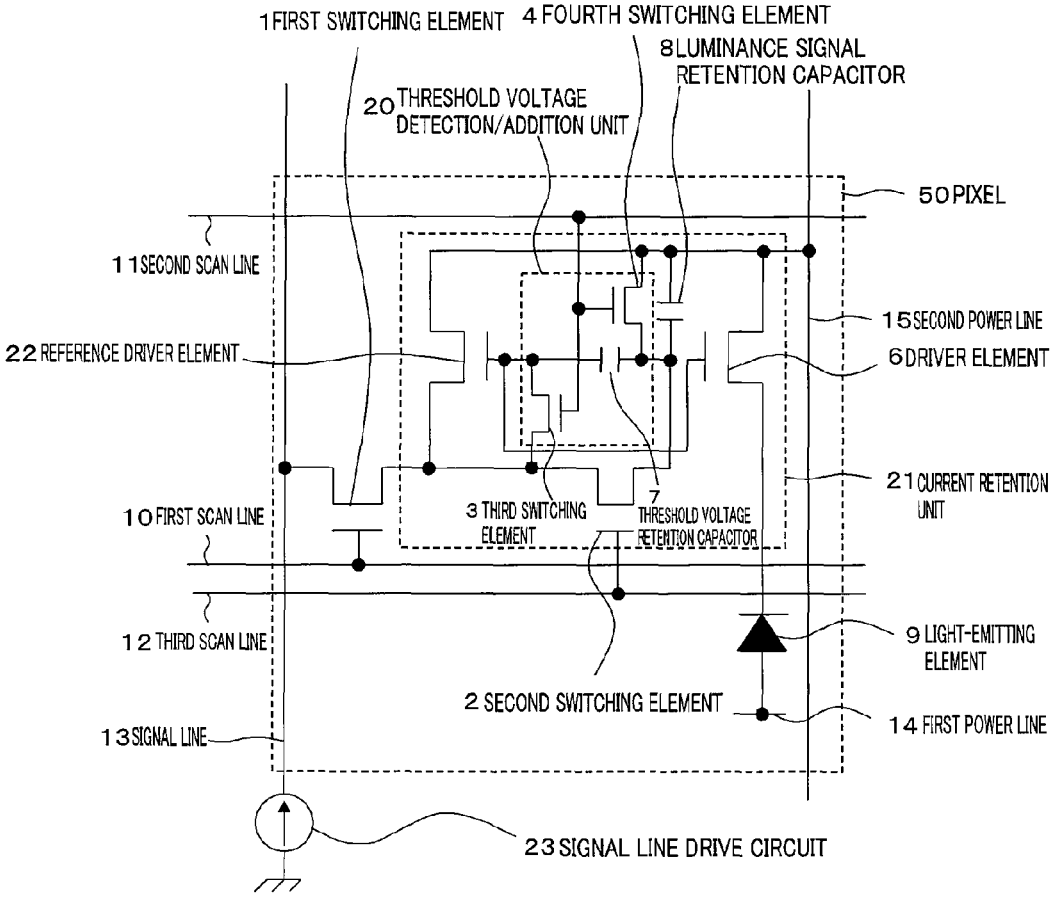
FIG. 42 is a circuit diagram showing the configuration of a light-emitting element circuit where the light-emitting element circuit of FIG. 41 is made up of an FET.

In the example illustrated in FIG. 42, the threshold voltage detection and addition unit 20 provided in the current retention unit 21 includes a third switching element 3 for controlling connection between the gate electrode and the drain electrode of the reference driver element 22, a fourth switching element 4 for controlling connection between both electrodes of the luminance signal retention capacitor 8, and a threshold voltage retention capacitor 7 disposed between the gate electrode of the reference driver element 22 and the first electrode of the luminance signal retention capacitor 8.

The on-off operations of the first switching element 1 and the second switching element 2 are controlled by the first scan line 10 and the third scan line 12, respectively. Additionally, the on-off operations of the third switching element 3 and the fourth switching element 4 are controlled by the second scan line 11. These first to third scan lines 10 to 12 are driven by a scan line drive circuit.

Figure 45:
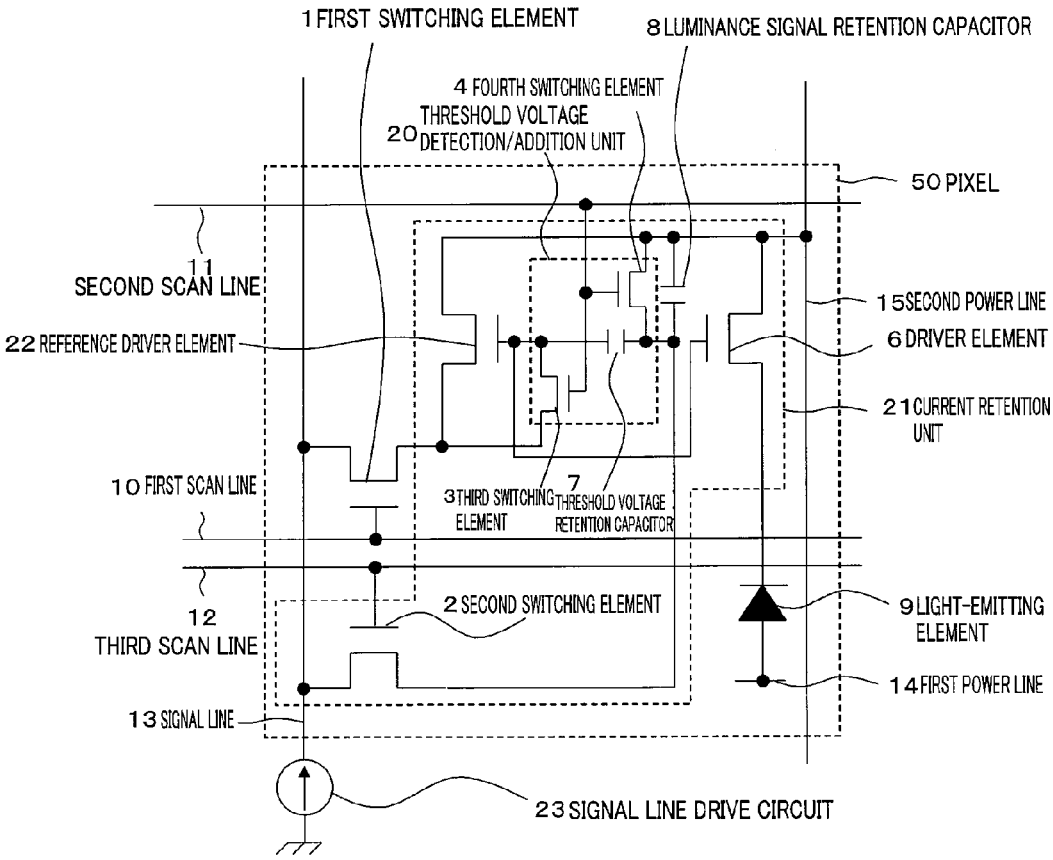
FIG. 45 is a circuit diagram showing the configuration of a light-emitting element circuit where the light-emitting element circuit of FIG. 44 is made up of an FET.
Figure 47:
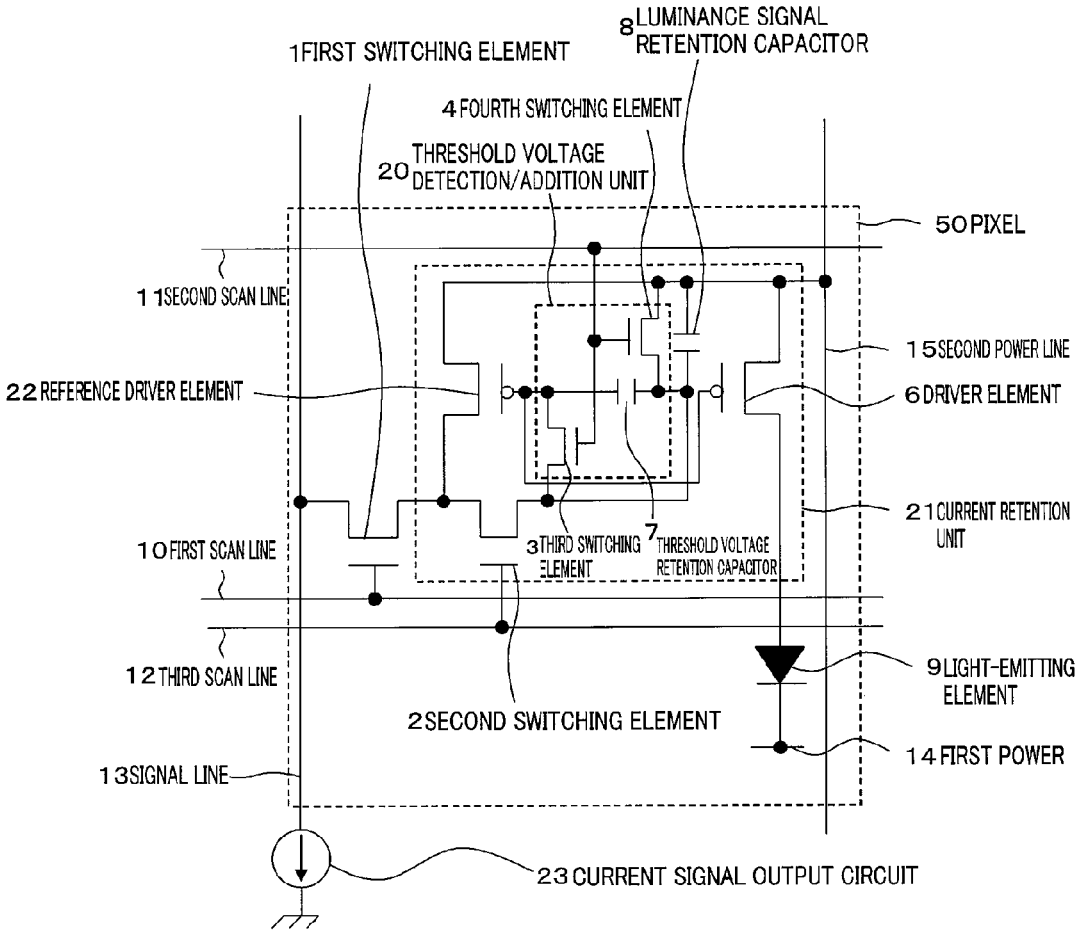
FIG. 47 is a circuit diagram showing the configuration of a light-emitting element circuit where the light-emitting element circuit of FIG. 46 is made up of an FET.
Figure 49:
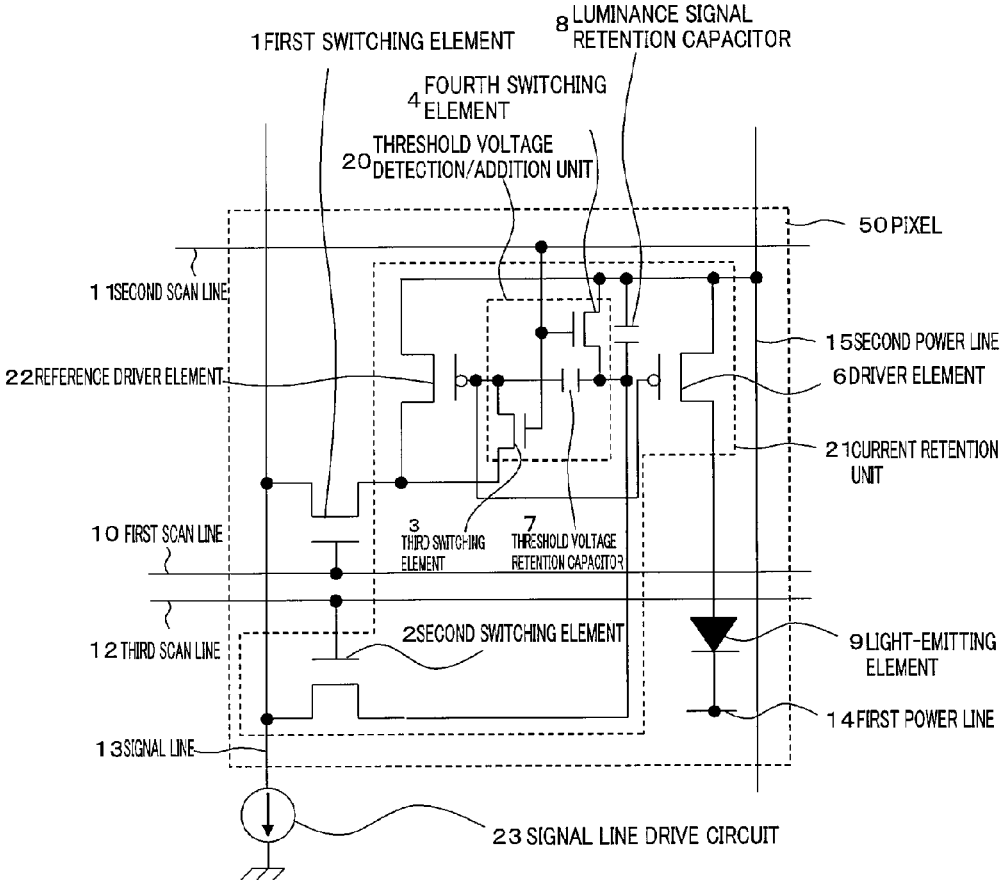
FIG. 49 is a circuit diagram showing the configuration of a light-emitting element circuit where the light-emitting element circuit of FIG. 48 is made up of an FET.
Figure 50:
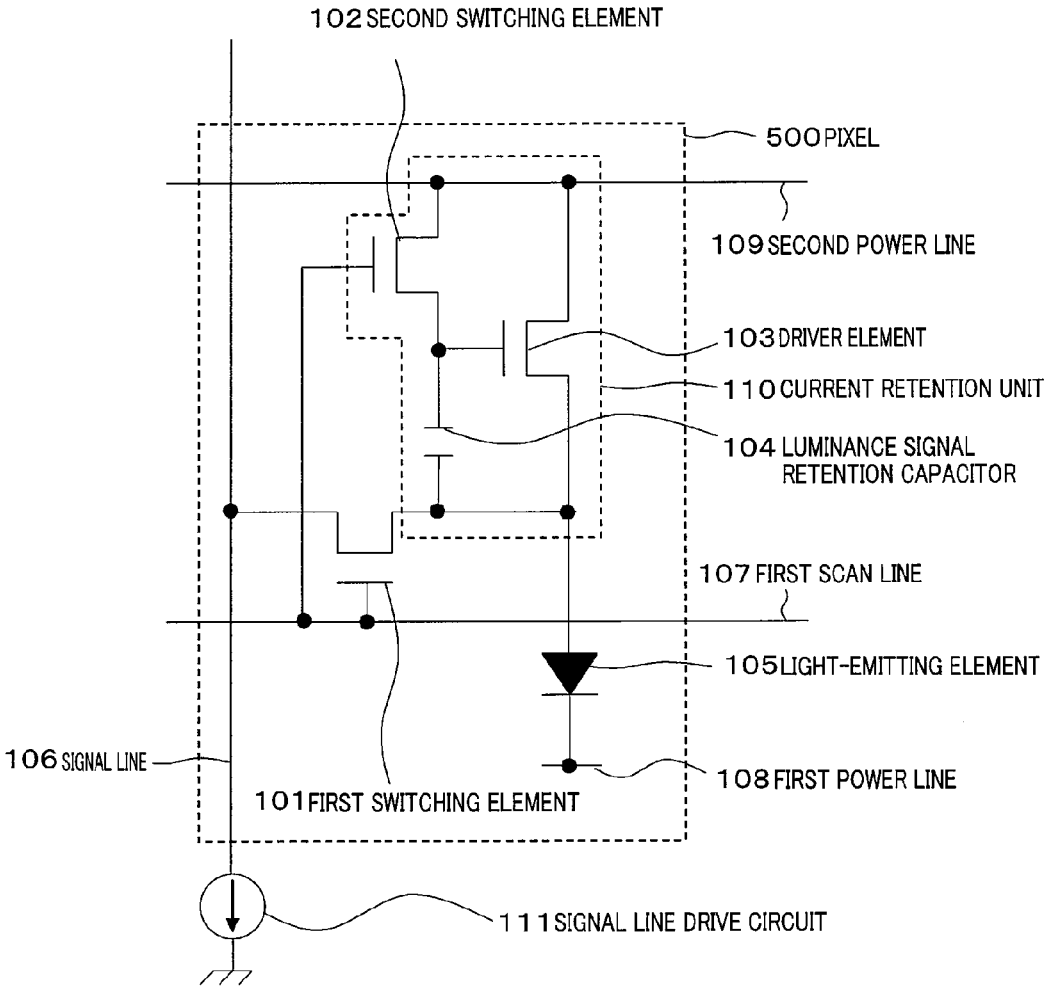
FIG. 50 is a block diagram showing the configuration of a conventional current-writing method pixel compensation circuit.
Figure 51:
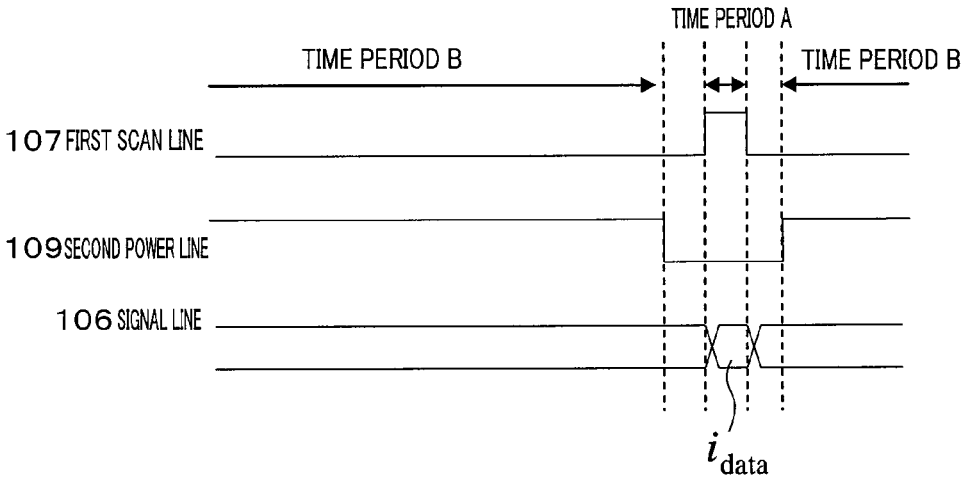
FIG. 51 is a timing chart representing the operation of the conventional pixel compensation circuit.

Also in the examples shown in FIGS. 45, 47, and 49, as in the example of FIG. 42, the threshold voltage detection and addition unit 20 includes a third switching element 3, a fourth switching element 4, and a threshold voltage retention capacitor 7.

Taking the light-emitting element circuit of FIG. 42 as a typical example, its operation will now be described with reference to the drive waveform shown in FIG. 43. All the FETs are assumed to be of an n-channel type in the configuration example shown in FIG. 42. This, however, is for the sake of convenience of explanation, and the FETs may all be of a p-channel type or a mixture of n-channel and p-channel types.

Figure 43:
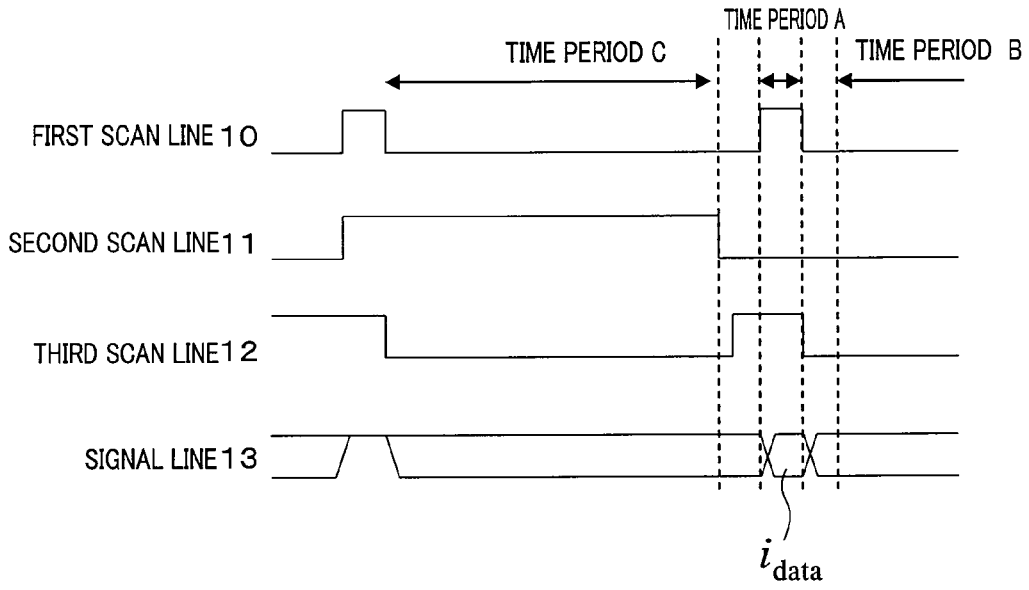
FIG. 43 is a view showing the drive waveform of a light-emitting element circuit included in the display apparatus according to the embodiment 4 of the present invention.

As illustrated in FIG. 43, before the beginning of a time period C, the second scan line 11 and the third scan line 12 are turned to a high voltage state to simultaneously turn on the second switching element 2, the third switching element 3 and the fourth switching element 4. At this time, both electrodes of the luminance signal retention capacitor 8 are short-circuited by the fourth switching element 4, resulting in a 0-volt potential difference. Furthermore, the gate electrode and the drain electrode of the reference driver element 22 are short-circuited by the third switching element 3 and, because the second switching element 2 is in the on state, a sufficiently large voltage is applied between the drain electrode and the source electrode of the reference driver element 22. This voltage is stored in the threshold voltage retention capacitor 7 by the action of the third switching element 3 and the fourth switching element 4.

Then, by turning the third scan line 12 to a low voltage state, the second switching element 2 becomes off and the time period C starts. At this point in time of the beginning of the time period C, because the potential difference between the gate electrode and the source electrode of the reference driver element 22 is maintained sufficiently large by the threshold voltage retention capacitor 7, the reference driver element 22 is in the on state.

The current that flows through the reference driver element 22 flows into the threshold voltage retention capacitor 7 via the fourth switching element 4, because the first switching element 1 is in the off state. As a result, the potential difference that has been stored in the threshold voltage retention capacitor 7 gradually gets smaller until it eventually becomes the threshold voltage of the reference driver element 22. Now, by putting the second scan line in a low voltage state and turning the third switching element 3 and the fourth switching element 4 to an off state, the recording of the threshold voltage of the reference driver element 22 in the threshold voltage retention capacitor 7 is completed, and the time period C ends. At this time, the potential difference stored between both electrodes of the luminance signal retention capacitor 8 is 0 volt.

Next, the first scan line 10 is turned to a high voltage state to start a time period A. Assuming that the output current of the signal line drive circuit 23 is Idata, Idata is supplied to the current retention unit 21 via the first switching element 1 during the time period A. At this time, because the second switching element 2 is in the on state, the potential difference between the drain electrode and the source electrode of the reference driver element 22 is transmitted to the luminance signal retention capacitor 8. This potential difference Vds is represented by the above equation (5), and the potential difference Vgs between the gate electrode and the source electrode of the reference driver element 22 is represented by the above equation (6).

Thus, also in the embodiment 4, as in the case of embodiment 1, the voltage width that the signal line drive circuit 23 needs to output is not dependent on the threshold voltage of the reference driver element 22. Consequently, the signal line drive circuit 23 needs not compensate for the threshold voltage of the reference driver element 22, but only needs to compensate for the mobility, making it possible to lower its design withstand voltage value.

From the foregoing description, various improvements and other embodiments of the present invention will be apparent to a person skilled in the art. Accordingly, the above description should be construed as examples only, it being provided for the purpose of offering the skilled person the best mode for carrying out the invention. A substantial change can be made in the particulars of the structure and/or function of the present invention without departing from its spirit.

INDUSTRIAL APPLICABILITY

The active matrix type display apparatus of the present invention enables to make a reduction in the design withstand voltage of a signal line drive circuit, and is useful as an organic EL display apparatus and various other display apparatuses, and the like.

What is claimed is:

1. An active matrix type display apparatus including a plurality of pixels disposed in a matrix arrangement, each of the pixels comprising:

a light-emitting element having a first electrode and a second electrode, which emits light in response to a current supplied via the first and second electrodes;

a first power line connected to the first electrode of the light-emitting element;

a second power line;

a signal line connected to a signal line drive circuit which supplies a luminance signal corresponding to a luminance of light emission of the light-emitting element, the luminance signal being a current signal;

a first switching element, one of a drain electrode and a source electrode of which is connected to the signal line, and which has a gate electrode connected to a first scan line;

a driver element, one of a drain electrode and a source electrode of which is connected to the other of the drain electrode and the source electrode of the first switching element, and the other of which is connected to the second electrode of the light-emitting element or to the second power line;

a luminance signal retention capacitor having a first electrode and a second electrode, the second electrode being connected to the source electrode of the driver element;

a second switching element, one of a drain electrode and a source electrode of which is connected to the first electrode of the luminance signal retention capacitor, and the other of which is connected to the signal line or to the drain electrode of the driver element; and a threshold voltage detection and addition unit having a first terminal connected to the gate electrode of the driver element, a second terminal electrically separately provided from the first terminal and connected to the first electrode of the luminance signal retention capacitor, and a third terminal connected to a second scan line, which detects a threshold voltage of the driver element and causes a voltage obtained by adding the threshold voltage to a potential of the second terminal to be applied at the first terminal.

2. The active matrix type display apparatus according to claim 1, wherein the threshold voltage detection and addition unit comprises:

a threshold voltage retention capacitor having a first electrode connected to the first terminal and a second electrode connected to the second terminal.

3. The active matrix type display apparatus according to claim 2, wherein the driver element is an n-channel type transistor, wherein the threshold voltage detection and addition unit comprises:

a first diode element having an anode terminal connected to the first terminal and a cathode terminal connected to the second terminal; and a second diode element having an anode terminal connected to the third terminal and a cathode terminal connected to the first terminal, and wherein a threshold voltage of the first diode element is controlled such that a value obtained by dividing an absolute value of the threshold voltage of the first diode element by an absolute value of the threshold voltage of the driver element becomes a positive value of 1 or less.

4. The active matrix type display apparatus according to claim 2, wherein the driver element is a p-channel type transistor, wherein the threshold voltage detection and addition unit comprises:

a first diode element having a cathode terminal connected to the first terminal and an anode terminal connected to the second terminal; and a second diode element having a cathode terminal connected to the third terminal and an anode terminal connected to the first terminal, and wherein a threshold voltage of the first diode element is controlled such that a value obtained by dividing an absolute value of the threshold voltage of the first diode element by an absolute value of the threshold voltage of the driver element becomes a positive value of 1 or less.

5. The active matrix type display apparatus according to claim 2, wherein the threshold voltage detection and addition unit further comprises:

a fourth terminal connected to the source electrode of the driver element, and wherein each of the pixels comprises:

a third switching element, either one of a drain electrode and a source electrode of which is connected to the first terminal, and the other of which is connected to the fourth terminal, and which has a gate electrode connected to the third terminal.

6. The active matrix type display apparatus according to claim 2, wherein the threshold voltage detection and addition unit further comprises:

a fourth terminal connected to the drain electrode of the driver element, and further comprises:

a third switching element, one of a drain electrode and a source electrode of which is connected to the first terminal, and the other of which is connected to the fourth terminal.

7. The active matrix type display apparatus according to claim 6, wherein the threshold voltage detection and addition unit further comprises:

a fifth terminal; and a fourth switching element, one of a drain electrode and a source electrode of which is connected to the second terminal, and the other of which is connected to the fifth terminal.

8. The active matrix type display apparatus according to claim 1, wherein the switching element or the driver element is constituted by a field-effect transistor.

9. The active matrix type display apparatus according to claim 8, wherein the field-effect transistor is constituted by a thin-film transistor.

10. The active matrix type display apparatus according to claim 1, wherein the light-emitting element is an organic EL element.

* * * * *